US005524396A

United States Patent [19]

Lalvani

[11] Patent Number: 5,524,396

[45] Date of Patent: Jun. 11, 1996

[54] SPACE STRUCTURES WITH NON-PERIODIC SUBDIVISIONS OF POLYGONAL FACES

[76] Inventor: Haresh Lalvani, 164 Bank St., Apt. 2B, New York, N.Y. 10014

[21] Appl. No.: 75,145

[22] Filed: Jun. 10, 1993

[51] Int. Cl.[6] ..... E04B 1/32

[52] U.S. Cl. ..... 52/81.1; 52/81.2; 52/311.2; 52/DIG. 10

[58] Field of Search ..... 52/81.2, 311, DIG. 10, 52/81.1

[56] References Cited

U.S. PATENT DOCUMENTS

| | | | |
|---|---|---|---|
| 1,976,188 | 9/1934 | Hozawa | 52/81.2 |
| 2,361,540 | 10/1944 | Forbes | 52/81.2 |
| 2,978,704 | 4/1961 | Cohen et al. | 52/81.2 |
| 3,058,550 | 9/1962 | Richter | 52/81.2 |
| 3,154,887 | 11/1964 | Schmidt | 52/81.2 |
| 3,722,153 | 3/1973 | Baer . | |
| 4,133,152 | 1/1979 | Penrose . | |
| 5,007,220 | 4/1991 | Lalvani . | |
| 5,036,635 | 8/1991 | Lalvani | 52/8 |

OTHER PUBLICATIONS

Uniform Ant–hills in the World of Golden Isozonohedra by K. Miyazaki, Structural Topology, #4, 1980 pp. 21–30 (Canada).

Fourfield: Computers, Art & the 4th Dimension by Tony Robbin, Bullfinch Press, 1992 pp. 81–94.

Regular Polytopes by H. S. M. Coxeter, Dover, 1963, pp. 27–33.

*Primary Examiner*—Wynn E. Wood

[57] ABSTRACT

A family of space structures having subdivided faces, where such faces are subdivided into rhombii in non-periodic arrangements. The rhombii are derived from regular planar stars with n vectors, and the source space structures are composed of regular polygons. The family includes: globally symmetric structures where the fundamental region is subdivided non-periodically, or globally asymmetric structures composed of regular polygons which are subdivided non-periodically or asymmetrically. The rhombii can be further subdivided periodically or non-periodically. The family further includes all regular polyhedra in the plane-faced and curve-faced states, regular tessellations, various curved polygons, cylinders and toroids, curved space labyrinths, and regular structures in higher-dimensional and hyperbolic space. The structures can be isolated structures or grouped to fill space. Applications include architectural space structures, fixed or retractable space frames, domes, vaults, saddle structures, plane or curved tiles, model-kits, toys, games, and artistic and sculptural works realized in 2- and 3-dimensions. The structures could be composed of individual units capable of being assembled or disassembled, or structures which are cast in one piece, or combination of both. Various tensile and compressive structural systems, and techniques of triangulation could be used as needed for stability.

25 Claims, 57 Drawing Sheets

165

166

167

168

| | | | | | | | |
|---|---|---|---|---|---|---|---|
| q=∞ | {2,∞} | {3,∞} | {4,∞} | {5,∞} | {6,∞} | {7,∞} | ...{∞,∞} |
| | ⋮ | ⋮ | ⋮ | ⋮ | ⋮ | ⋮ | ⋮ |
| q=7 | {2,7} | {3,7} | {4,7} | {5,7} | {6,7} | {7,7} | ...{∞,7} |
| q=6 | {2,6} |  {3,6} | {4,6} | {5,6} | {6,6} | {7,6} | ...{∞,6} |
| q=5 | {2,5} |  {3,5} | {4,5} | {5,5} | {6,5} | {7,5} | ...{∞,5} |
| q=4 | {2,4} |  {3,4} |  {4,4} | {5,4} | {6,4} | {7,4} | ...{∞,4} |
| q=3 | {2,3} |  {3,3} |  {4,3} |  {5,3} |  {6,3} | {7,3} | ...{∞,3} |
| q=2 | {2,2} | {3,2} | {4,2} | {5,2} | {6,2} | {7,2} | ...{∞,2} |
| | p=2 | p=3 | p=4 | p=5 | p=6 | p=7 | p=∞ | q → p

SPACE STRUCTURES WITH NON-PERIODIC SUBDIVISIONS OF POLYGONAL FACES

FIELD OF THE INVENTION

This invention relates to building structures based on non-periodic subdivisions of regular space structures with plane or curved faces. In some cases, the fundamental region are subdivided non-periodically and the structures have global symmetry, in other cases the entire polygonal faces of space space structures are subdivided non-periodically and the structures may or may not have symmetry. In addition, this invention relates to further subdivisions of such space structures which are locally periodic. The space structures considered include all regular polyhedra in the plane-faced and curve-faced states, various curved polygons, cylinders and toroids, curved spaced labyrinths, and structures in higher-dimensional and hyperbolic space. The structures can be isolated structures or grouped to fill space.

BACKGROUND OF THE INVENTION

The use of curved lines (arches, curved beams) and curved surfaces (shells, vaults, domes, membranes) in architecture arises out of several needs. There is the pragmatic need for the efficient use of material to cover space, an idea that becomes increasingly relevant with depleting resources. This economy of material can translate into decreased costs of building. There is the architectural need for "comfort" in inhabiting spaces and structures that are "organic" and mirror the constructions in nature. There is the philosophical need for living in harmony with nature. For these reasons, curved space structures are desirable in architecture.

Curved space structures are characterized by curved surfaces and curved lines. The curved surfaces can be single-curved as in cones and cylinders, or doubly-curved as in spheres and saddles. Architectural structures based on singly-curved and doubly-curved surfaces are well-known. In either case, the surfaces can be continuously smooth surfaces as in cast shells made of concrete or plastics, or tensile membranes made of reinforced nylon fabrics. Alternatively, the curved surfaces can be decomposed into polygonal areas which can be manufactured separately as parts of the structure and the entire surface assembled out of these pre-made parts. Such space structures have relied upon a geometric subdivision of the surface into polygonal areas. In all prior art, such geometric subdivision is based on periodic subdivision of the fundamental region of the structure; the fundamental region is the minimum spatial unit of the structure from which the entire structure can be generated using symmetry operations of reflection, rotation, translation and their combinations. In addition, the prior art of modular space structures has retained the global symmetry of the space structure.

In contrast to the prior works, this application discloses three new classes of curved space structures not taught by the prior art of building. One class comprises globally symmetric space structures where the fundamental region is subdivided into rhombii in a non-periodic manner. The second class where the entire polygonal faces of symmetric space structures are subdivided non-periodically or asymmetrically into rhombii and the structure retains only partial global symmetry or is completely asymmetric. The third class of structures are those in which the rhombii of non-periodic subdivisions are subdivided further in a periodic manner.

The structual advantages of the "new" space structures disclosed here remain to be examined and analyzed. But as the history of building art reveals, new geometries have always led to special architectural, structural, functional, or aesthetic advantages. The aesthetic appeal of non-periodic space structures cannot be overemphasized as these are a marked departure from the conventional space structures which, with recent exceptions, have relied upon periodicity as a device to cover space and span structures. Curved space structures with non-periodic subdivisions are new and are likely to advance the building art of the future.

Prior art includes U.S. Pat. No. 4,133,152 to Penrose which discloses the Penrose tiling, U.S. Pat. No. 5,007,220 to Lalvani which discloses prismatic nodes for periodic and non-periodic space frames and related tilings, U.S. Pat. No. 5,036,635 to Lalvani which discloses periodic and non-periodic curved space structures derived from vector-stars, U.S. Pat. No. 3,722,153 to Baer which discloses nodes of icosahedral symmetry for space frames, the work of T. Robbin which suggests the use of dodecahedral nodes for "quasicrystal" space structures using the De Bruijn method, the work of K. Miyazaki which discloses the 3-dimensional analog of the Penrose tiling. Prior work also includes known plane-faced zonohedra having tetrahedral, octahedral and icosahedral symmetry and derived from corresponding symmetric stars published in H. S. M. Coxeter's *Regular Polytopes* (Dover, 1973). Other related publications include Lalvani's article 'Continuous Transformations of Non-Periodic Tilings and Space-Fillings' in *Fivefold Symmetry* by I. Hargittal (World Scientific, Singapore, 1992), and citations to Lalvani in J. Kappraff's *Connections: The Geometric Bridge Between Art and Science* (McGraw-Hill, 1991, p. 246–249).

None of the prior art deals with non-periodic subdivisions of the fundamental region of various symmetric space structures, nor does it deal with non-periodic and asymmetric subdivisions of the surfaces of space structures. Further, prior art does no deal with the non-peridic subdivision of architecturally useful curved space structures like domes, vaults and related structures. Going further, the prior art does not teach such subdivisions for higher-dimensional and hyperbolic space structures.

SUMMARY OF THE INVENTION

The principal aim of the invention is to provide classes of space structures, here termed 'subdivided' structures, derived from known space structures, here termed 'source' structures, by a non-periodic subdivision of the source surfaces. The subdivided structures can have plane (flat), curved or a combination of flat and curved surfaces. The source structures, and the derived subdivided structures may be single-layered, double-layered, multi-layered, or multi-directional.

The subdivided structures, the object of this disclosure, include the following classes of space structures:

1. Space structures which are globally symmetric but their fundamental region is subdivided in a non-periodic manner with rhombii. All faces of such structures retain their symmetry and the rhombii can be subdivided into two triangles which can be further subdivided into a periodic array of triangles.
2. Space structures obtained by subdividing the polygonal faces of the source space structures in a non-periodic manner using various rhombii. The subdivision is such that the faces lose their overall symmetry. In some instances, the resulting structures are completely asymmetric, in other cases the structures have a reduced symmetry. The rhombii can be subdivided into two triangles which can be further subdivided into periodic arrays of triangles.

The source structures include the following:

1. All 2- and 3-dimensional regular space structures, namely, regular polygons and plane tessellations, and regular polyhedra and regular space fillings.
2. All 2- and 3-dimensional projections of regular, higher-dimensional structures (higher than 3-dimensions) in Euclidean space.
3. All regular space structures in hyperbolic 2-, 3- and higher dimensional space.

Another aim of the present invention is to provide an alternative to the well-known and successful geodesic dome. While the geodesic dome is based on the periodic subdivision of the triangular faces of regular tetrahedron, octahedron or the icosahedron by using portions of the triangular lattice, the present disclosure subdivides the triangles in a different way. In addition, the present disclosure includes subdivision of the cube and the dodecahedron as other viable alternatives to the geodesic dome.

Another aim of the present invention is to provide a variety of curved space structures in the form of cylinders, torii, saddle polygons, vaulted domes, barrell vaults, hyperbolic paraboloids, paraboloids, warped surfaces, and any surfaces of revolution or translation, all based on non-periodic subdivision of the surfaces. These curved space structures can be used as individual units or in collective arrays which are either periodic or non-periodic.

Another aim of the invention is to provide a class of space labyrinths with either plane or curved faces with their surfaces subdivided in a non-periodic manner. Related to these labyrinths are close-packings and space-fillings of polyhedra with either plane or curved faces which are also subdivided non-periodically.

A further aim of the invention is to provide classes of plane-faced and curved space structures with subdivided surfaces which are double-layered, triple-layered or multi-layered, where the layers are interconnected and suitably stabilized.

The invention also provides classes of higher-dimensional space structures and hyperbolic space structures with subdivided surfaces and spaces.

Other objects, advantages and salient features of the invention will become apparent from the following detailed description, which, taken in conjunction with the annexed drawings, discloses preferred embodiments of the present invention.

DRAWINGS

Referring now to the drawings which form a part of this original disclosure:

FIG. 1 shows the various rhombii used for the subdivision and derived from an n-star. The rhombii are listed according to n.

FIGS. 2*a–c* shows the dissection of the rhombii of FIG. 1 by the diagonals of the rhombus. FIG. 2*a* shows a bisection into half-rhombii by one diagonal, FIG. 2*b* shows the alternate bisection into another set of half-rhombii by the alternate diagonal, FIG. 2*c* shows the quarter-rhombii derived by the further bisection of the half-rhombii.

FIG. 3 shows the periodic subdivision of a rhombus, half-rhombus and quarter-rhombus into smaller self-similar rhombii. These lead to periodic triangulation by inserting the diagonals.

FIGS. 4*a–d* show various types of fundamental regions of regular p-sided polygons. FIG. 4*a* shows fundamental regions of Type I which is ½pth portion of the polygon, FIG. 4*b* shows fundamental regions of Type II which are 1/pth portion of the polygon, FIG. 4*c* shows Type III region which is 2/pth fraction of an even-sided polygon, FIG. 4*d* show Type IV regions which are irregular 1/pth fractions of polygons.

FIGS. 5–8 show examples of subdivision of various regular polygons using the rhombii from FIG. 1.

FIG. 5*a* shows the subdivision of an equilateral triangle (p=3) into rhombii from n=6 such that the triangle retains 3-fold symmetry. The triangle uses fundamental region Type I.

FIG. 5*b* shows two different subdivisions of the hexagon (p=6) with a 6-fold symmetry using n=6 rhombii and fundamental region Type I. Two examples of non-periodic subdivisions of a triangle using the same rhombii are also shown. These two are asymmetric.

FIG. 6*a* shows the gnomonic fundamental region using n=4 rhombii. The figure also shows the procedure for self-similar non-periodic subdivision for p=4 and 8 cases. The region shown corresponds to fundamental region of Type I for the p=8 case.

FIG. 6*b* shows four increasing non-periodic subdivisions of a square (p=4) derived from the procedure of FIG. 6*a*. Also shown is an octagon obtained by truncating the corners of the squares. These examples are bilaterally symmetric and correspond to fundamental region type V.

FIG. 6*c* shows the subdivision of an octagon (p=8) using the n=4 rhombii. Four examples correspond to fundamental region Type I and have 8-fold symmetry and two correspond to fundamental region Type V.

FIG. 7*a* shows the gnomonic subdivision of a fundamental region Type III for p=5 and 10 using n=5 rhombii. The figure also shows the procedure for generating the non-periodic tiling for n=5 case.

FIGS. 7*b* and 7*c* show the the derivation of decagons (p=10) from the n=5 rhombii using the gnomonic regions (Type III) from FIG. 7*a*. The example is FIG. 7*b* is the well-known Penrose tiling and is shown with 5-fold symmetry. The example in FIG. 7*c* is a new variant of the Penrose tiling in FIG. 7*b*. Regular pentagons (p=10) are embedded in these two tiling patterns and are shown in dotted lines within the the decagons in FIG. 7*b*.

FIGS. 7*d* and 7*e* show the subdivisions of regular pentagons (p=5) of varying sizes using the Penrose tiling of FIG. 7*b* and retaining 5-fold symmetry. In FIG. 7*d*, the edges of the rhombii are kept constant, while in FIG. 7*e* the edge of the pentagons is kept constant.

FIG. 7*f* shows four examples of subdivisions of a pentagon, two without symmetry, and two with 5-fold rotational symmetry having fundamental region Type IV and derived from the Penrose tiling of FIG. 7*b*.

FIG. 8*a* shows three examples of subdivided heptagons (p=7) using the n=7 rhombii. Two examples have 7-fold mirror symmetry using fundamental region Type I, and one has 7-fold rotational symmetry using fundamental region Type IV.

FIG. 8*b* shows five examples of a 14-sided polygon (p=14) using n=7 rhombii. Two of the examples have a 14-fold symmetry and use fundamental region Type I, and three are asymmetric.

FIG. 9 shows a variety of curved polygons with p=3, 4, 5, 6 and 8 sides. The polygons are singly-curved, or doubly-curved. The doubly-curved cases include synclastic (positive) and anti-clastic (negative) curvatures.

FIG. 10*a* and 10*b* show singly-curved polygons.

FIG. 10*a* shows two examples of curved polygons, one by rolling a subdivided octagon (n=4 case) into a half-cylindrical vault, and the other by curving a subdivided square (n=4 case) into a cross-vault. The cross-vault is also shown triangulated.

FIG. 10*b* shows a periodic array of the cross-vault of FIG. 10*a* in an isometric view and an interior view.

FIG. 11*a–e* show doubly-curved synclastic polygons having a positive curvature.

FIG. 11*a* shows two examples of a doubly-curved dome obtained by projecting a subdivided heptagon (p=7) and pentagon (p=5) on to a convex curved surface like a sphere. The heptagon is taken from FIG. 8*a* and has 7-fold mirror symmetry. It is also shown in its triangulated state. The pentagon is taken from FIG. 7*f* and has no symmetry.

FIG. 11*b* shows two examples of convex domes obtained by projecting subdivided 14-sided polygons (p=14) on to an ellipsoid. The 14-sided polygons are taken from FIG. 8*b*. One has a 14-fold mirror symmetry and the other is asymmetric.

FIG. 11*c* and 11*d* are two shallow convex domes with scalloped edges obtained by "inilating" the subdivided decagons (p=10) of FIGS. 7*b* and 7*c*. The former is a curved Penrose tiling and the latter is a variant. The two retain global 5-fold symmetry.

FIG. 11*e* is another example of a curved Penrose tiling derived from one of the decagons (p=10) of FIG. 7*b*. In this example, the curvature is also applied to the plan which has radial and concentric circular arcs.

FIG. 12*a–c* show examples of anti-clastic polygons with a negative curvature. FIG. 12*a* shows a subdivided saddle polygon with four-sides (p=4) obtained from one of the squares of FIG. 6*b*.

FIG. 12*b* shows two examples of a faceted version of a six-sided (p=6) pseudo-sphere. These have a tent-like form and have a negative curvature. One has a 6-fold mirror symmetry and uses a subdivided hexagon of FIG. 5*b*. It is shown in its triangulated state in an upside-down position. The other is completely asymmetric and uses six asymmetrically subdivided triangles of FIG. 5*b*.

FIG. 12*c* shows a periodic array of the one of the faceted pseudo-spheres of FIG. 12*b*. Each is rotated randomly while repeating, leading to a completely asymmetric pattern in the plan view.

FIGS. 13*a–d* show examples of subdivided cylinders and torii.

FIGS. 13*a* shows a cylinder by rolling up a portion of the n=4 pattern obtained from FIG. 6*a*.

FIGS. 13*b–d* show a cylinder and a torus obtained from a portion of the Penrose tiling of FIGS. 7*b* and the variant Penrose tiling of FIG. 7 *c*. In each case the net of the cylinder is shown. The cylinder is bent into a torus. FIG. 13*d* shows their triangulated versions.

Figure 16A:
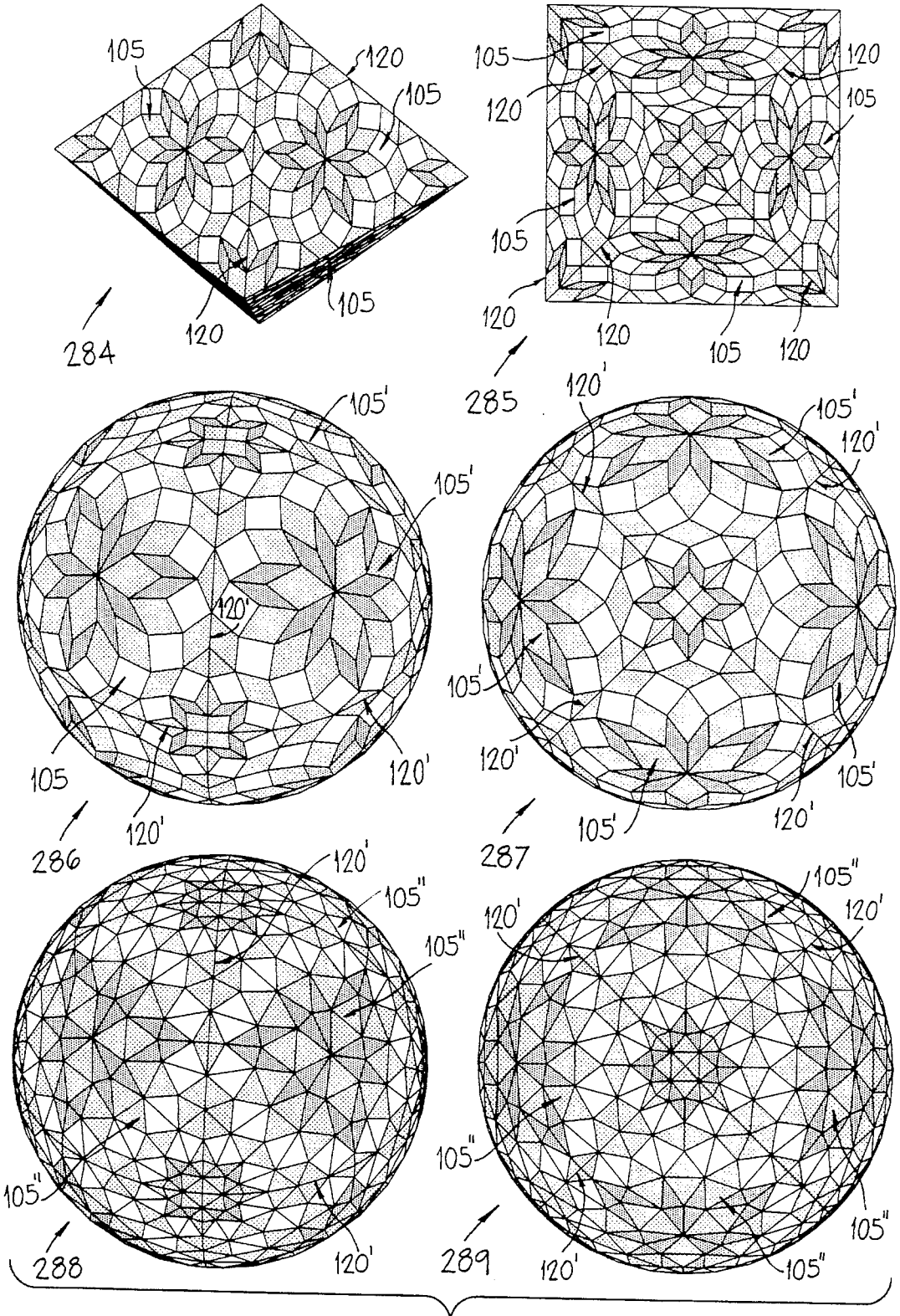
Figure 16B:
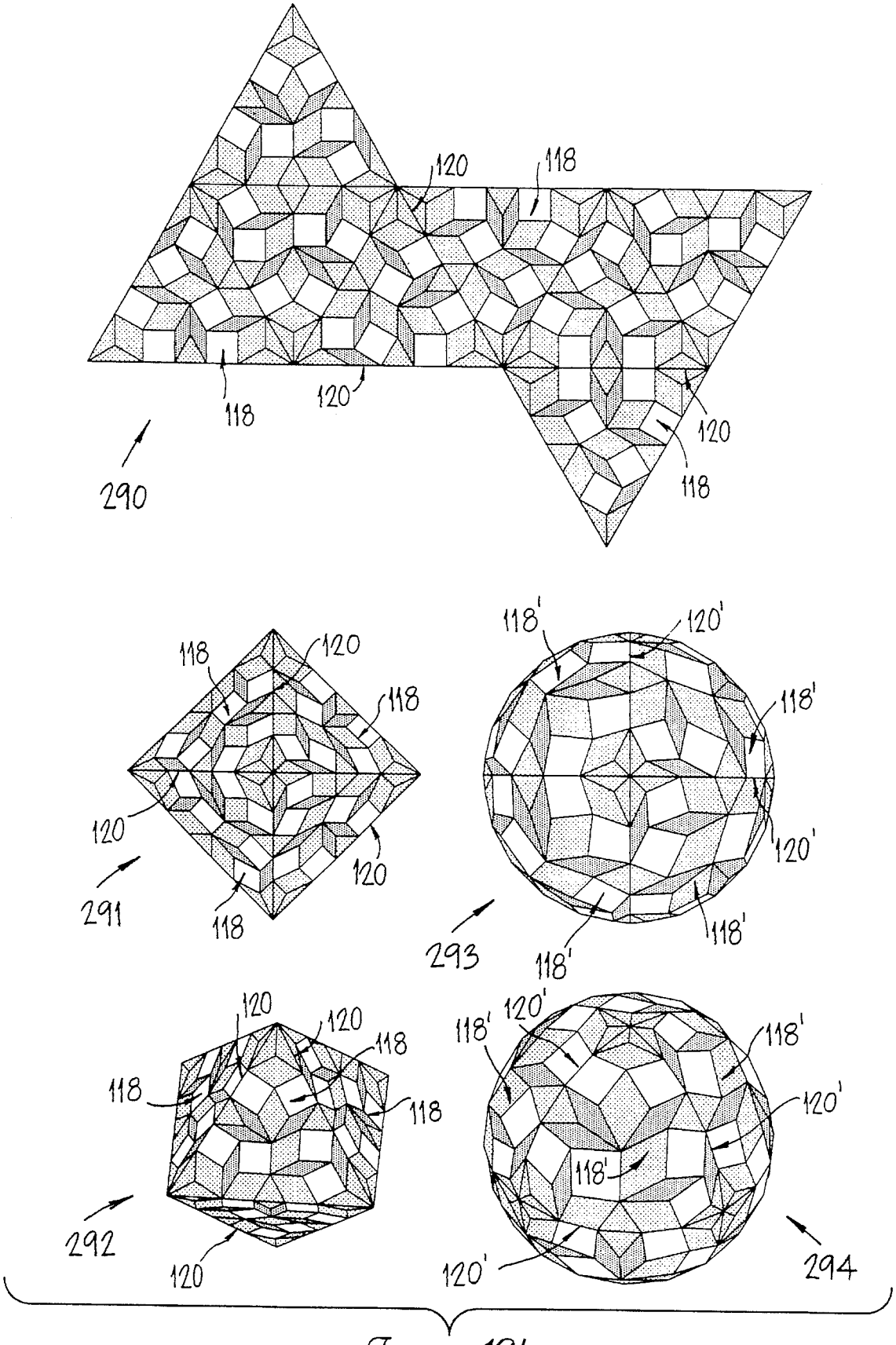

FIGS. 16*a* and 16*b* show two examples of octahedra {3,4} composed of subdivided faces in its plane-faced and spherical states. One retains global octahedral symmetry and the other is asymmetric. The former is also shown as a triangulated geodesic sphere.

Figure 17A:
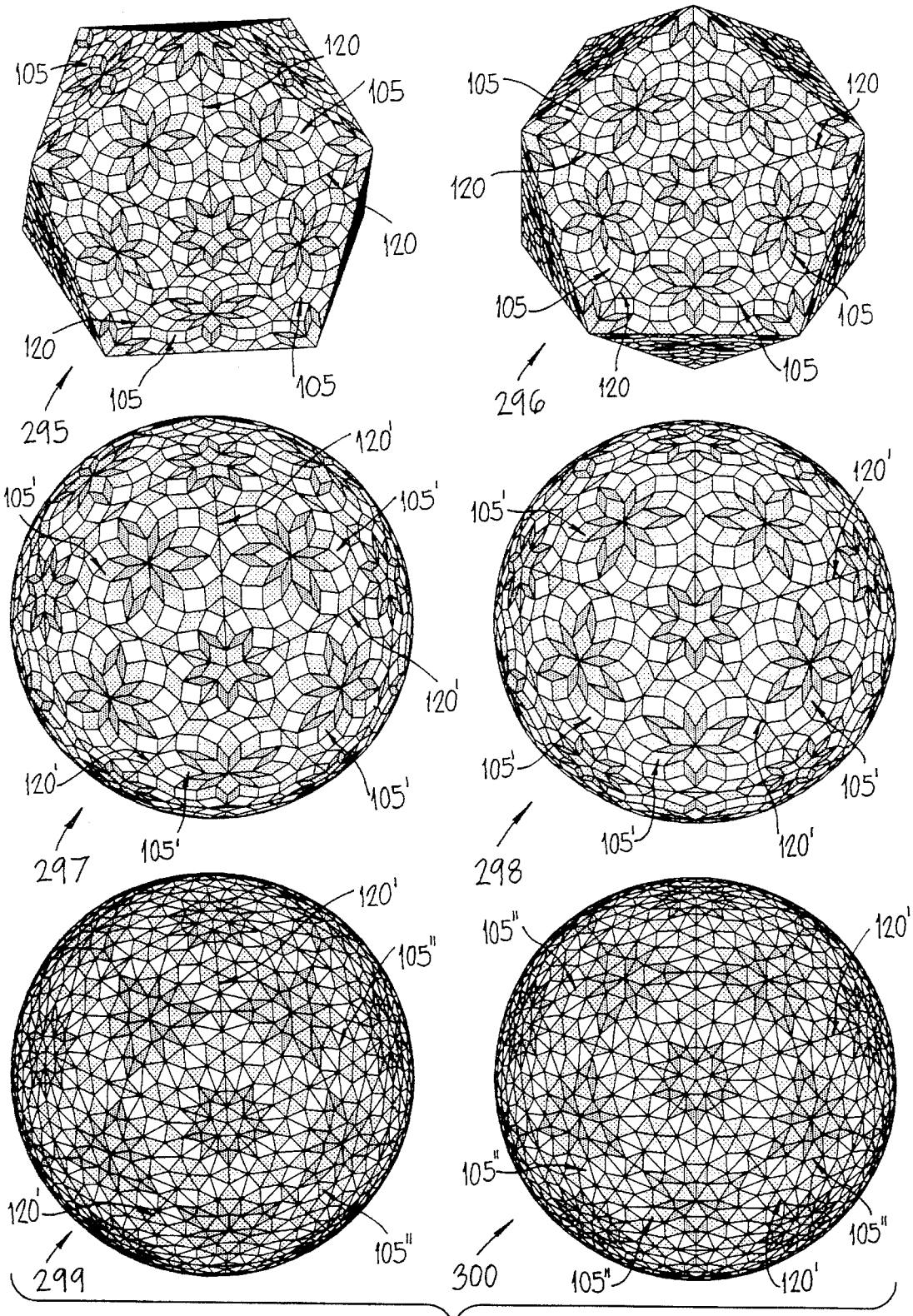
Figure 17B:
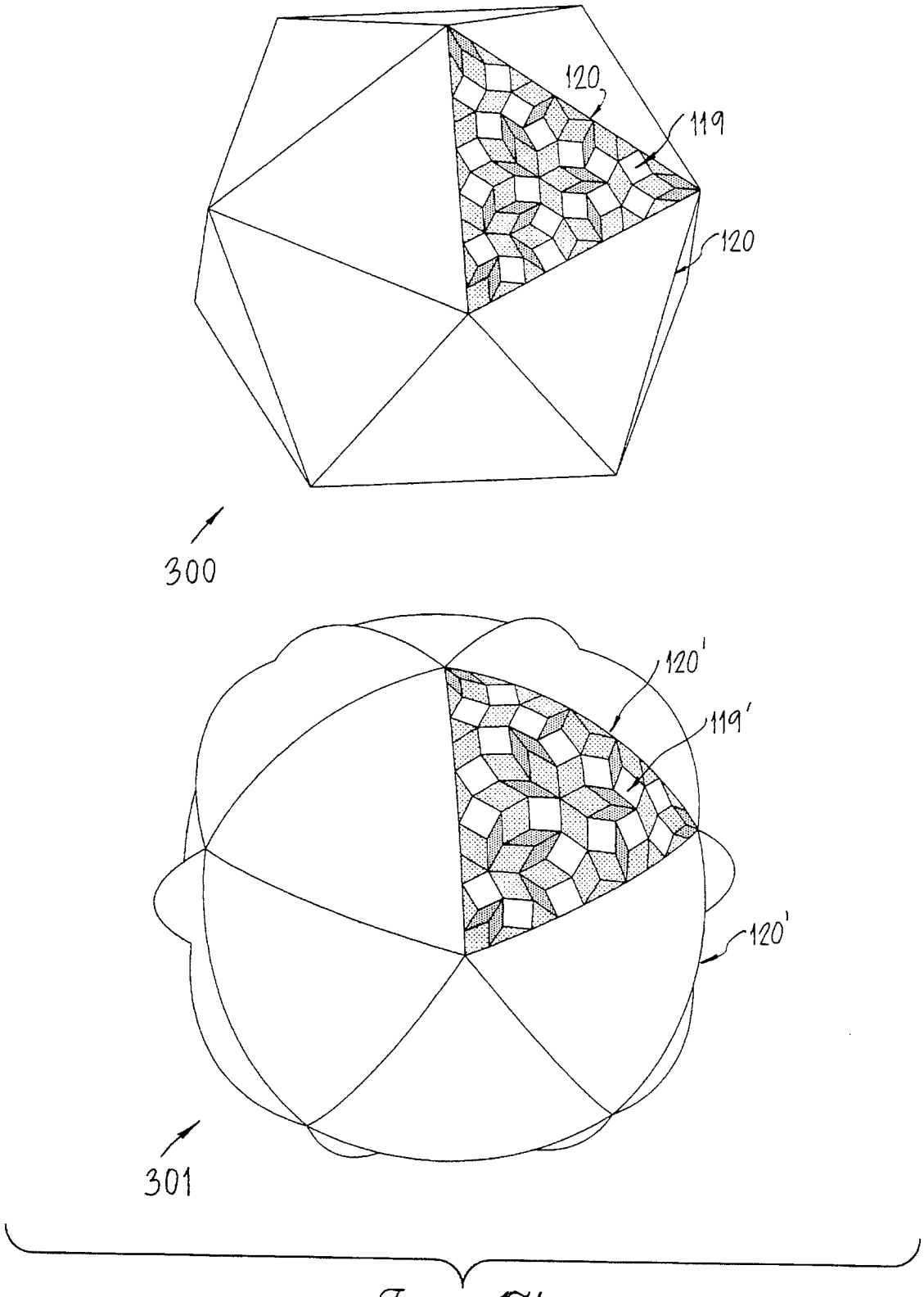

FIGS. 17*a* and 17*b* show two examples of icosahedra {3,5} composed of subdivided faces and shown in their plane-faced and sphere-projected states. One retains global symmetry and is also shown as a triangulated geodesic sphere. The other can be asymmetric or have local symmetry.

Figure 18A:
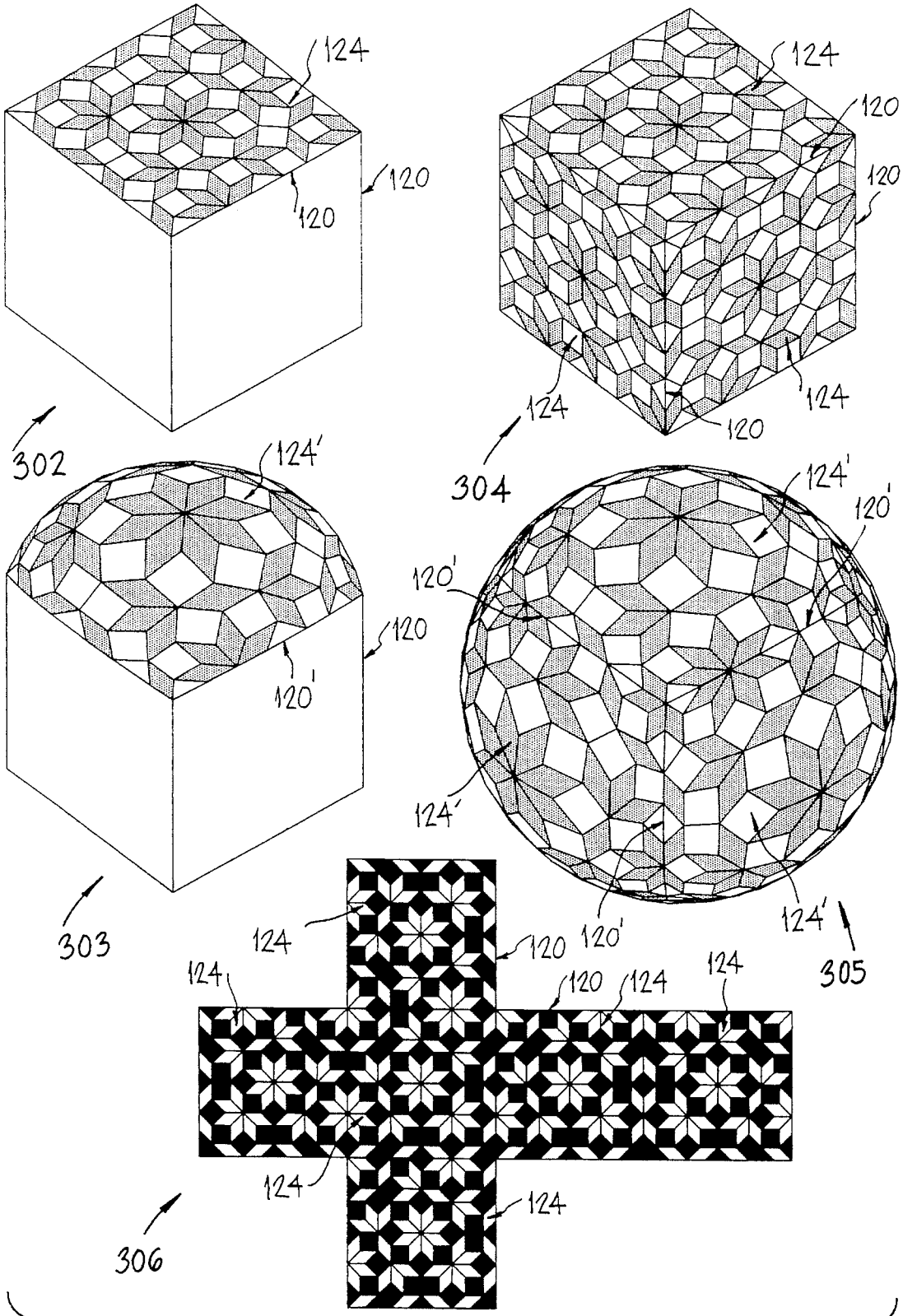
Figure 18B:
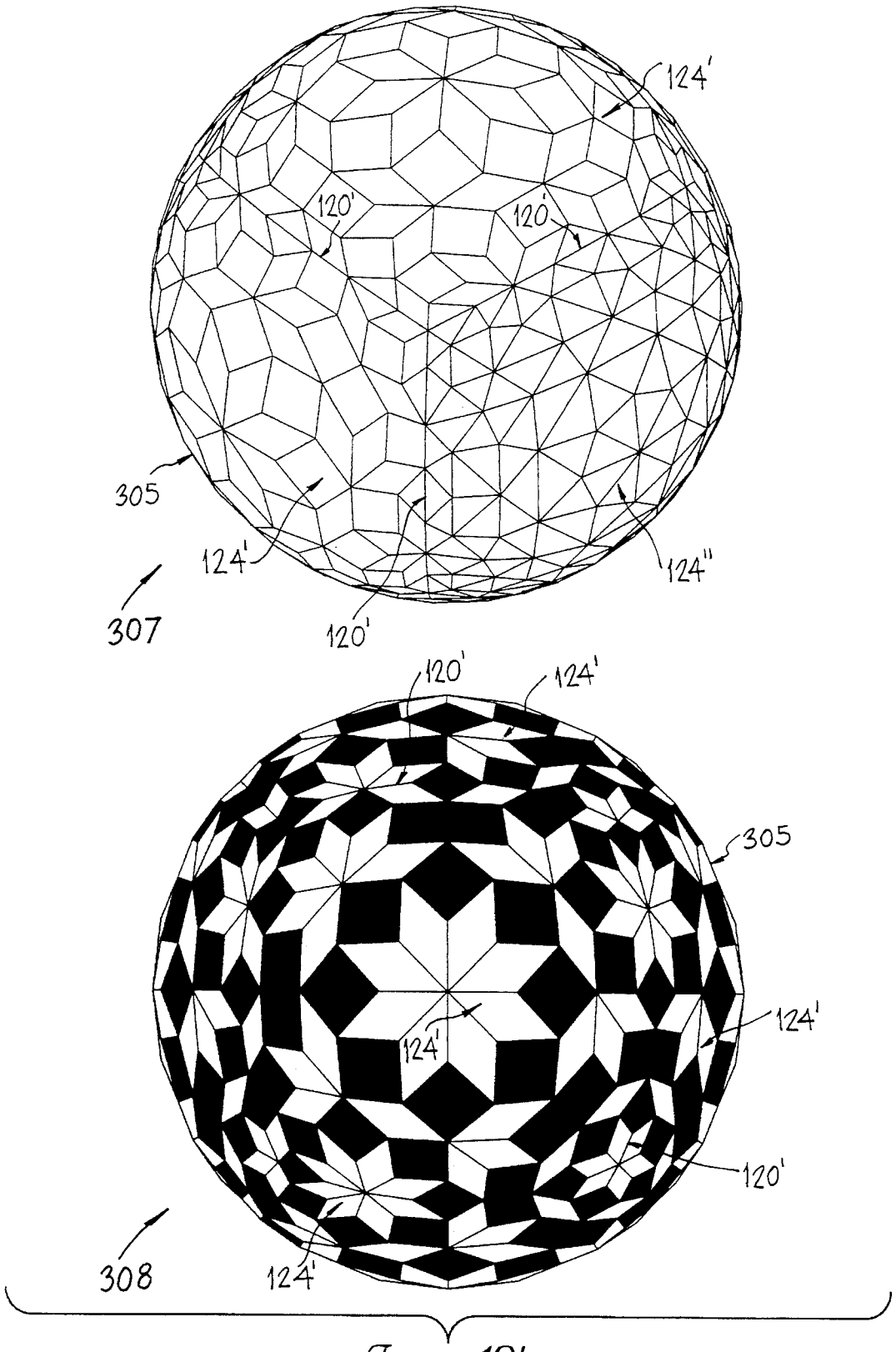

FIGS. 18*a* and 18*b* show one example of a non-periodically subdivided cube {4,3} in its plane-faced and spherical states.

Figure 19A:
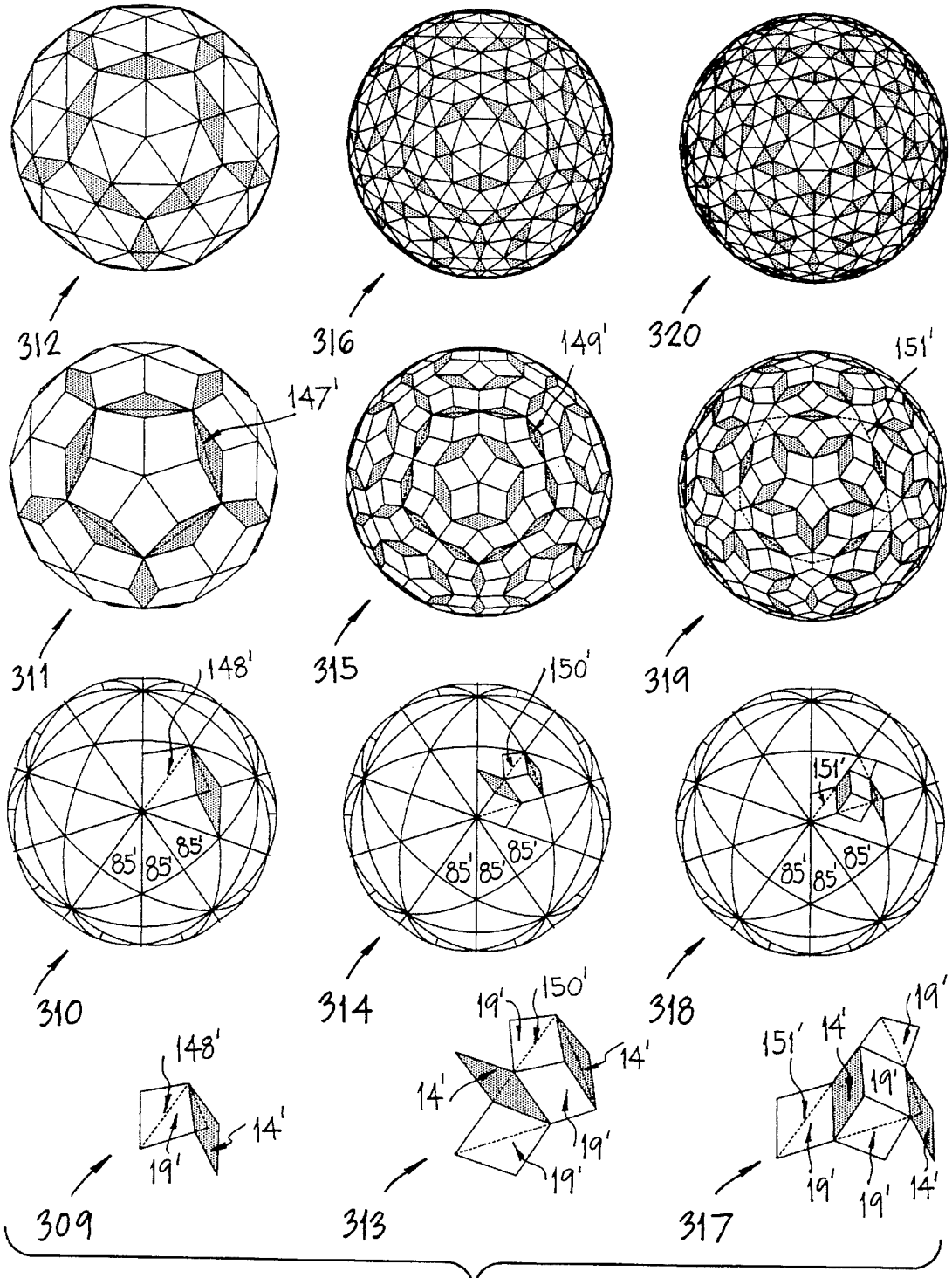
Figure 19B:
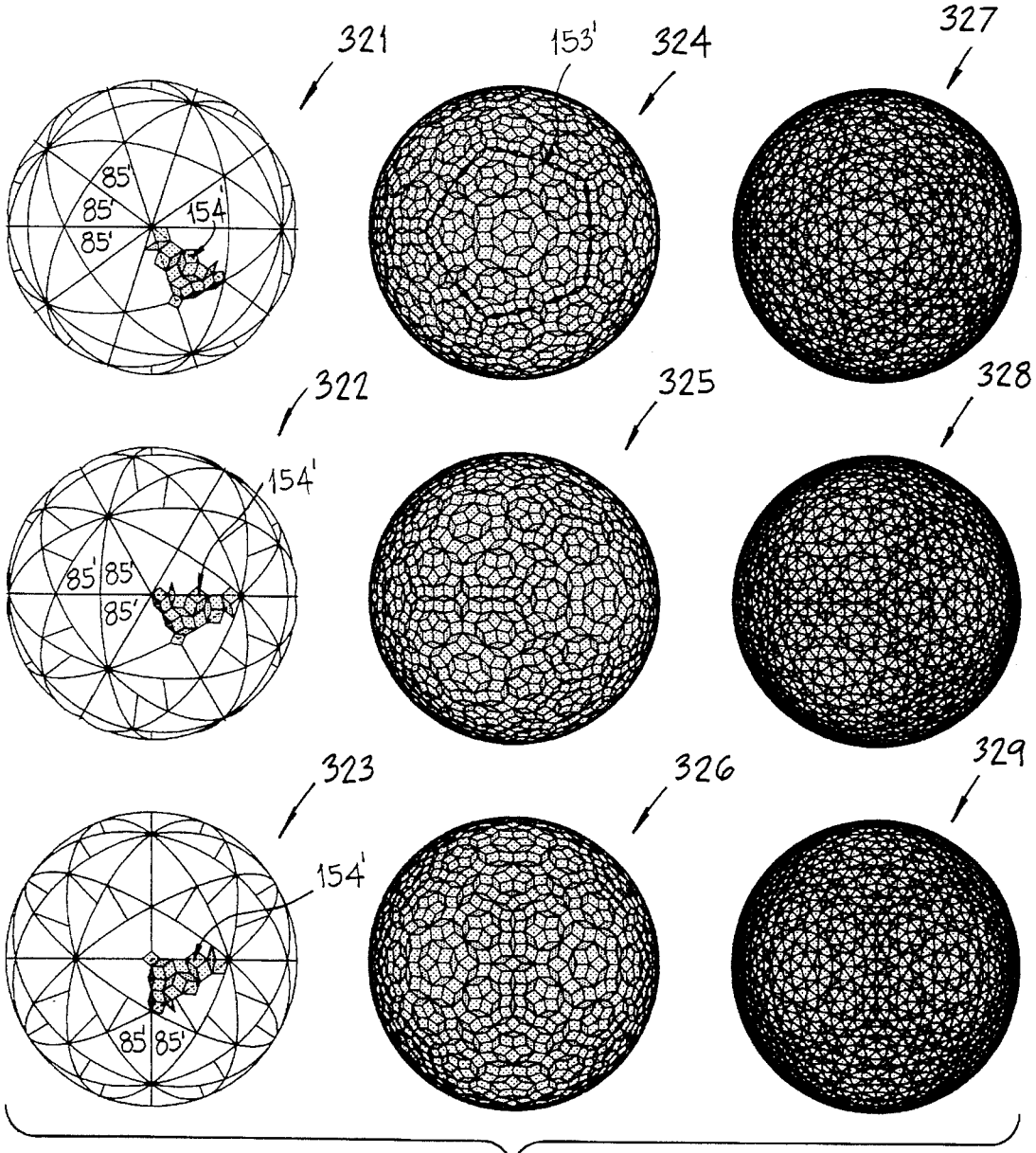
Figure 19C:
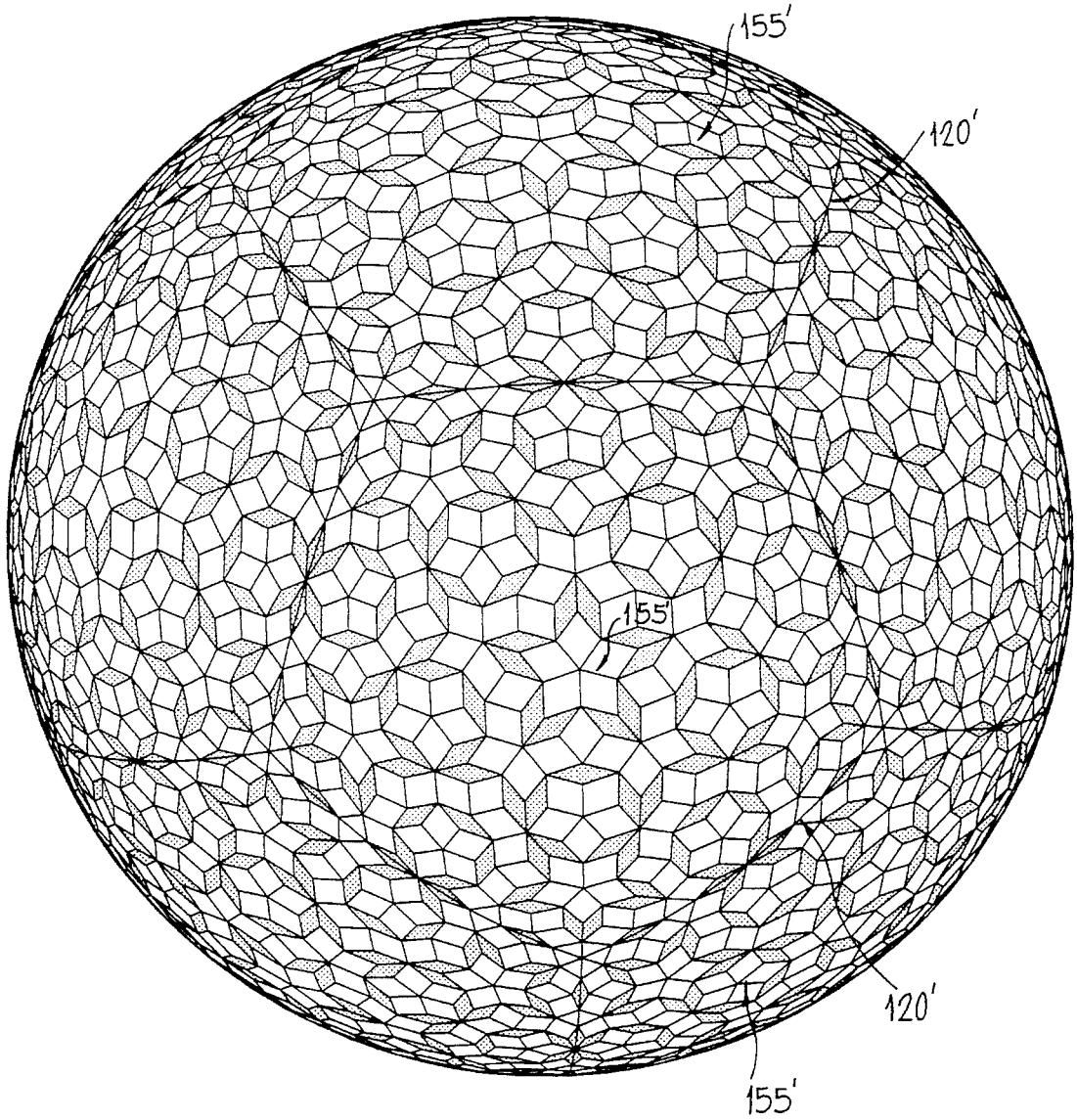
Figure 19D:
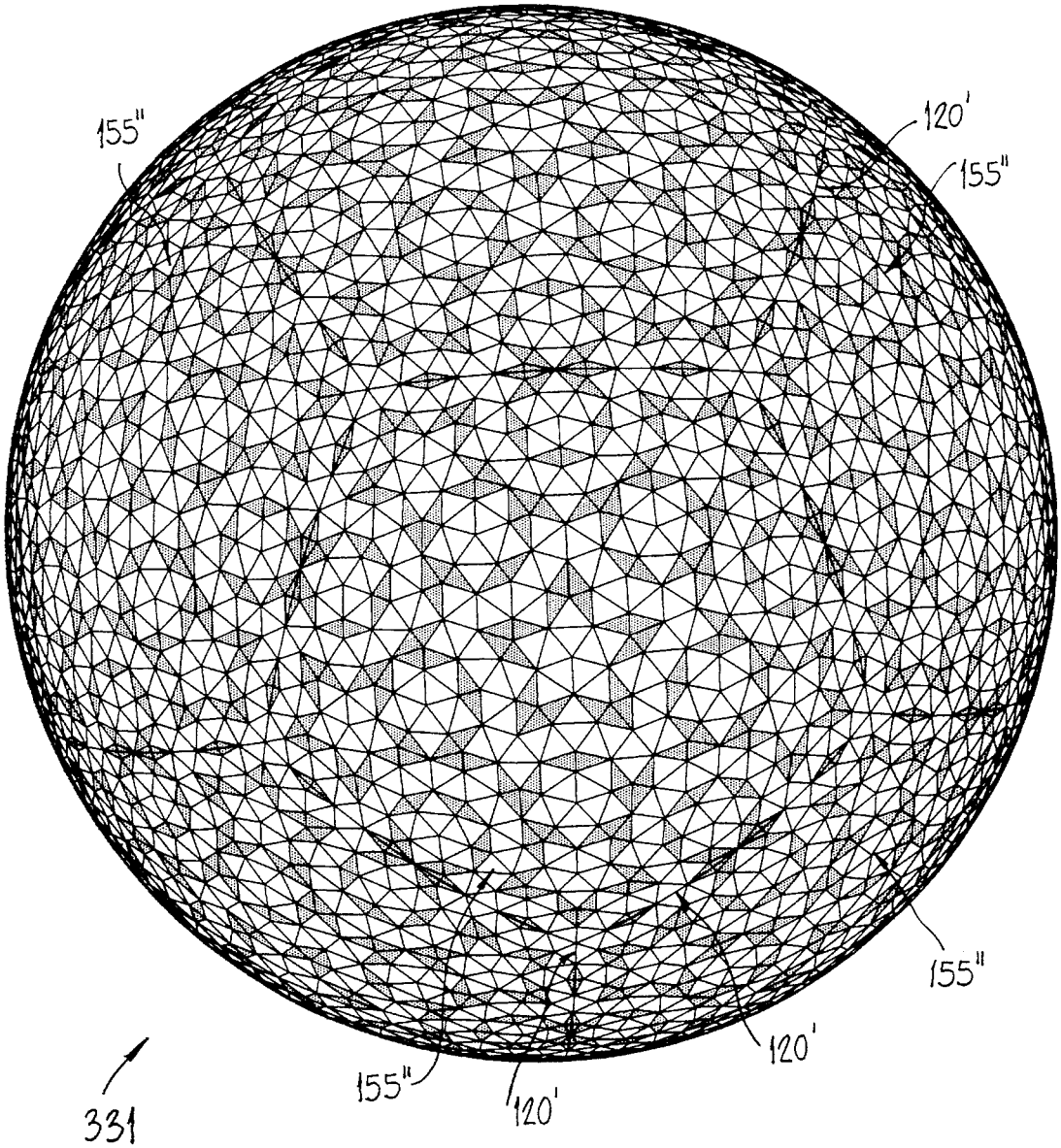
Figure 19E:
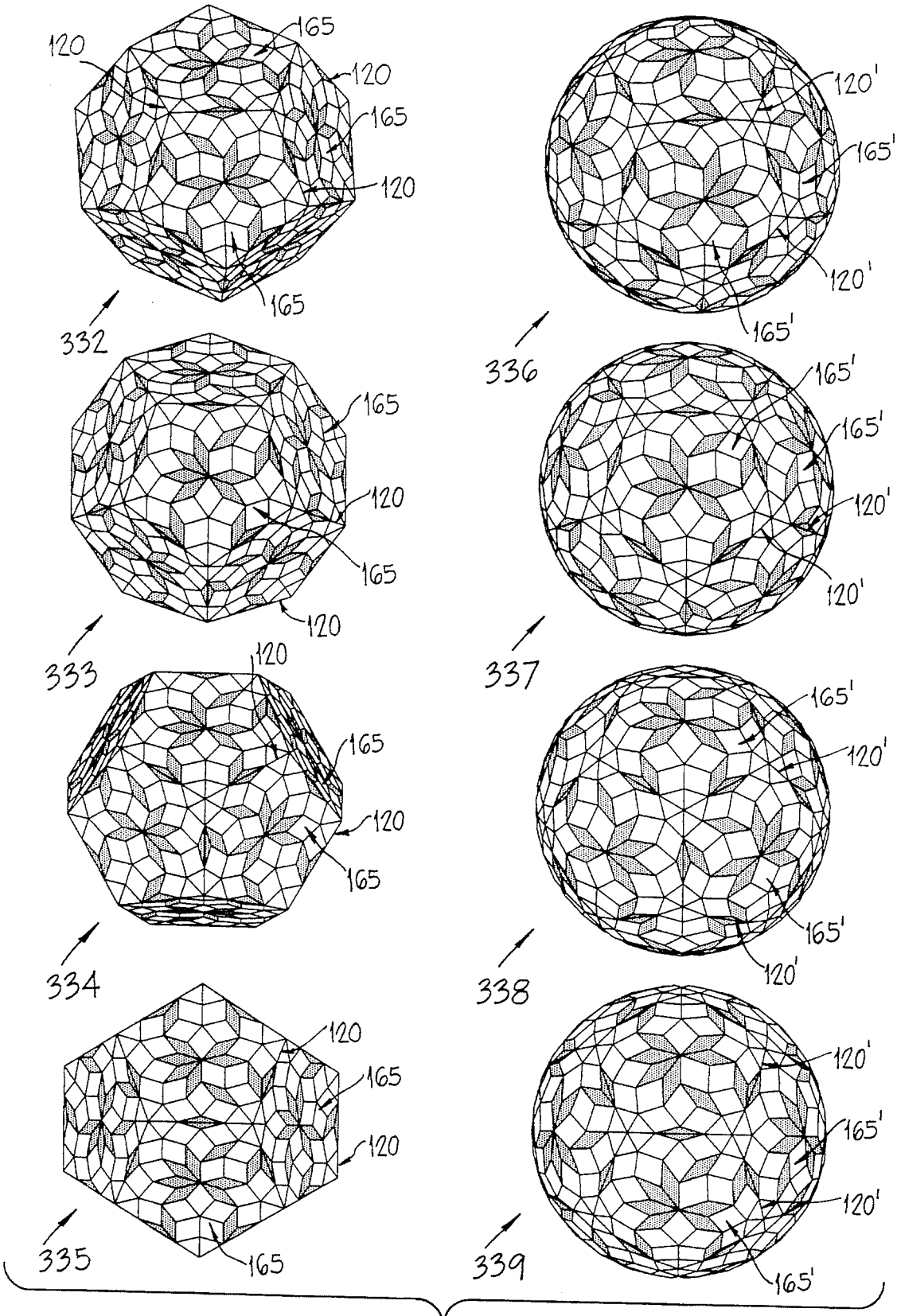

FIGS. 19*a–e* show six different examples of geodesic spheres obtained by subdividing the faces of the dodecahedron {5,3}. The subdivisions of the faces in FIGS. 19*a–c* correspond to the Penrose tilings of FIGS. 7 *a*, 7*b* and 7*d* and have global icosahedral symmetry. FIG. 19*d* is a triangulated version of FIG. 19*c*. FIG. 19*e* is an asymmetrically subdivided dodecahedron and geodesic sphere.

Figure 20:
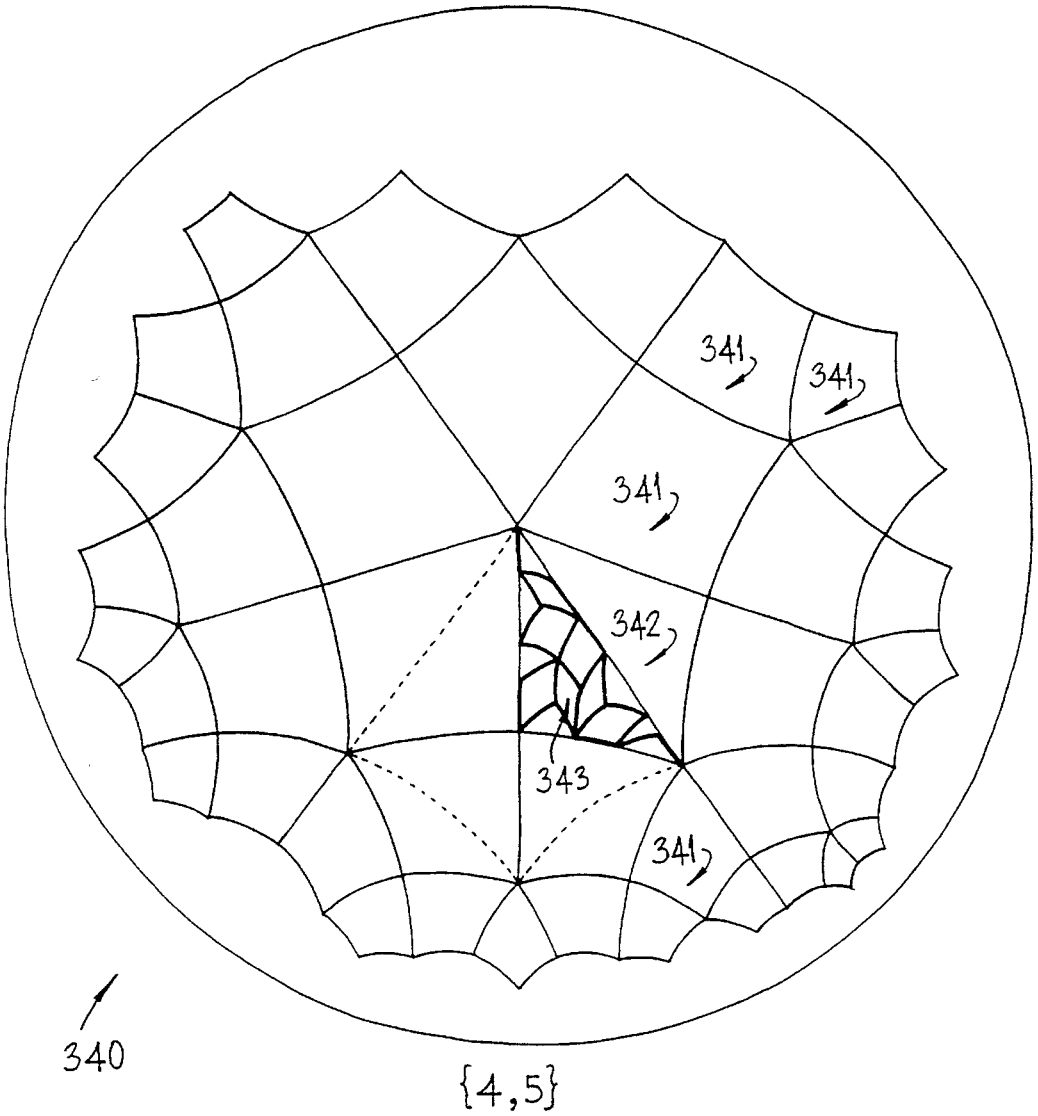

FIG. 20 shows one examples of the hyperbolic tessellation {4,5} where the one-half of the hyperbolic square is subdivided into the hyperbolic Penrose tiling composed of rhombii with curved circular arcs as edges.

Figure 21:
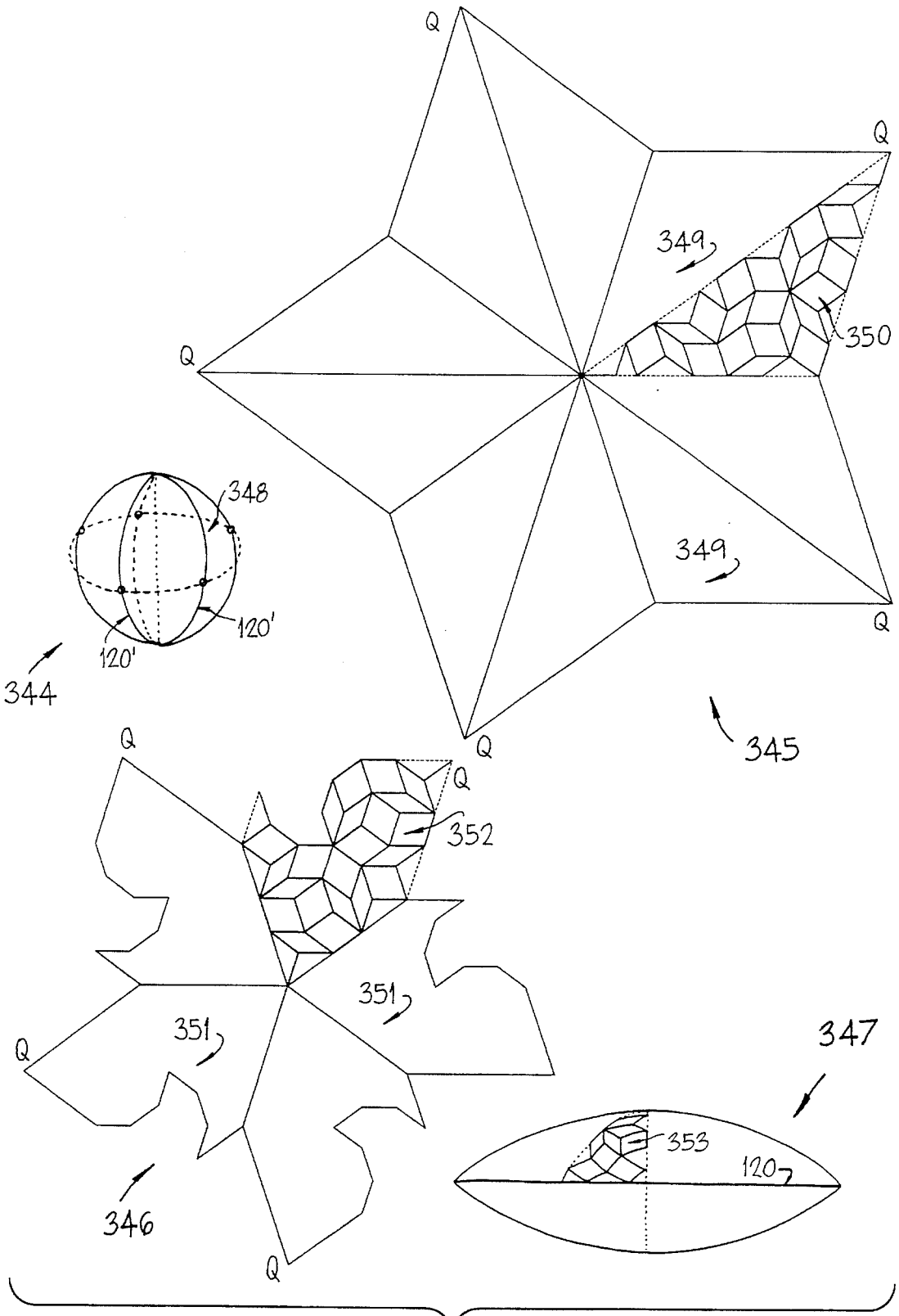

FIG. 21 shows two examples of digonal pentahedra, shown in their fold-out state, and with fundamental regions subdivided using portions of the Penrose tiling. One example of a side-view of a 7-sided diheron is shown with its subdivided fundamental region.

Figure 22A:
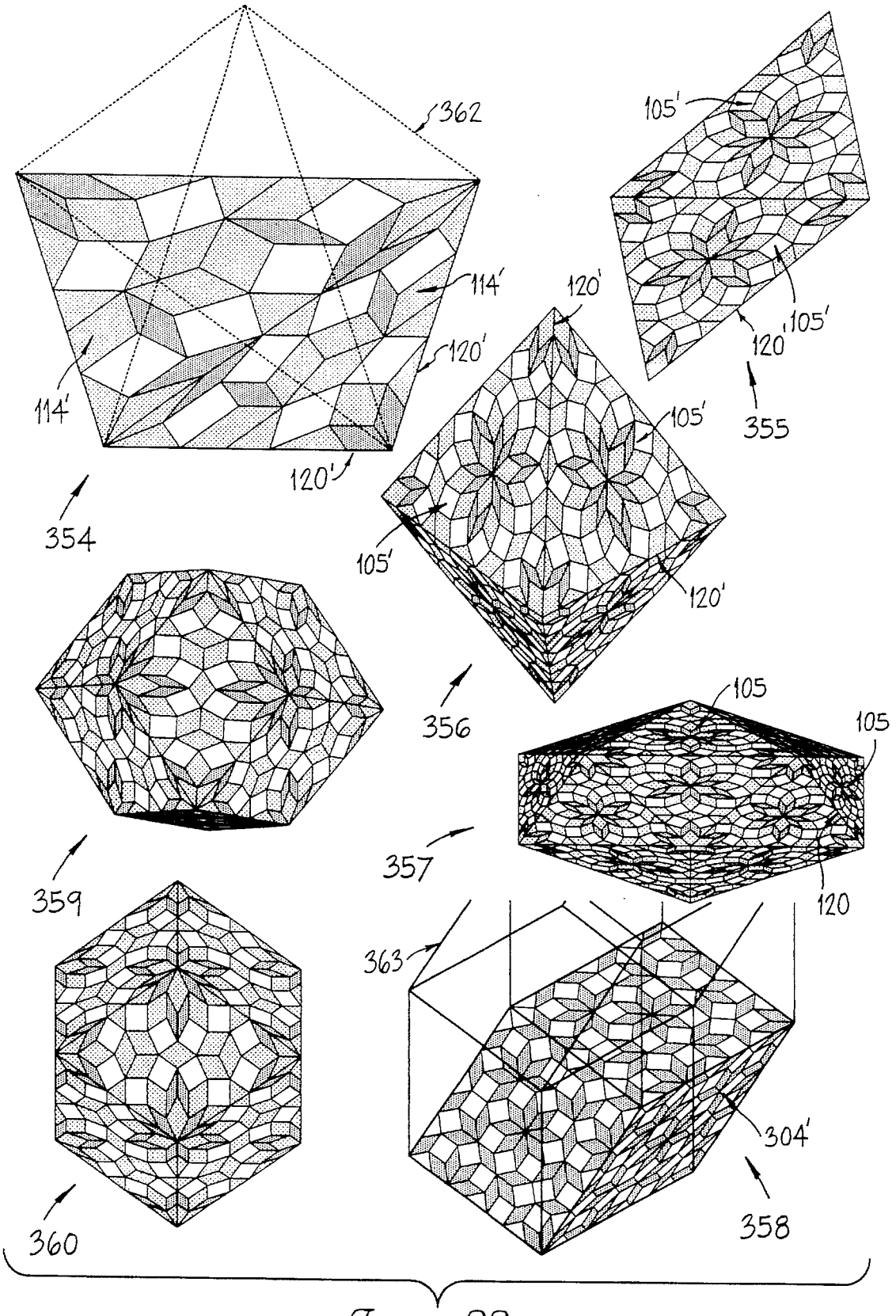
Figure 22B:
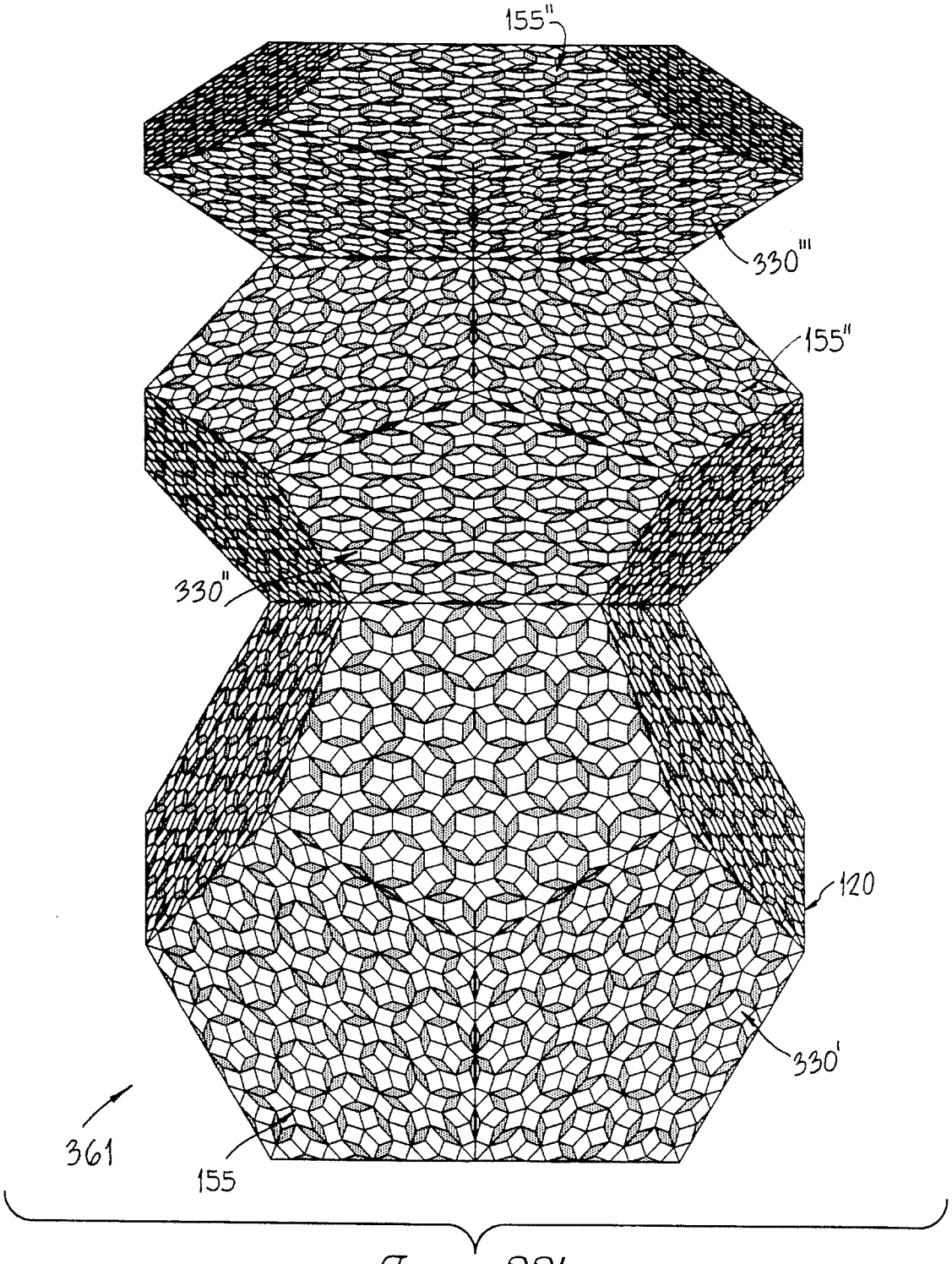

FIGS. 22*a* and 22*b* show 3-dimensional cells of higher-dimensional polyhedra composed of subdivided polygonal faces selected from FIGS. 5–7. These are regular in higher space, but become distorted when projected down to 3-dimensions Cells of of various 4-dimensional polytopes are illustrated.

Figure 23:
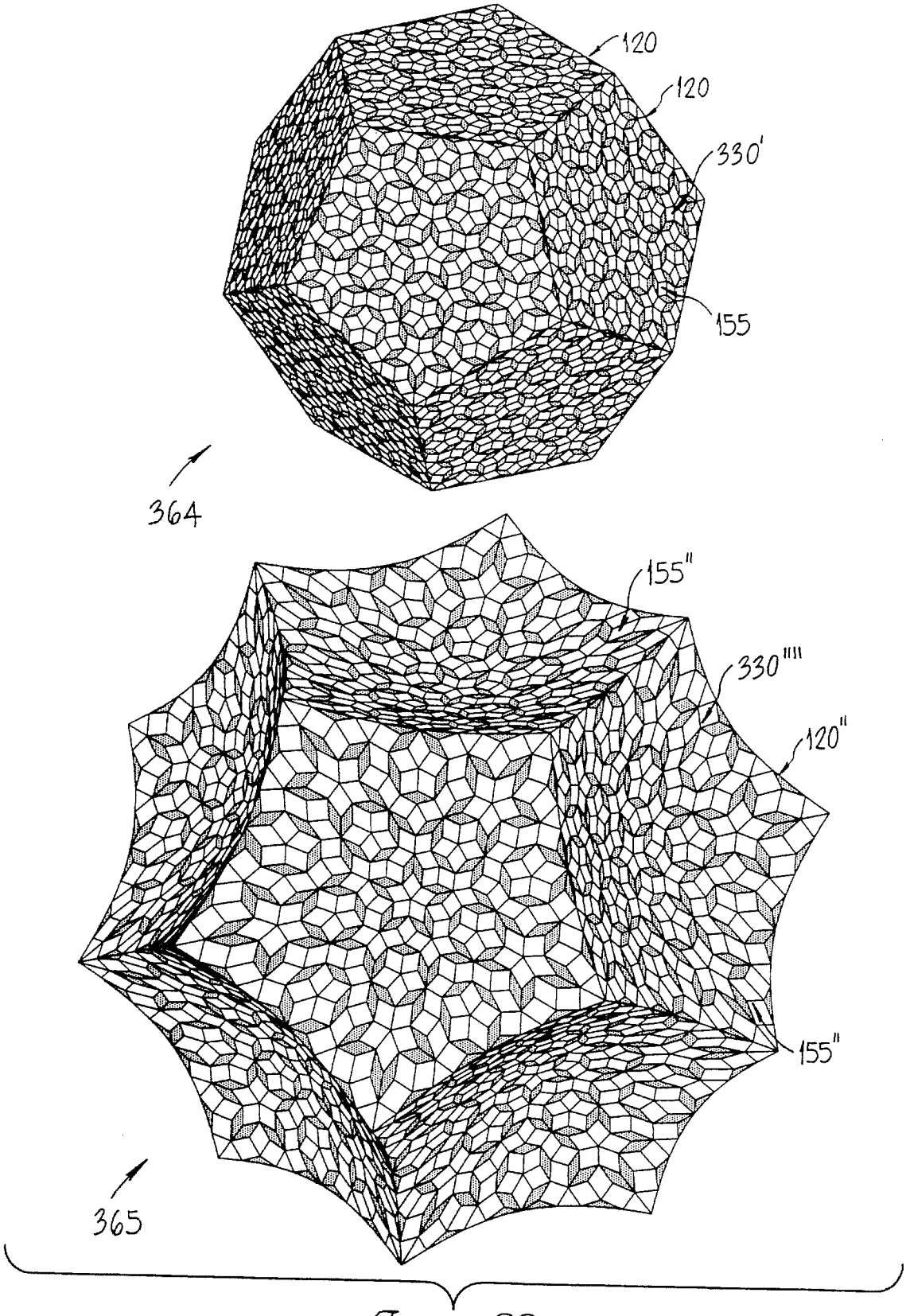

FIG. 23 shows a regular dodecahedron with plane faces (in Euclidean space) and its counterpart in hyperbolic (non-Euclidean) space.

Figure 24:
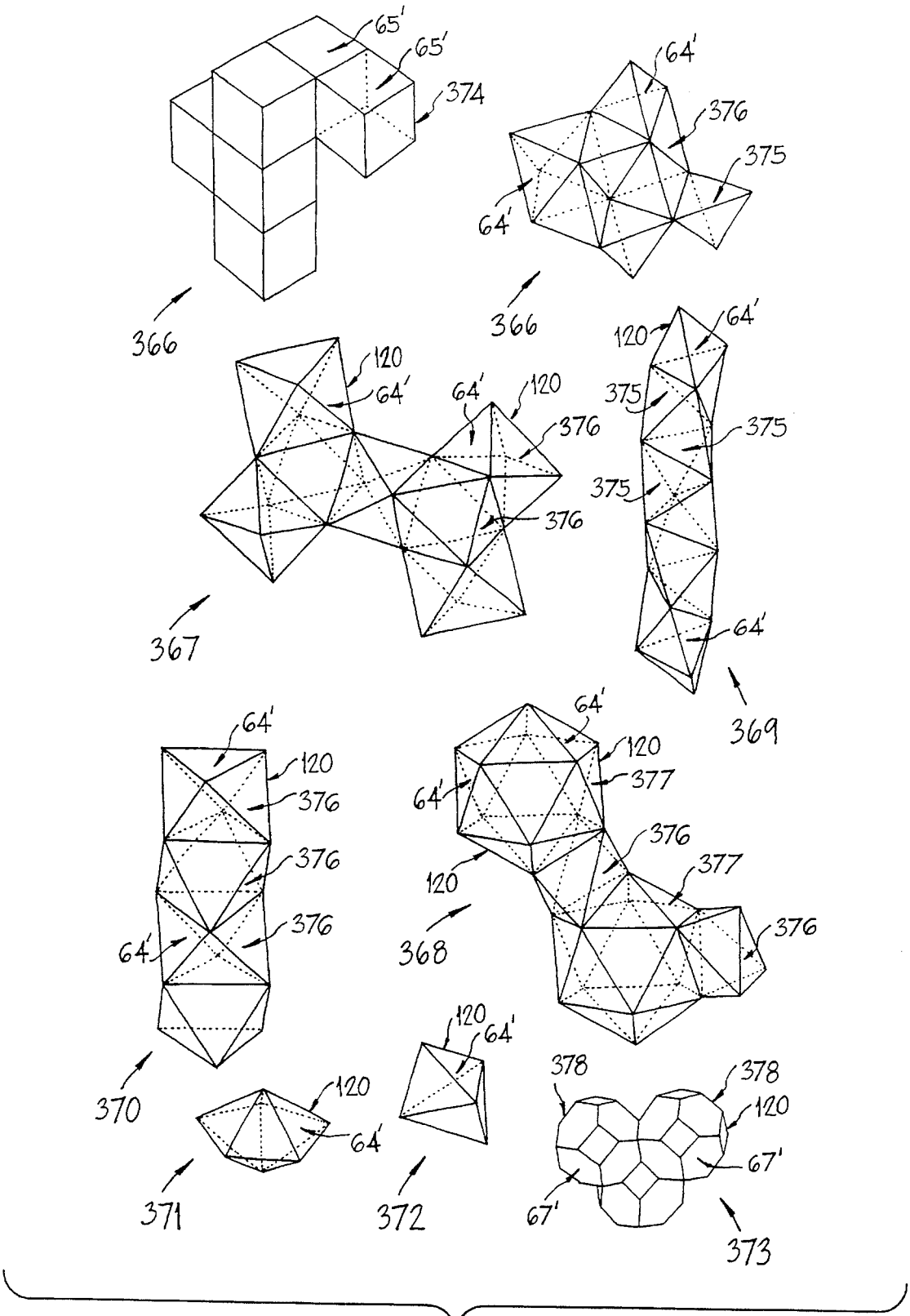

FIG. 24 shows miscellaneous space structures composed of regular squares, triangles and hexagons. These could be subdivided using the subdivisions of FIGS. 5 and 6.

Figure 25A:
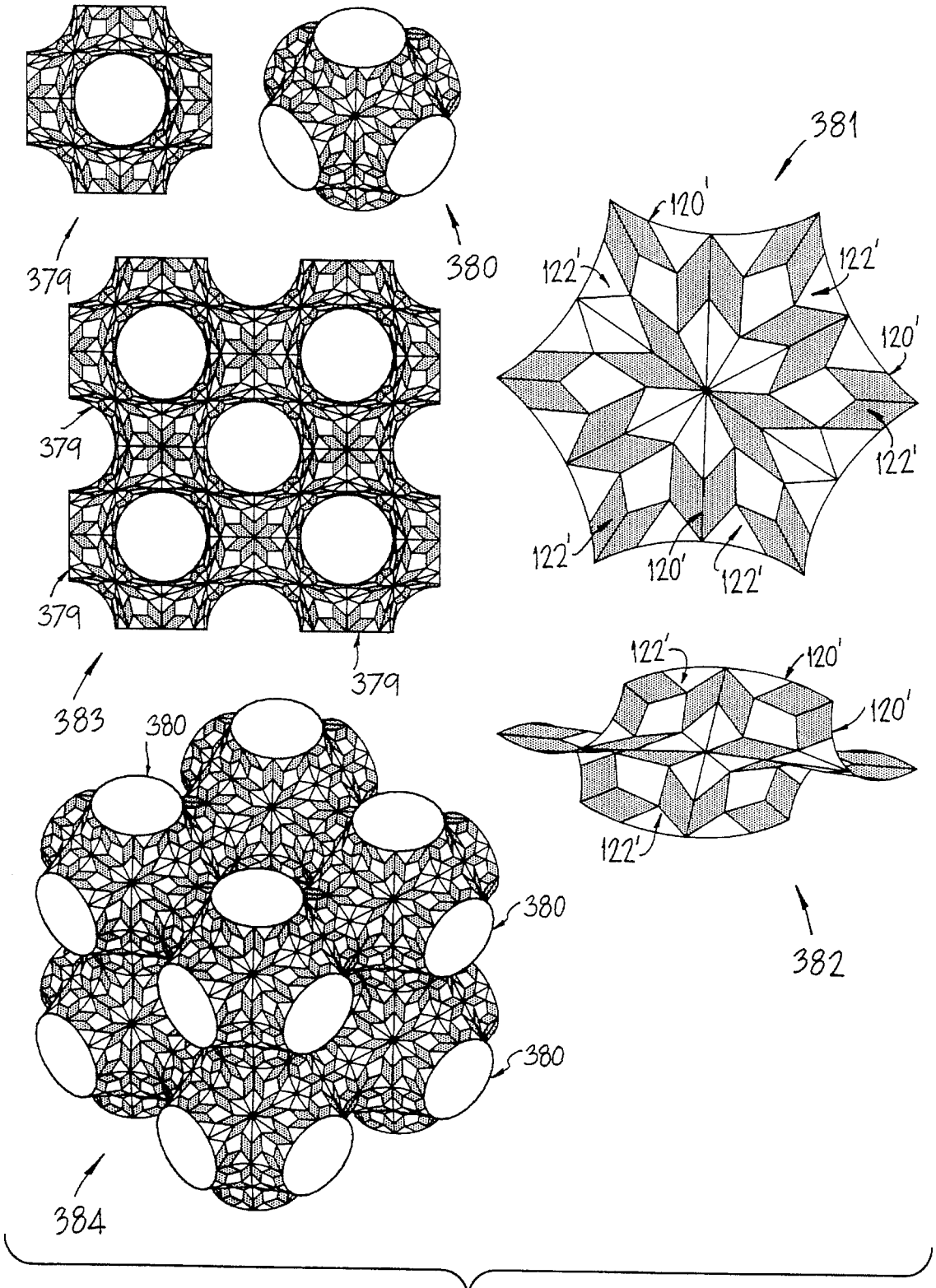
Figure 25B:
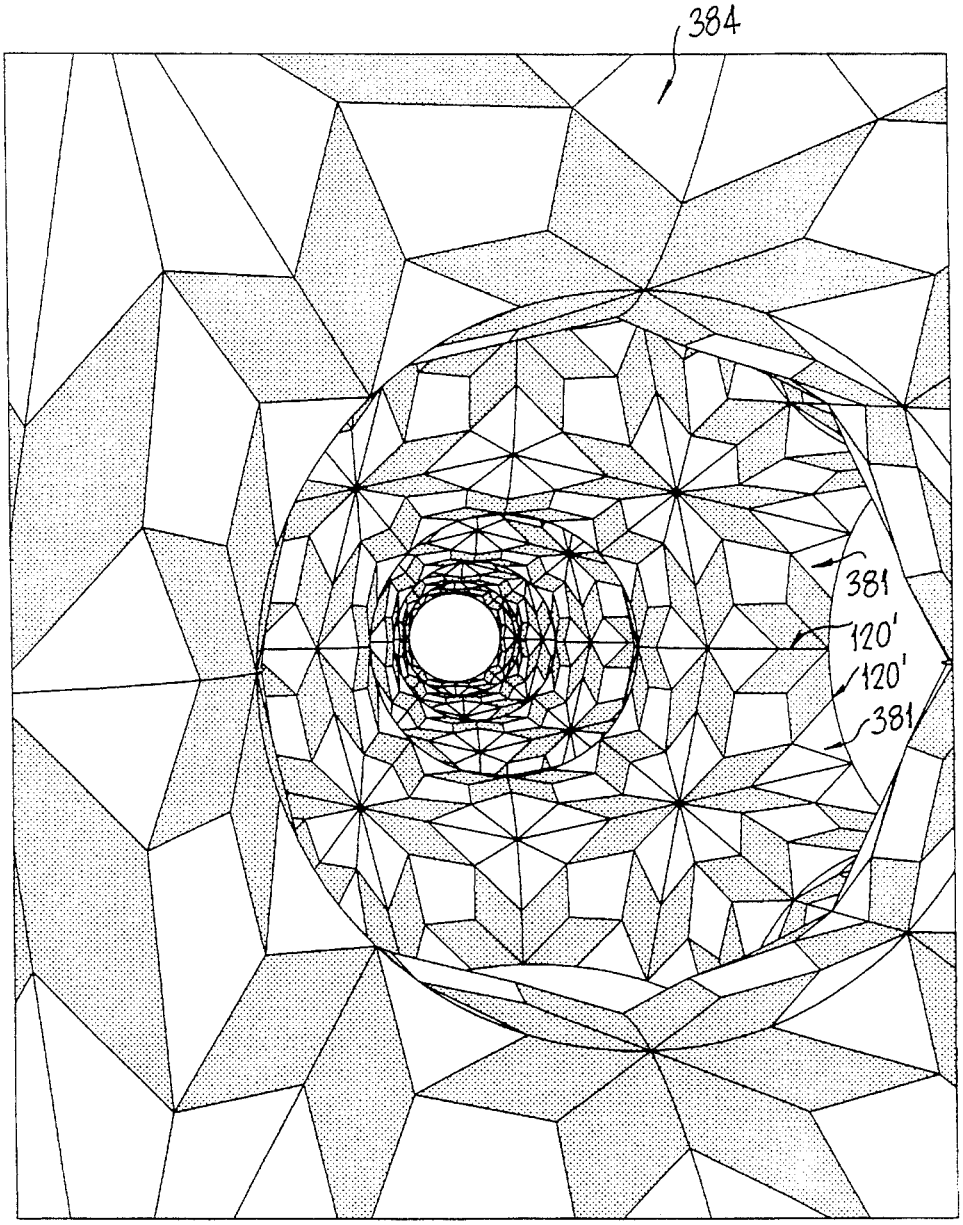

FIGS. 25*a* and 25*b* show one example of a curved space labyrinth with a non-periodic subdivision of its saddle hexagonal face. This example corresponds to the minimal Schwartz surface.

Figure 26:
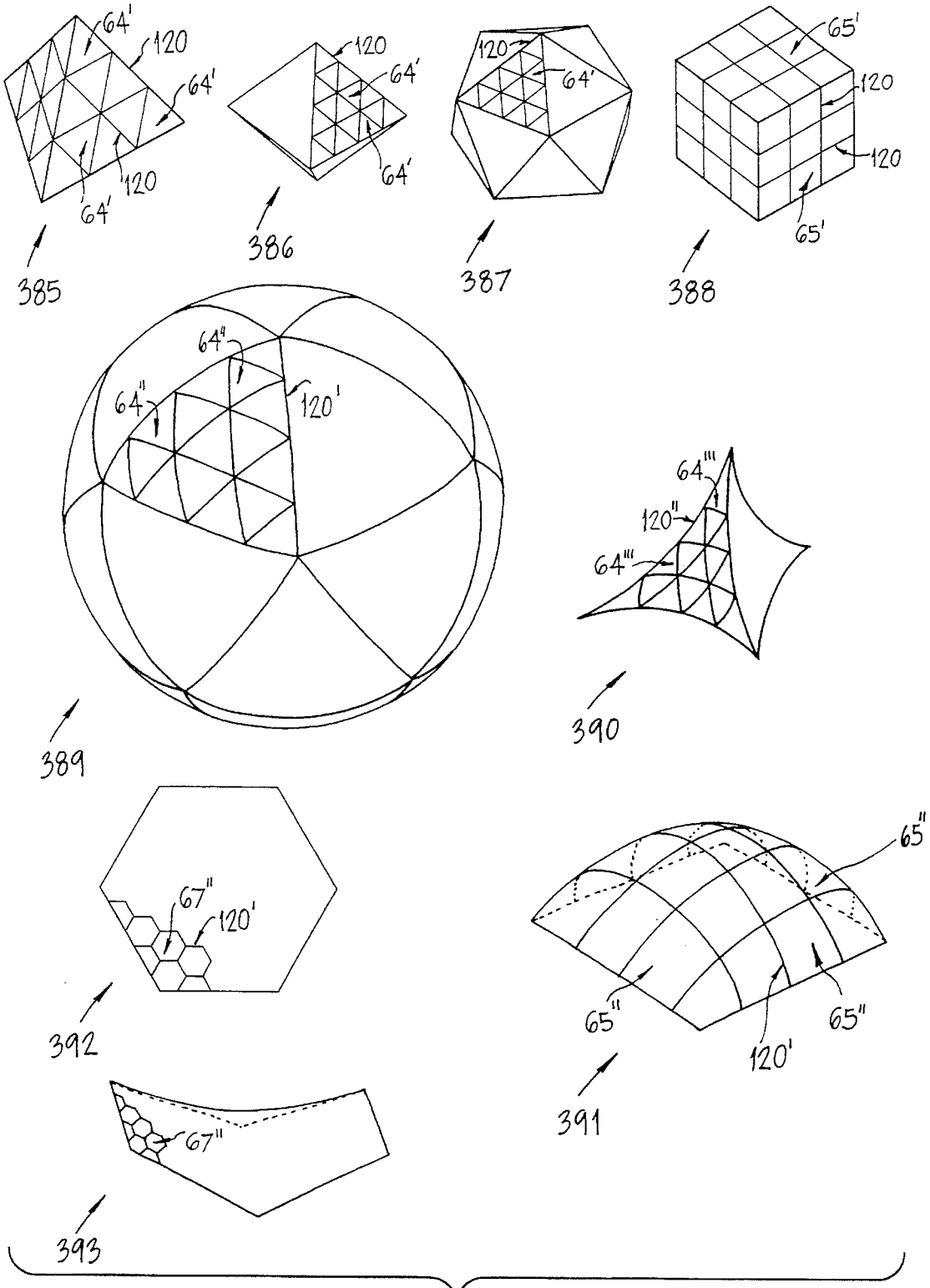

FIG. 26 shows miscellabeous examples where the subdivided triangles, squares and hexagons could be used as units of curved nets.

Figure 27A:
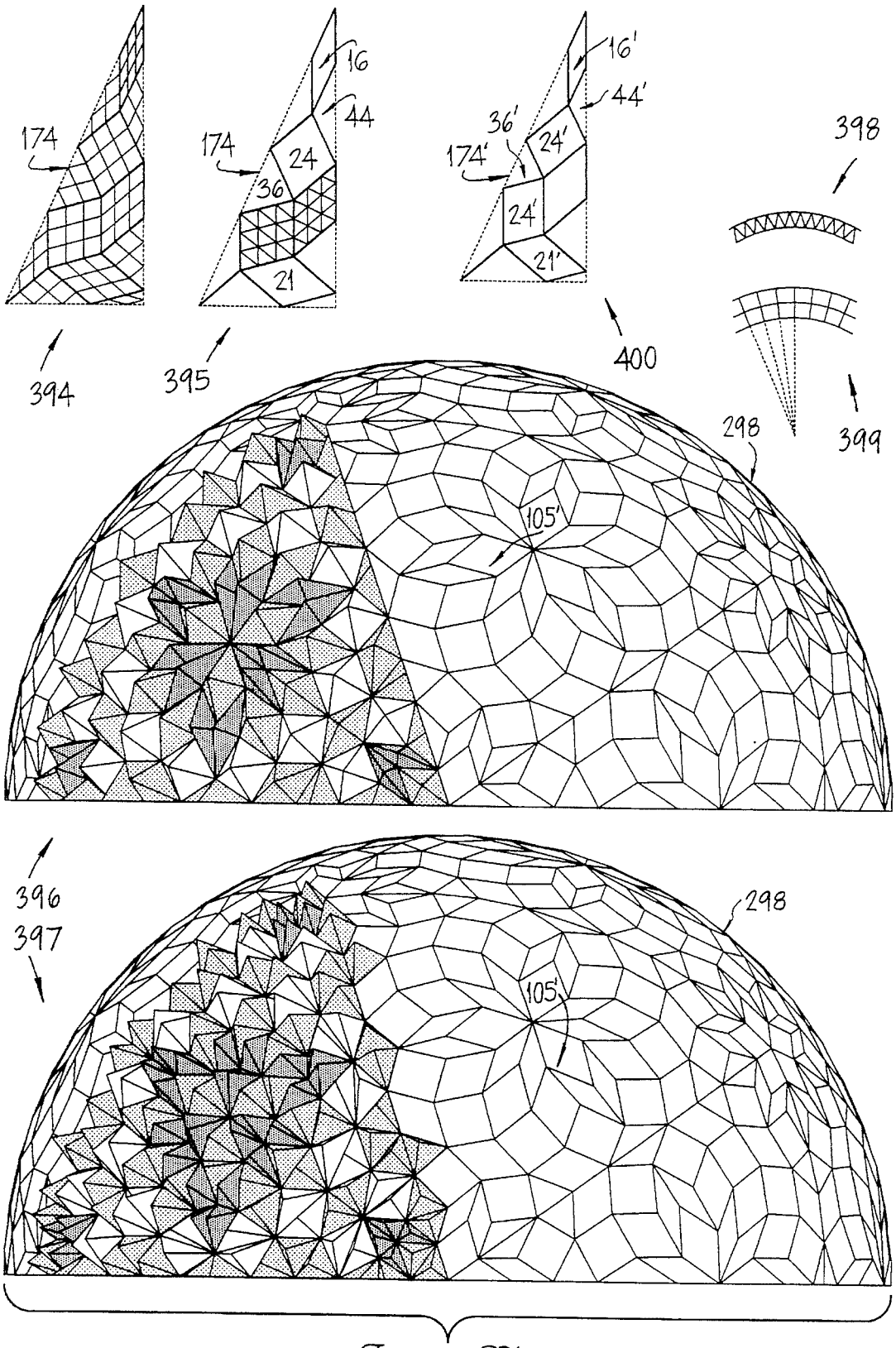
Figure 27B:
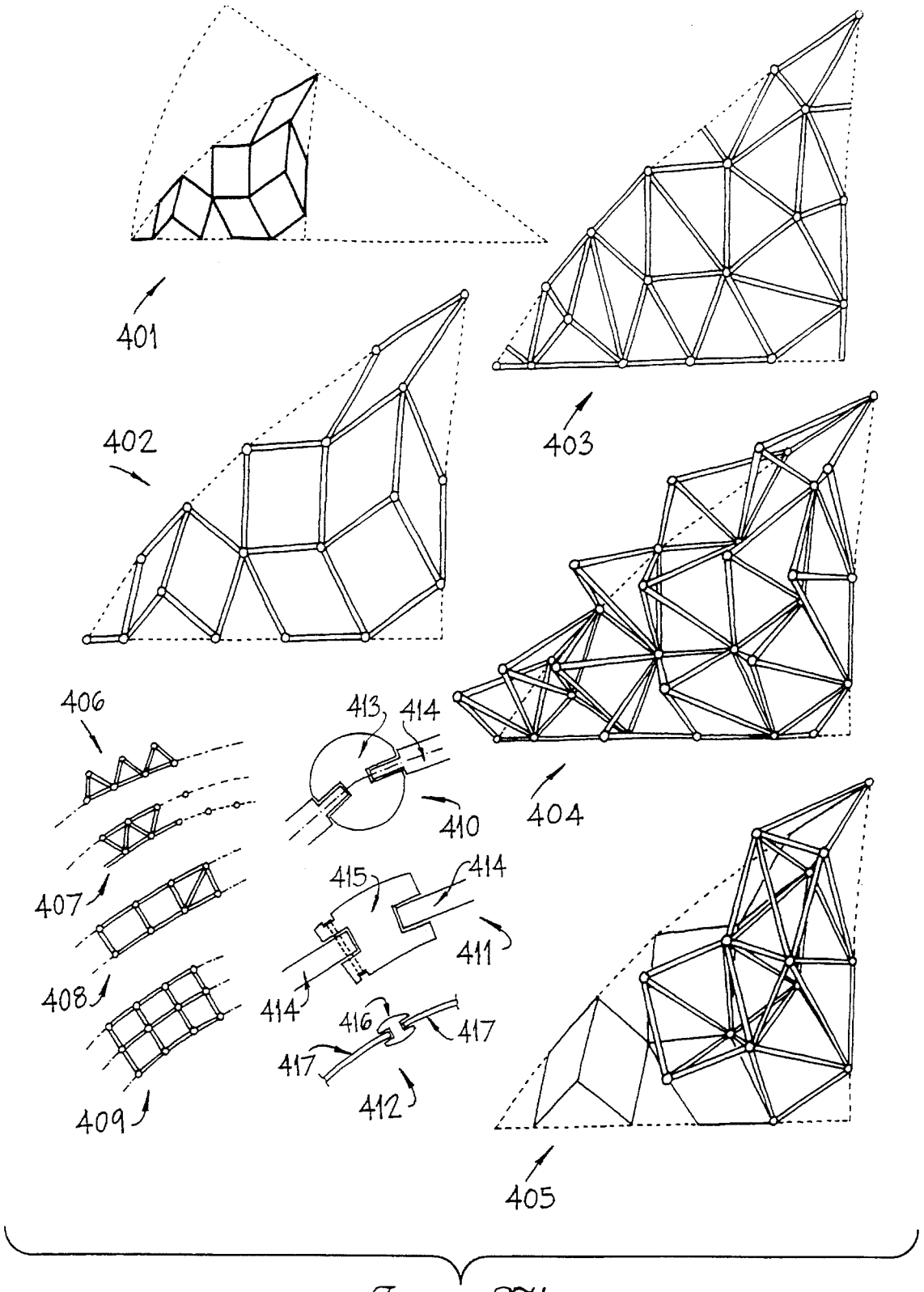

FIGS. 27*a* and 27*b* show a three-dimensionalization of the subdivided surface and its conversion into building structures composed of nodes, struts, panels and blocks.

DETAILED DESCRIPTION OF THE INVENTION

1. Family of Rhombii

Figure 1:
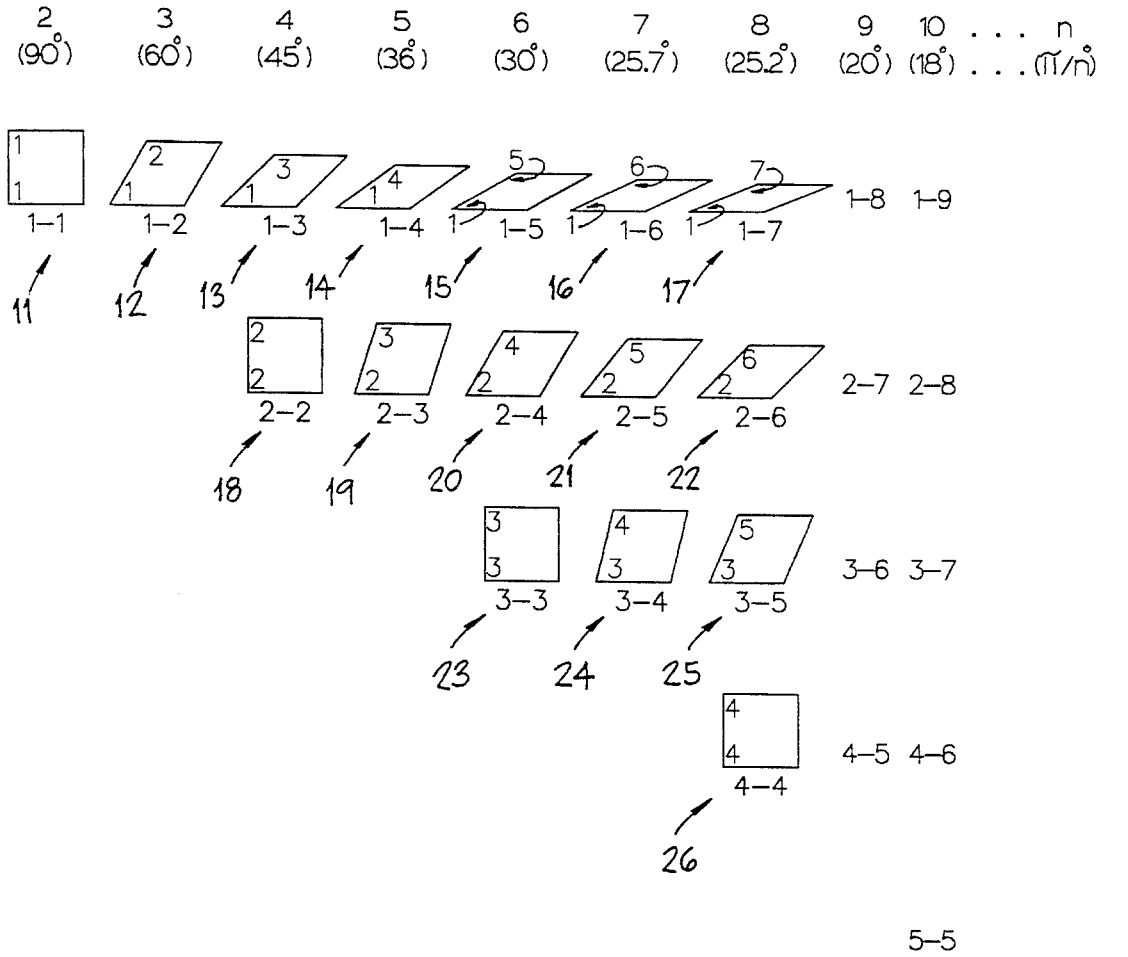

FIG. 1 shows an infinite table of rhombii 1–16 which make up the polygons in the disclosed subdivisions. These rhombii, and the technique of their derivation as described here, is known from prior literature (e.g. Lalvani). The rhombii can be derived from 2-dimensional projections of n-dimensions, where the edges of rhombii are parallel to the n-vectors of generating n-star. The n-star has n directions radiating from a point, and any pair of vectors from these n directions define two of the edges of a rhombus. The remaining two edges of the rhombus are produced in a straightforward manner by adding the new edges to the existing ones keeping their directions parallel to the pair of selected vectors.

In the types of subdivisions described here, n-star is obtained by lines (vectors) joining the center of a 2n-sided regular polygon to its n vertices lying on one half-side of the polygon. The angles between adjacent vectors equal A, the central angle of the 2n-sided polygon, such that A=180°/n. It is clear that the angles between any selected pairs of vectors, i.e. the interior angles of a rhombus, will be integer multiples of A. The general expression for the interior angle of a rhombus is a.A, where a=1,2,3,4 . . . n−1. In fact, the number of distinct rhombii obtained from n equals all pairs of values of a which add up to n. For example, in FIG. 1, under column n=4 there are only two rhombii 13 and 18 are possible since the only pairs of integers that add up to 4 are 1 and 3, and 2 and 2. These integers are marked on the interior of each rhombus. In the example cited, the rhombii 13 and 18 are correspondingly labelled as 1–3 and 2–2, respectively. To take another example, under n=5 column, only two rhombii 14 and 19 are possible since 1 and 4, and 2 and 3, are the only pairs that add up to 5. These two rhombii are respectively designated as 1–4 and 2–3. Following this process, the entire table in FIG. 1 can be filled to generate an infinite family of rhombii.

For each rhombus, the precise angle can be obtained by multiplying the integers marked on the interior angles of the rhombus with A. The value of A for n=2 through 10 is given within brackets on top of the table in FIG. 1. For n=4 case, A=45°, and the angles of the rhombus 13 are 45° and 135°, respectively, and the the angles of the rhombus 18 are 90° each. Angles for other rhombii in the table can be similarly calculated.

1.1 Subdivided Rhombii 1.11 Triangulation

Figure 2A:
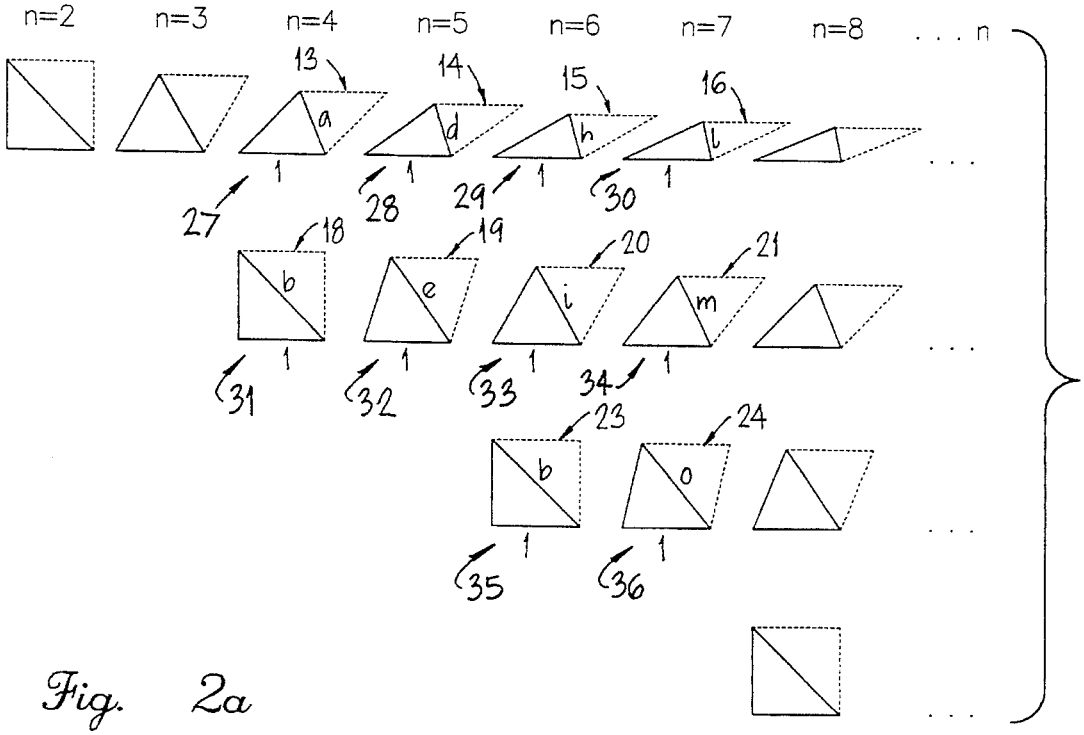
Figure 2B:
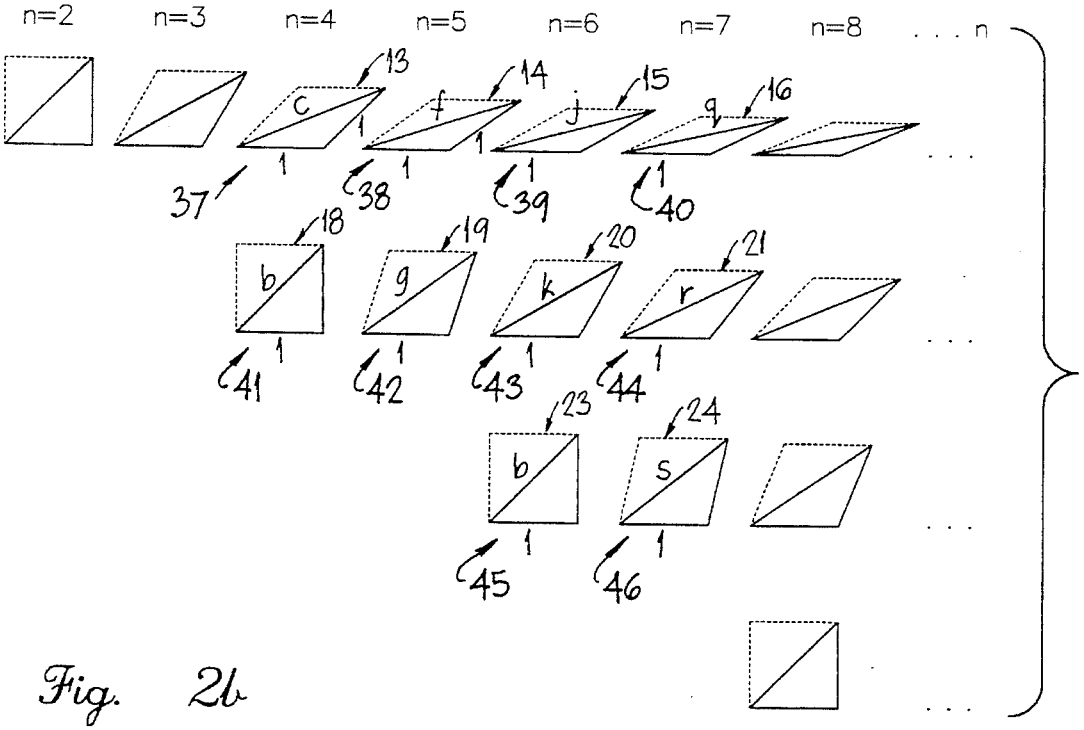

Each rhombus can be divided into two triangles by inserting a diagonal as shown in FIG. 2*a* which shows the resulting half-rhombii. The half-rhombii for n=4 through 7 are marked 27–36. Alternatively, the second diagonal could be inserted to subdivided each rhombus as shown in FIG. 2*b*. Here too the half-rhombii for n=4 through 7 are marked 37–46. The edges of all rhombii in FIGS. 1 and 2 are kept 1 unit and the lengths of diagonals are given by the characters a through s. In practice the unit edges can be in any measurement system and can be any length appropriate to the design and size of the structure. All half-rhombii are isosceles triangles with the apex angle equal to the interior angle of the rhombus (i.e. A.a) and the two base angles each equal to half of the other interior angle (the complementary angle) of the rhombus. From this data, the lengths of the diagonals of each rhombus can be determined by the well-known trigonometric equations relating lengths and angles. If the diagonal equals x, then $x^2=2(1-\text{Cos}\ (A.a))$ for a rhombus with a unit edge.

Figure 2C:
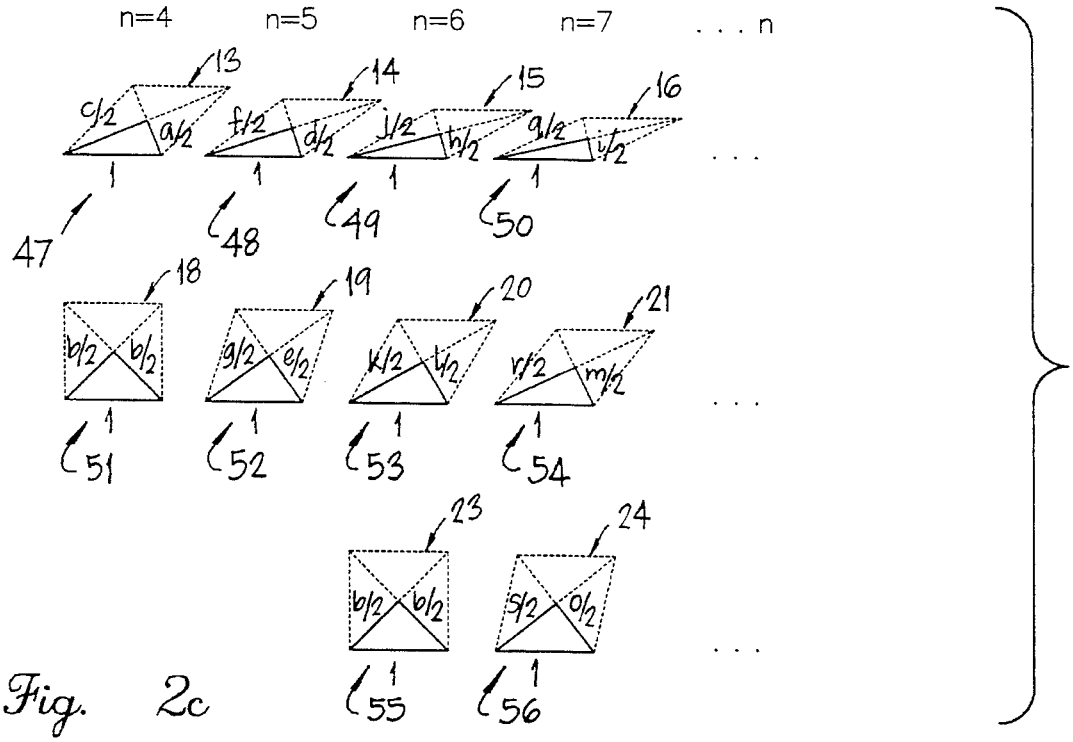

FIG. 2*c* shows quarter-rhombii 47–56 obtained by further halving of the half-rhombus. Once again, these are shown for n=4 through 7. Each quarter rhombus is a right-angled triangle with its hypotenuse equal to 1 unit and the other two sides equal to half-diagonals.

1.12 Triangular Grids

Figure 3:
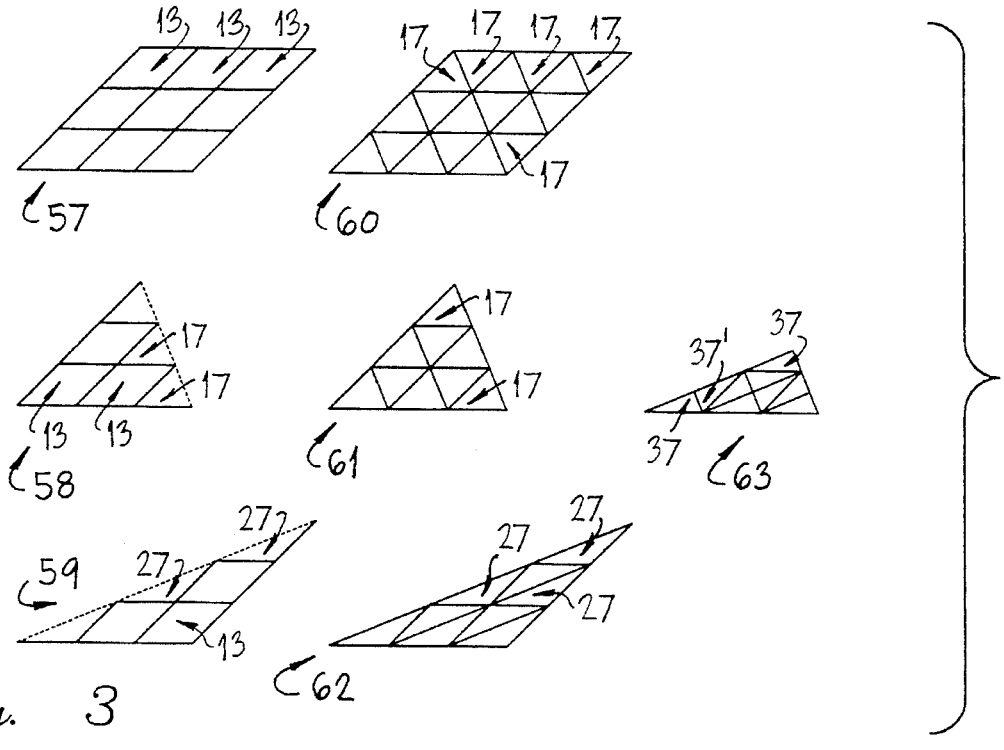

Each triangle can be subdivided periodically into a triangular grid of any size as shown in FIG. 3. This, in effect, is a way to subdivide the rhombus into smaller rhombii as shown in 57–59, and then subdividing each smaller rhombus into two triangles as shown in corresponding FIGS. 60–62. For the purposes of illustration, the n=4 rhombus 13 and its half-rhombii 27 and 37 are used. In 63, the quarter rhombus is subdivided periodically into other quarter-rhombii 37 and 37' of the same shape but smaller size. In this case, the quarter-rhombii are left-handed and right-handed.

1.13 Non-Periodic Subdivision

Each rhombus can be subdivided in a non-periodic manner into smaller rhombii. This will be shown later.

2. Family of Regular Polygons Subdivided into Rhombii 2.1 Fundamental Regions

Regular p-sided polygons, composed of p edges and p vertices, contain equal interior angles of 180°×(p−2)/p. All regular polygons can be characterized by their fundamental region. This is well-known from prior literature. This region is the smallest region of the polygon from which the entire polygon can be generated by reflections and rotations, or by rotations only. Four types of fundamental regions are described here.

Figure 4A:
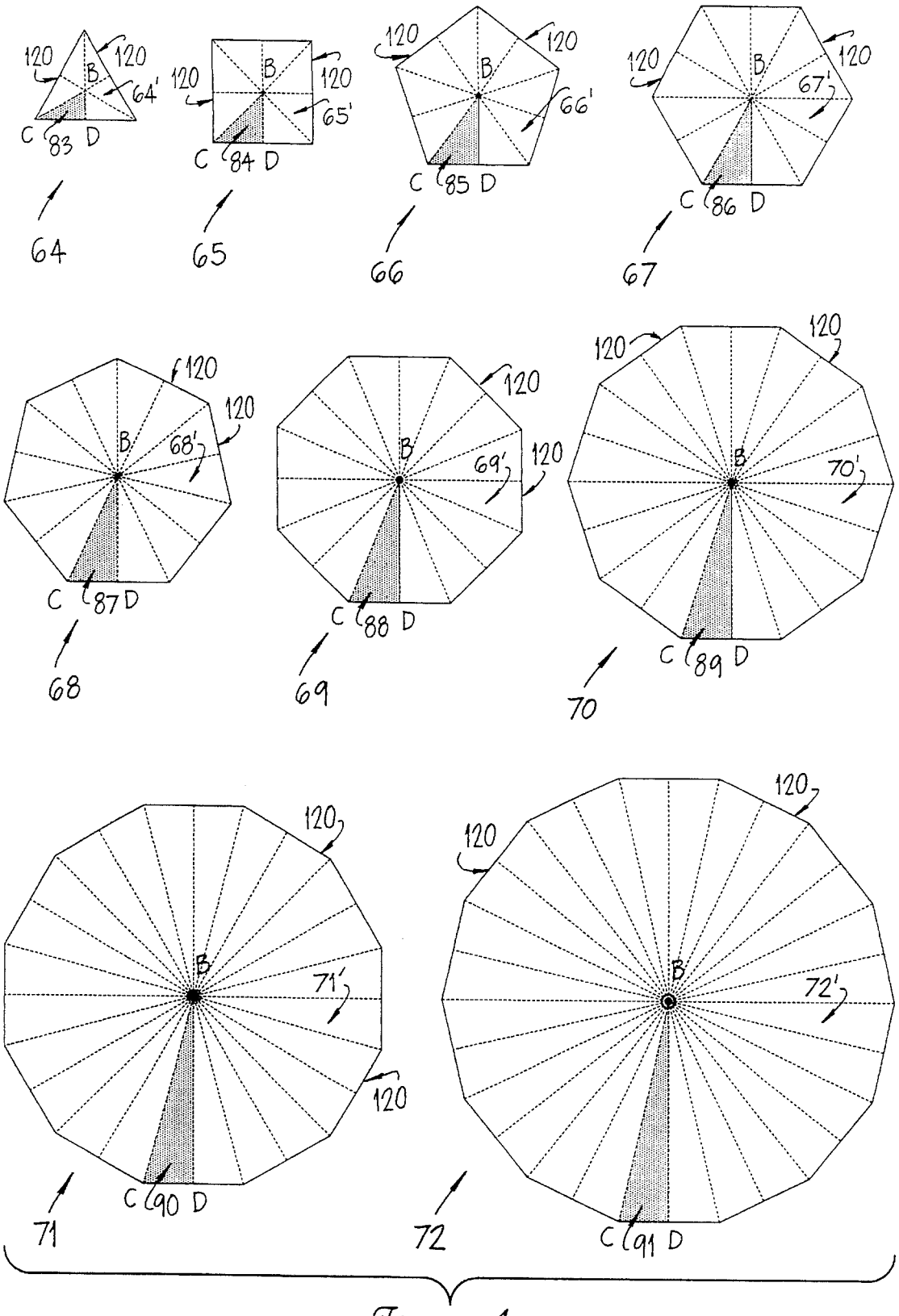

Illustrations 64–72 in FIG. 4*a* show fundamental region Type I for regular polygons with p=3, 4, 5, 6, 7, 8, 10, 12 and 14 sides, respectively, where each polygon is shown with equal sides 120. The polygons are correspondingly identified by numerals 64'–72'. These polygons have a Schlafli notation [p], e.g. a triangle is [3], a square is [4], and so on. In each case the fundamental region is the shaded right-angled triangle BCD sitting on the base of the polygon and is marked 83–91 for each polygon as shown. In each case, this region is bound by the half-edge CD of the polygon, and lines joining the center B of the polygon to the mid-point D of the edge and the vertex C of the polygon. The interior angles of the triangle are as follows: the angle at the center B equals 180°/p, the angle at the mid-edge D is a right angle and the angle at the vertex C equals 180°(1−1/p). From these angles, the ratios between the sides can be calculated, and when any one length is known, the other two can be easily calculated.

This type of fundamental region can be reflected around the line BD, then the combined area including the original region and its reflected region can be rotated p−1 times around the center B to generate the entire polygon. The polygon obtained this way has 2p regions. Such polygon also have a mirror-symmetry, where the mirrors are the lines BC and BD and all their replicas.

Fundamental region Type II is equal to the doubled portion of fundamental region Type I. This is shown in illustrations 73–79 in FIG. 4*b* for polygons with p=3, 4, 5, 6, 7, 8 and 10 identified with numerals 64'–70'. The fundamental regions 92–98 are the shaded isosceles triangles BCE with the following angles: angle at the center B equals 360°/p, and angles at the vertices C and E equal 180°(1−2/p). Here the entire BCE can be rotated p−1 times around B to generate the entire polygon. The polygons obtained this way are composed of p regions (shown with dotted lines) and have a rotational symmetry. In addition, in even-sided polygons, the region could be first reflected and then the combined regions rotated p/2 times to generate the entire polygon. In such even-sided cases, the polygons have mirror-symmetry.

Fundamental region Type III is a special case of the region Type II. It is restricted to even-sided polygons and is composed of any other (2/p)th portion of a polygon. One example is shown in 80 for p=10 case, the decagon 71', in FIG. 4*c*, where the shaded fundamental region 99 is the lozenge-shaped polygon BCEF which is 1/5th of the 10-sided polygon. This region must be rotated (p/2)−1 times around B to complete the polygon. In this type of fundamental region, the entire polygon has a rotational symmetry. The general case is when the fundamental region is any fraction which divides p into integers. For example, in the p=9 case, the region could even be ⅓rd, or in the p=20 case, the region could be ¼th or ⅕th.

Fundamental region Type IV is also related to the region Type II. Here it is any 1/pth portion of of an odd-sided or even-sided polygon which must be rotated p−1 times to generate the entire polygon. The resulting polygon has rotational symmetry. Two examples, 81 and 82, are shown for the p=5 case in FIG. 4*d*. In 81, the fundamental region 100 is the quadrilateral BGEH which is 1/5th of the pentagon 66', and in 82 the fundamental region 101 is an irregular 1/pth part of the pentagon 66'. In the latter case, the curvilinear line BC is the same as the line BE.

Fundamental region Type V (not illustrated) is composed of one-half of the polygon. Here the polygon has one mirror-plane which divides the two fundamental regions and the polygon has bilateral symmetry.

2.12 Symmetric Polygons with Asymmetrically Subdivided Fundamental Regions

All fundamental regions of regular polygons can be subdivided into rhombii of FIG. 1 in a non-periodic manner. There are several different procedures, all known in prior literature, which could be followed in deriving the subdivision:

a) The procedure for subdivision may be in gnomonic increments which are self-similar, i.e. a portion of a tile or tiling is added to an existing portion so that the new combined portion is similar in shape to the original portion but larger in size. There is a built-in fractal-like structure in this procedure. Two examples of such a procedure will be shown later.

b) An topological technique, like De Bruijn's 'dualization method', could be used to derive the non-periodic subdivision. This uses n-directional grids composed of n sets of parallel lines in unit increments of distance from an origin, where each set of lines is perpendicular to the n directions of the n-star. The topological dual of this n-grid is a non-periodic tiling. Alternatively, the method used by quasi-crystal scientists, called 'cut-and-project' method, could be used.

c) A technique using matching rules as in the case of the Penrose tiling could be used. By this technique, the tiles are marked in specific ways to ensure a forcibly non-periodic tiling by matching the markings while tiling the surface.

d) An arbitrary non-periodic design could be used instead. Here the tiles could be arranged arbitrarily by fitting them together. The subdivision could be constructed in a trial-and-error manner to fit the rhombii and half-rhombii within the fundamental region. An interesting example of randomly non-periodic design is where tiles are locally rearranged at various places of a source pattern which is derived from rule-based or procedure-based techniques mentioned above.

2.2 Asymmetric Subdivisions of Polygons

In contrast to the method of subdividing fundamental regions, entire polygons could be subdivided into rhombii such that the polygons lack an overall symmetry. The procedures described in the last section could be applied for the entire polygons.

2.3 Examples

FIGS. 5–8 show an assortment of examples of polygons with p=3, 4, 5, 6, 7, 8, 10 and 14 sides, each bound by edges 120. The polygons with p and 2p sides are grouped since from any n, p=n and p=n/2 polygons are possible. For example, polygons with 3 and 6 sides are possible from the rhombii of n=6. The illustrations show polygons with p=3 and 6 in FIG. 5, p=4 and 8 in FIG. 6, p=5 and 10 in FIG. 7, and p=7 and 10 in FIG. 8. The examples of non-periodic subdivisions of the fundamental regions and subdivisions of entire polygons are mixed. The examples are representative and other examples can be found by using similar methods for all values of p greater than 2.

2.31 Subdivided Triangles and Hexagons

Figure 5A:
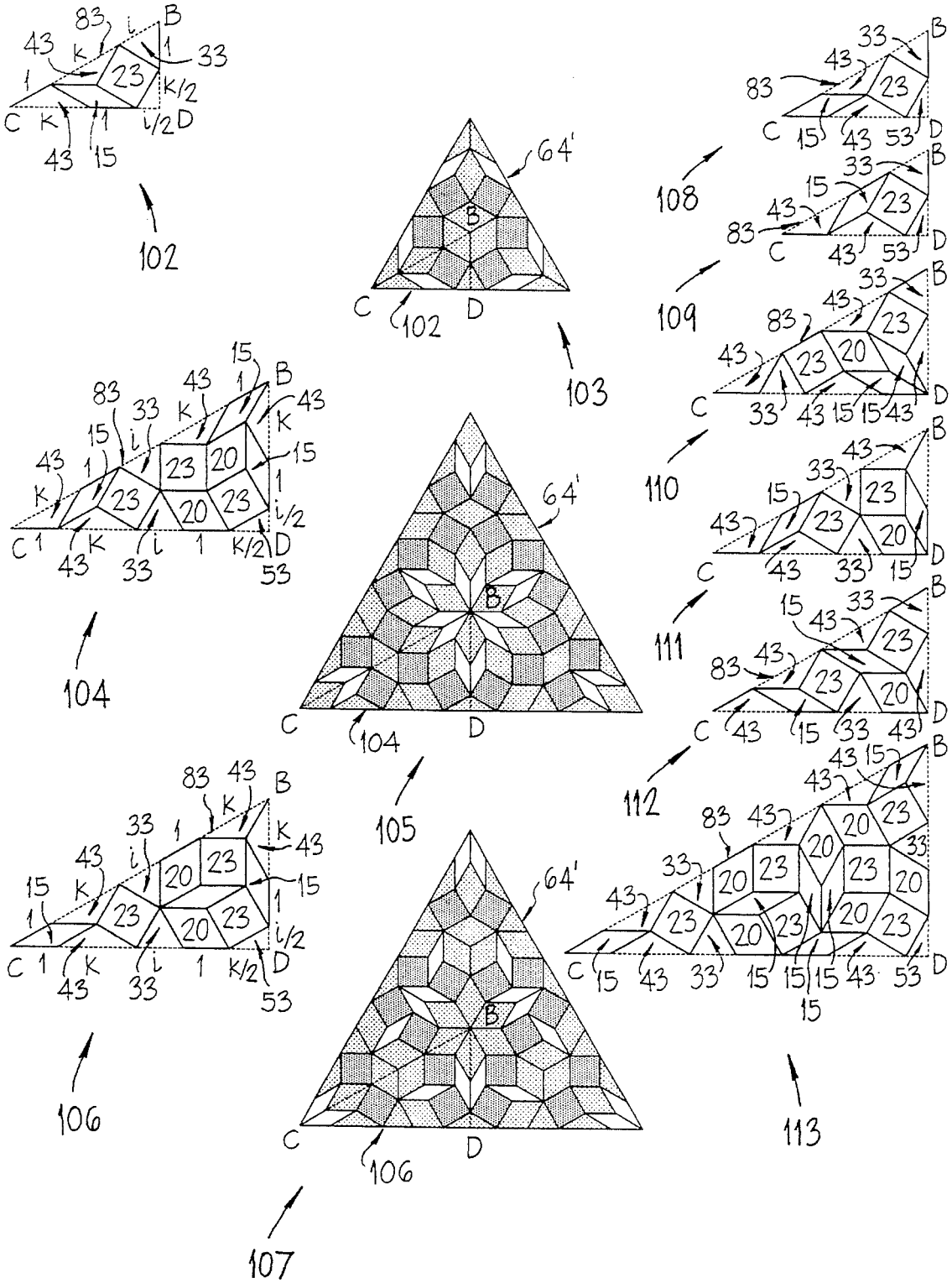
Figure 5B:
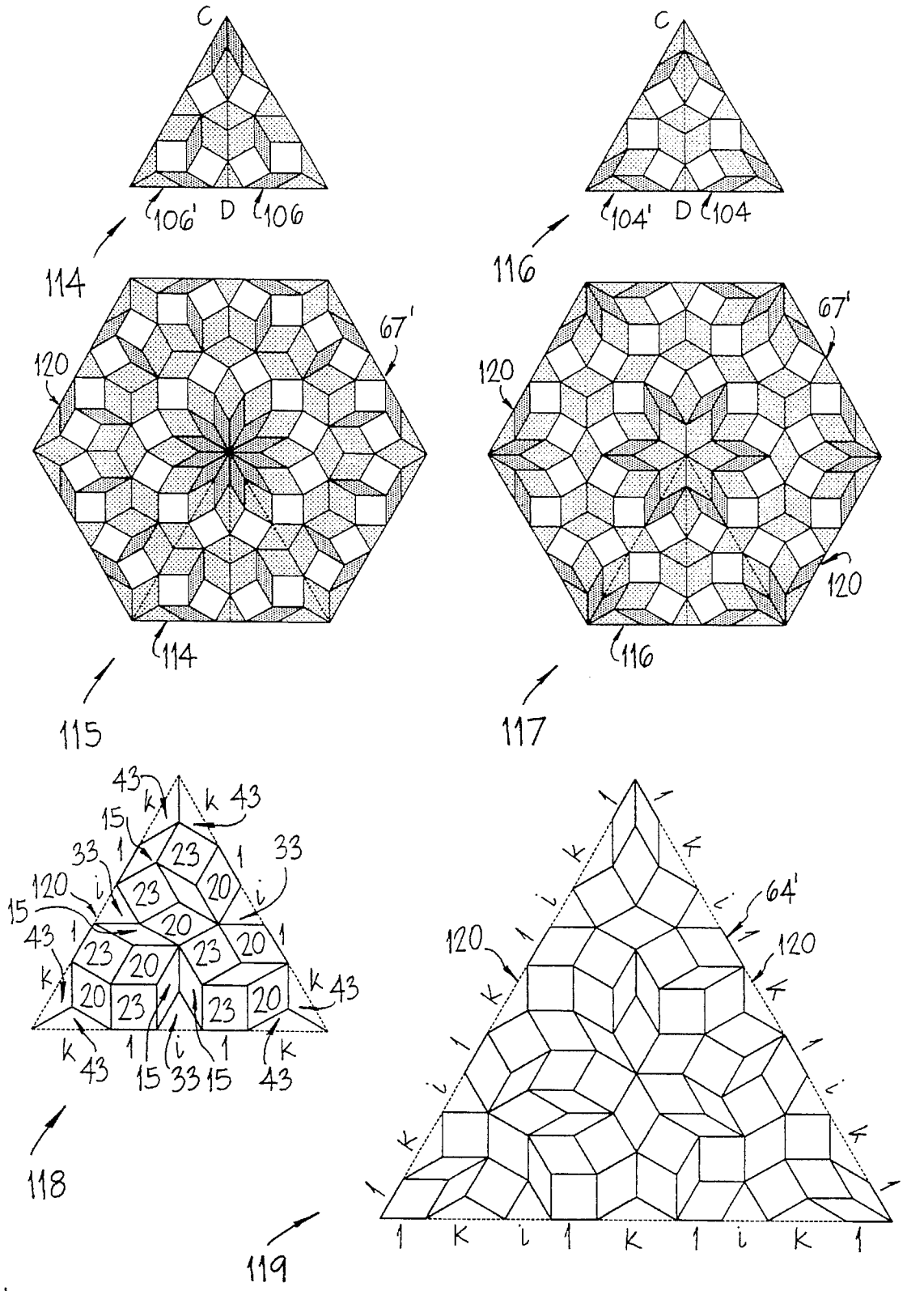

FIGS. 5*a* and 5*b* show subdivisions of triangles 64' and hexagons 67' bound by edges 120 and using the rhombii 15, 20 and 23, the associated half-rhombii 33 and 43, and the quarter-rhombus 53 from the n=6 case. In FIG. 5*a*, three examples of fundamental regions 104, 104 and 106 along with their corresponding symmetric triangles 103, 105 and 107 are shown. These regions correspond to fundamental region Type I. The region 102 consists of 15/4 rhombii including two full rhombii, three half rhombii and one quarter-rhombus. The total number of rhombii in the triangle equal 45/2. The length of the base CD equals k+3i/2 and the other sides are as marked. The regions 104 and 105 are of the same size with the base CD=3k/2+i+2, and each is composed of 45/4 rhombii in the fundamental region. The derivative triangles have 135/2 rhombii. Alternative regions 108–113 are also shown and generate different subdivisions of the triangle. Regions 108 and 109 are variants of 102. Regions 110,111 and 112 are variants of one another with the base CD=k+i+2 and composed of 8 rhombii. Region 113, the largest shown here, has a base CD=2k+3i/2+3 and is composed of 91/4 rhombii.

FIG. 5*b* shows the derivation of two different hexagons in 115 and 117 obtained from the regions 104 and 106 shown in FIG. 5*a*. The procedure is shown in 114 where the region 106 (shown here in a different orientation with CD upright) is reflected around CD to the region 106'. In 115, this doubled region 114 is rotated 5 times around the center to generate the hexagon 67' with a side 2k+i+2. The number of rhombii in the hexagon equals 135. The hexagon 117 is derived from 116 which is derived from 104 in a similar manner. 118 and 119 are two examples of arbitrary subdivision of the triangle 64' into rhombii. 118 has the same number of rhombii as 103, and 119 has the same rhombii as 105 or 107.

2.32 Subdivided Squares and Octagons

Figure 6A:
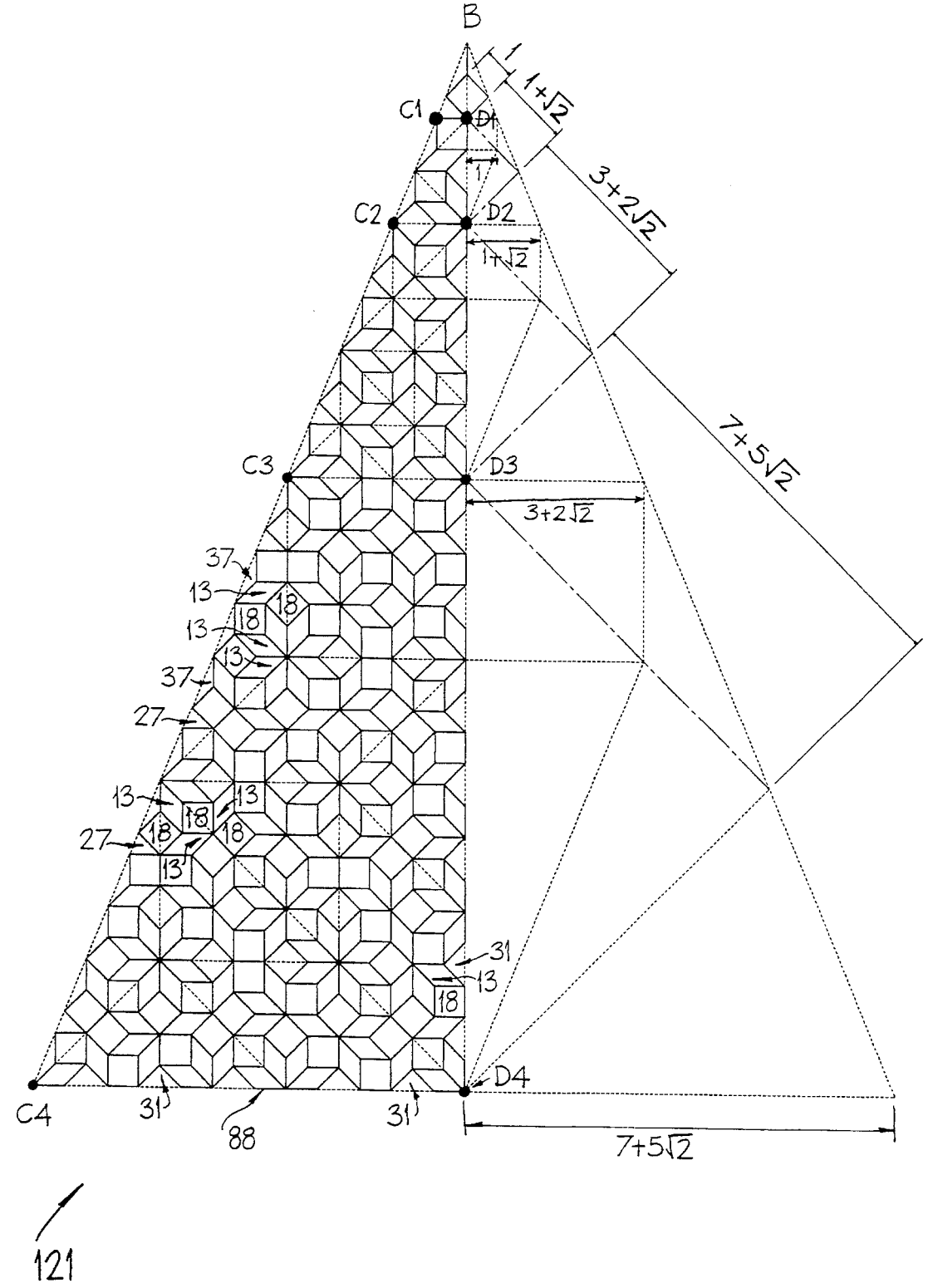
Figure 6B:
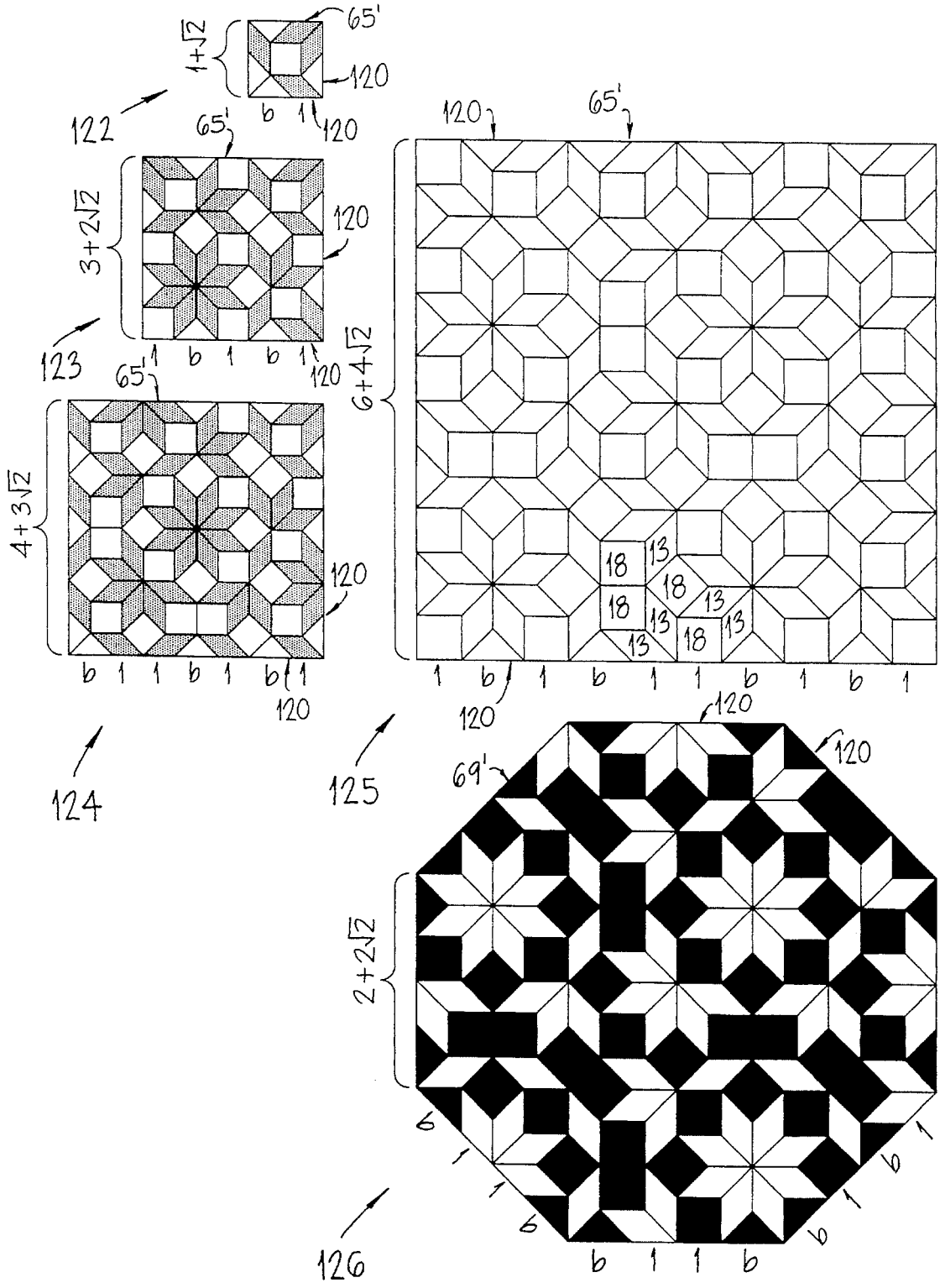
Figure 6C:
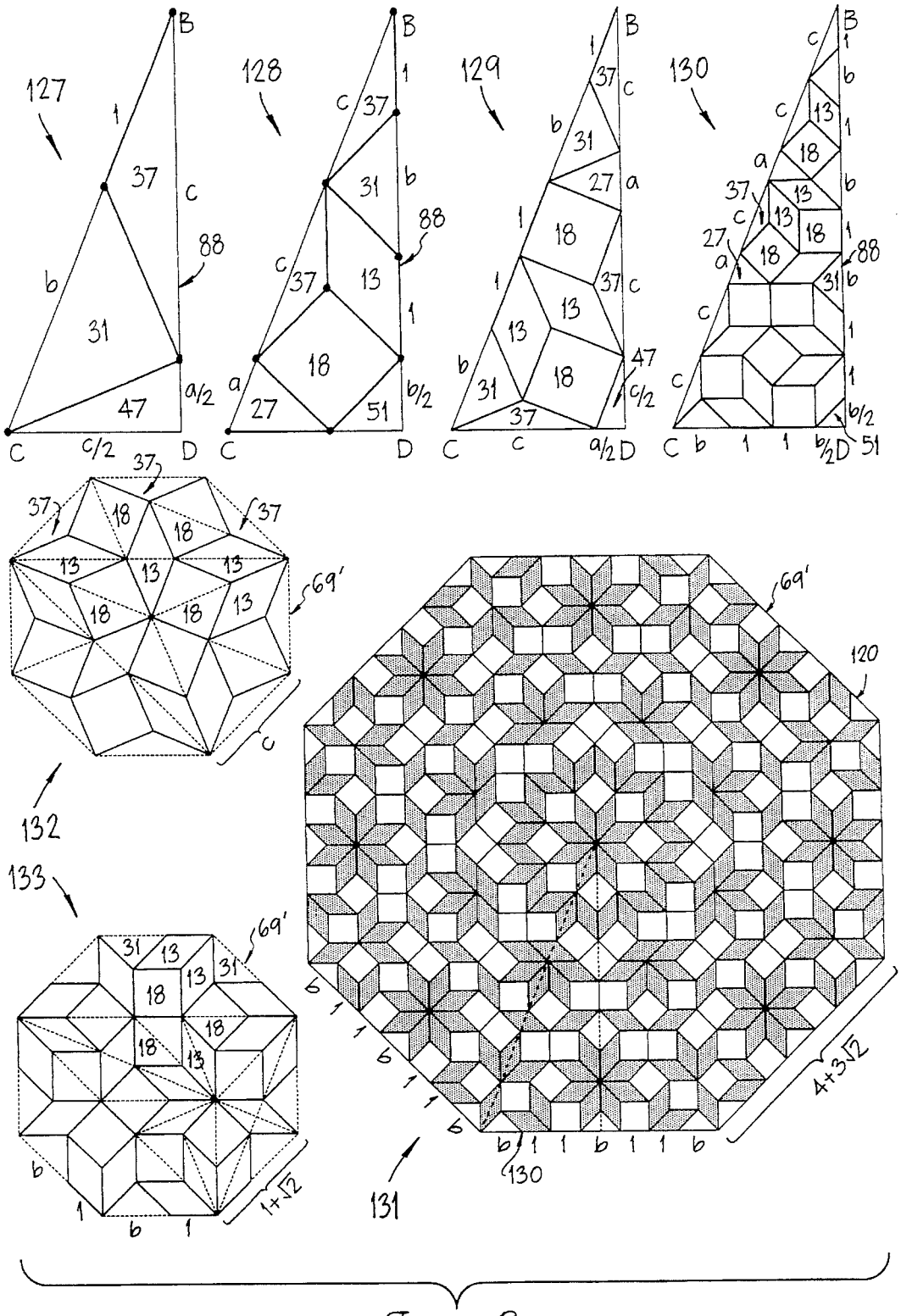

FIGS. 6*a*, 6*b* and 6*c* show examples of subdivisions of squares 65' and octagons 69' bound by edges 120. The subdivisions are composed of rhombii 13 and 14, half-rhombii 27, 31 and 37, and the quarter-rhombii 48 and 51, all belonging to the n=4 case in FIGS. 1 and 2. Some of the examples shown here are procedure driven. The procedure is shown in FIG. 6*a*. 121 shows the subdivision of the fundamental region 88 of an octagon in gnomonic increments. The fundamental triangle $BC_1D_1$ grows to $BC_2D_2$ which grows to $BC_3D_3$ which grows to $BC_4D_4$, and so on. The base $C_1D_1$ of the starting triangle equals 1, the base $C_2D_2$ of the second region equals 1+/2, the base $C_3D_3$ equals 3+2/2, and the base $C_4D_4$ equals 7+5/2. These lengths are part of an infinite geometric series 1, 1+/2, (1+/2)2, (1+/2)3, . . . where each number in the series equals (1+/2) times the preceding number. Since the progression has a irrational number in the series, the division of a line will necessarily be non-periodic. This non-periodicity carries over to division of the plane using the tiles. In 121, squares of increasing size can be seen connected point-to-point along the vertical line $BD_4$. These correspond to the rhombus 18 and their sides correspond to the geometric series. In addition, rhombii 13 and half-rhombii 27, 31 and 37 can also be seen in increasing sizes according to the same geometric series.

FIG. 6*b* shows four subdivided squares in 122–125 having increasing sizes extracted from the subdivision obtained in 121. The four squares shown have a mirror-symmetry around the diagonal joining the top right to the bottom left corner of each square and thus have fundamental region Type V. The sizes are marked in each case and b=/2. The octagon in 126 is obtained from 125 by cutting off the corners. A similar truncation of the other squares produces octagons with unequal sizes.

FIG. 6*c* shows a variety of octagons 69' bound by edges 120 and subdivided into the same rhombii, half-rhombii and quarter-rhombii from n=4 as in FIG. 6*b*. 127–130 show fundamental regions 88 of Type I subdivided in increasing number of rhombii. For the purposes of illustration, the fundamental regions 88 are kept the same size and the rhombii shrink in size with increased subdivision. Region 127 is composed of 5/4 rhombii and has a base CD=c/2. Region 128 is composed of 17/4 rhombii and has a base CD=b/2+1. Region 129 is composed of 29/4 rhombii and has the base CD=c+a/2. Region 130 is composed of 99/4 rhombii and has a base CD=3b/2+2. The subdivided octagon 131 is obtained from 130 by reflecting and rotating as described before. Subdivided octagons 132 and 133 have lost their global symmetry and instead have one mirror-plane which divides them into equal halves. In each half, the subdivision has no symmetry.

2.33 Subdivided Pentagons and Decagons

Figure 7A:
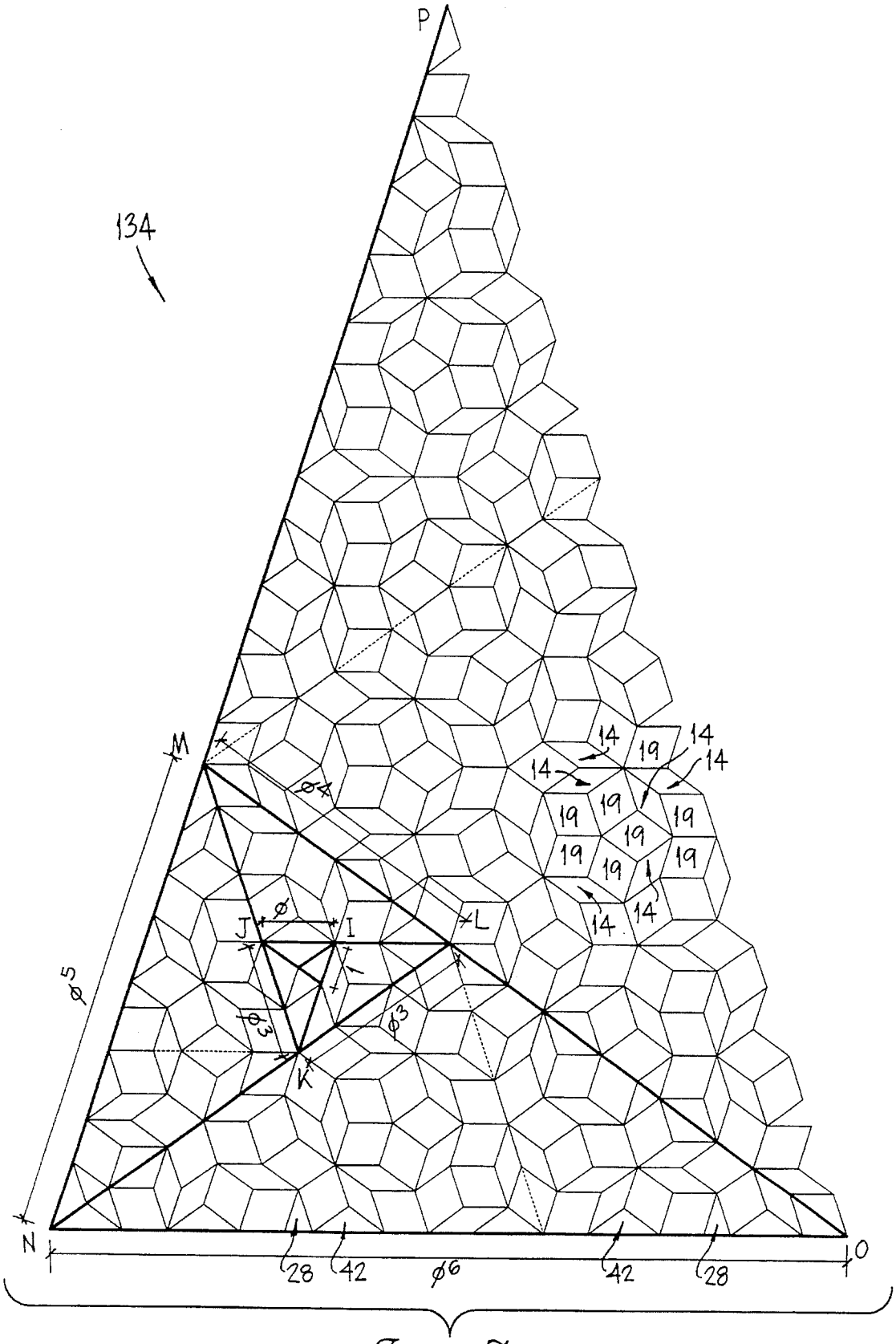

FIGS. 7*a–f* show pentagons 66' and decagons 70' bound by edges 120 and subdivided into rhombii using a procedure of gnomonic growth. The rhombii used are 14 and 19, and the half-rhombii are 28, 32, 38 and 42, and the quarter rhombii are 48 and 52, all from n=5 case. In FIG. 7*a*, 134 shows the prior art procedure and the tiling generated is the well-known Penrose tiling. The tiling pattern grows in the golden series 1, ø, $ø^2$, $ø^3$, $ø^4$, . . . , here shown with the growth of an equiangular golden spiral. Starting with a half-rhombus 28, the half-rhombus 42 is added as a gnomon to produce a larger ø-half-rhombus 28. A ø-half-rhombus 42 is added as a larger gnomon to obtain a larger $ø^2$-half-rhombus 28, and the procedure is continued reiteratively. Since the increments are in golden ratio, an irrational number, a non-periodic subdivision is forced on the lines and the area. 134 shows the half-rhombii 28 and 42 in golden increments and subdivided into smaller self-similar rhombii.

Figure 4B:
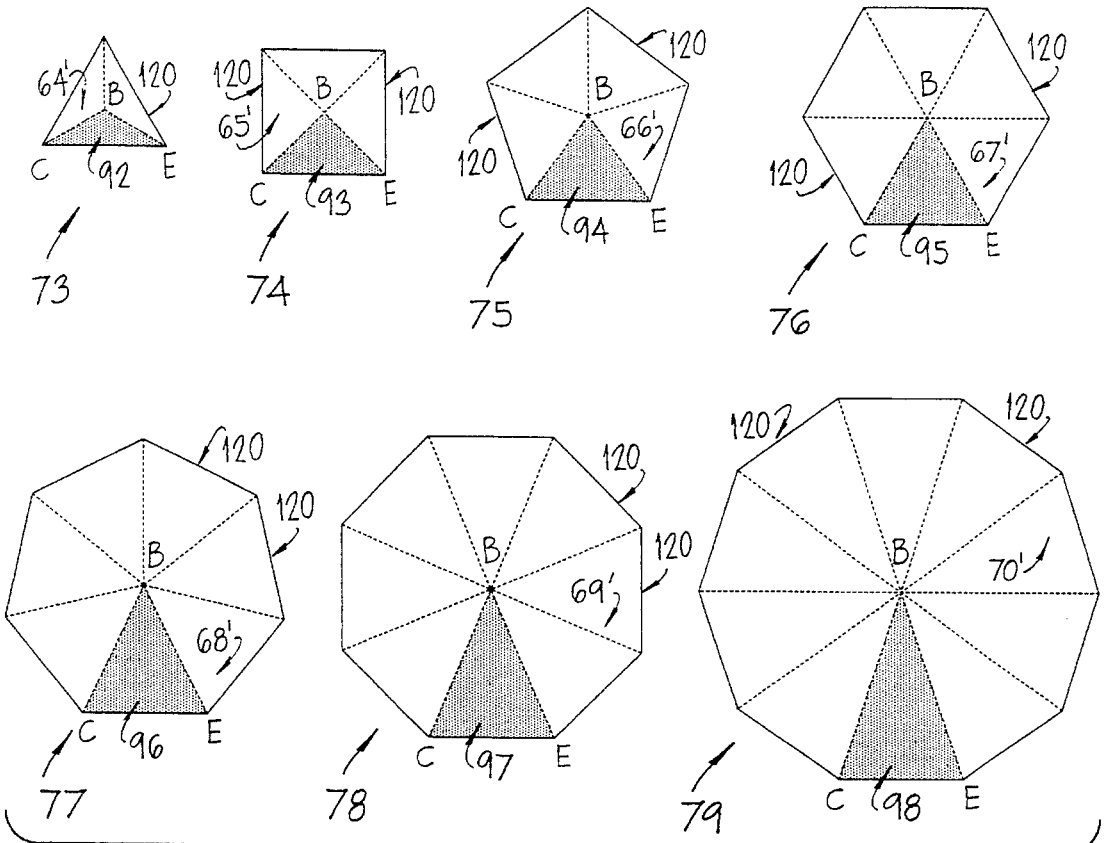
Figure 4C:
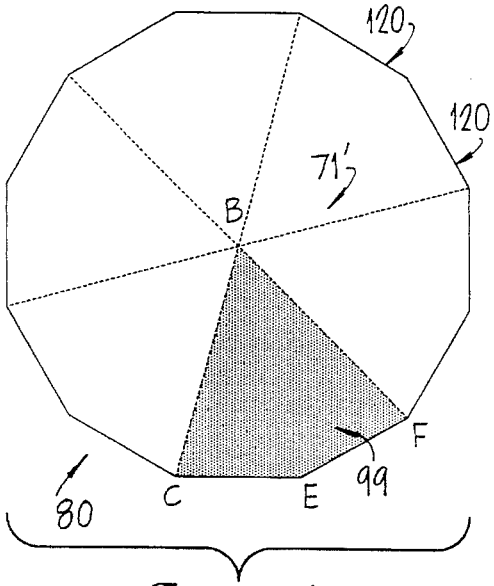
Figure 7B:
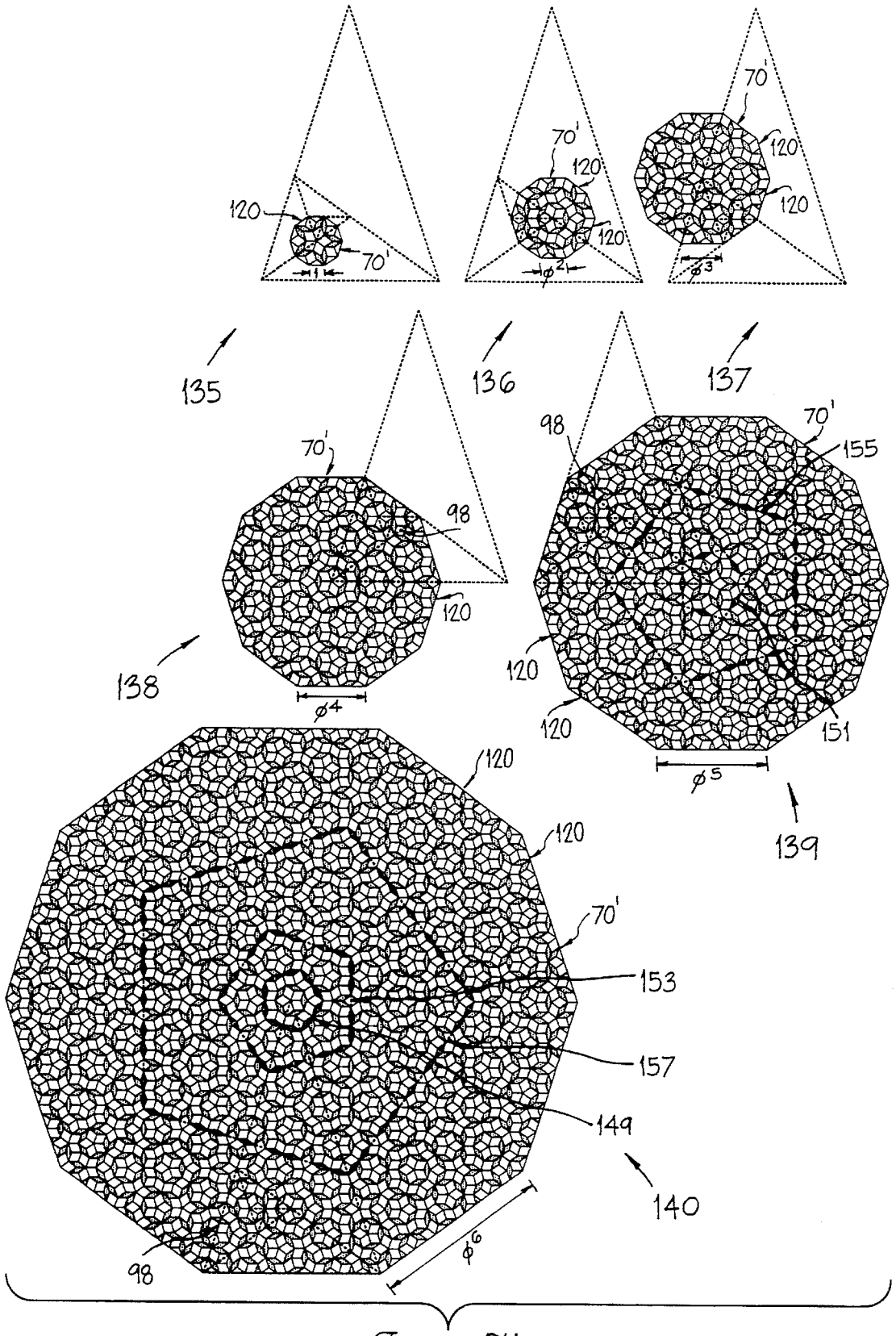

The half-rhombus 28 is also the fundamental region 98 (Type II in FIG. 4*b*, illustration 79) of the decagon and has an acute apex angle of 36°. As the series of increasingly larger golden half-rhombii 28 in 134 are individually rotated around their apex, a series of increasingly larger subdivided golden decagons are obtained. These are shown in FIG. 7*b*, and the apices or centers of decagons are marked in FIG. 7*a*. 135 is a ø-decagon with an edge equal to ø when the edge of the rhombus equals 1. Its center is the point K. 136 is $ø^2$-decagon with L as its center. 137 is a $ø^3$-decagon with M as its center, 138 is a $ø^4$-decagon with N as its center, 139 is a $ø^5$-decagon with O as its center and 140 is a $ø^6$-decagon with P as its center. The dotted line shows the equiangular spiral for reference in each case. The successive decagons alternate between the "infinite sun" and the "infinite star" patterns of Penrose.

Figure 7C:
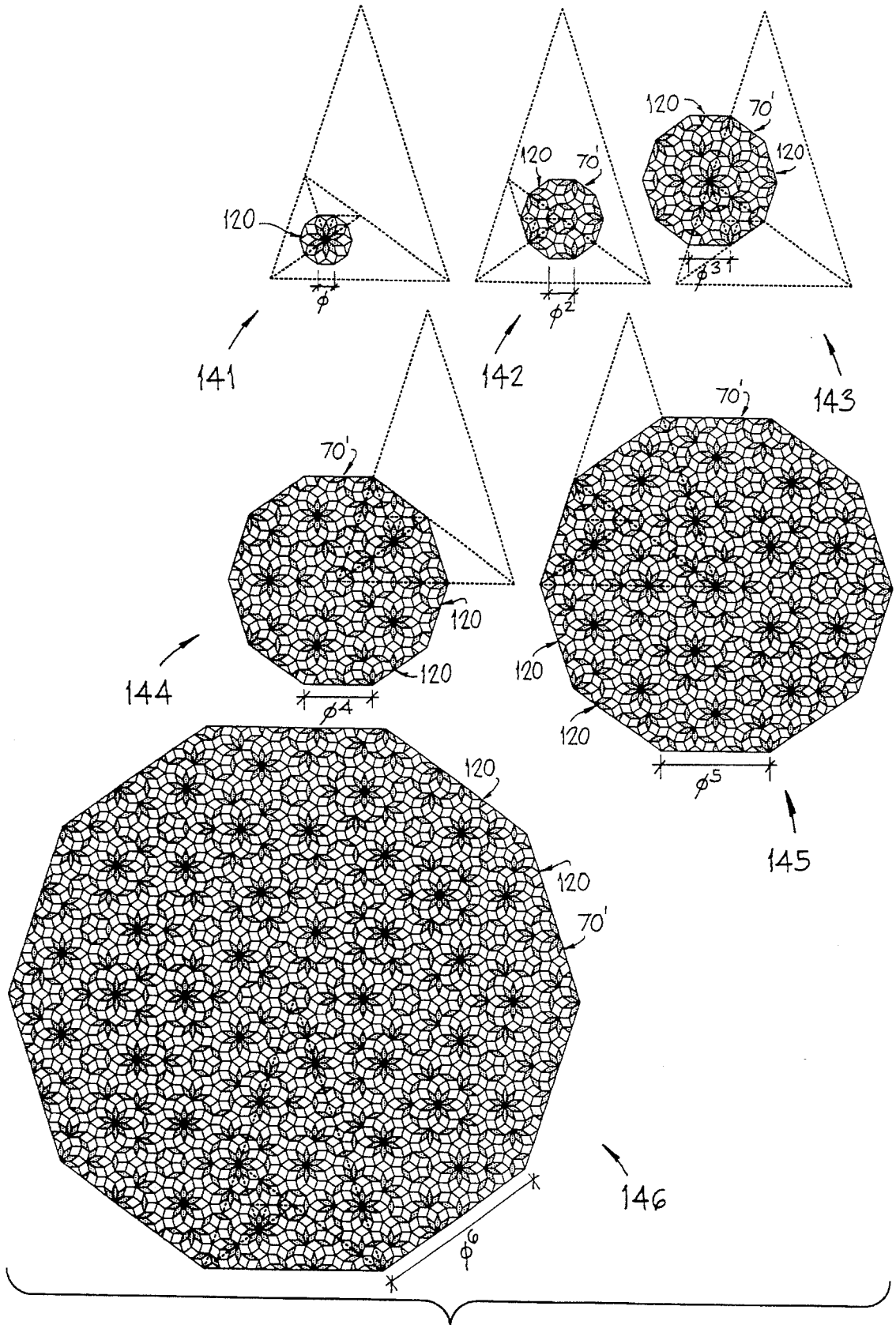

FIG. 7*c* shows an alternative subdivision of the series of golden decagons into the rhombii 14 and 19, with half-rhombii 28 and 42 on the periphery. The procedure of generation is identical to that used in FIG. 7*b*, but the rhombii 14 in 141 are inverted and cluster around the center in a star composed of ten rhombii 14 (compare with 135 where the same rhombii 14 are towards the outside and away from the center). This difference in the initial step is carried throughout the pattern to generate a variant of the Penrose tiling which is characterized by the appearance of star-like clusters of ten rhombii 14 at various places in the pattern.

Figure 7D:
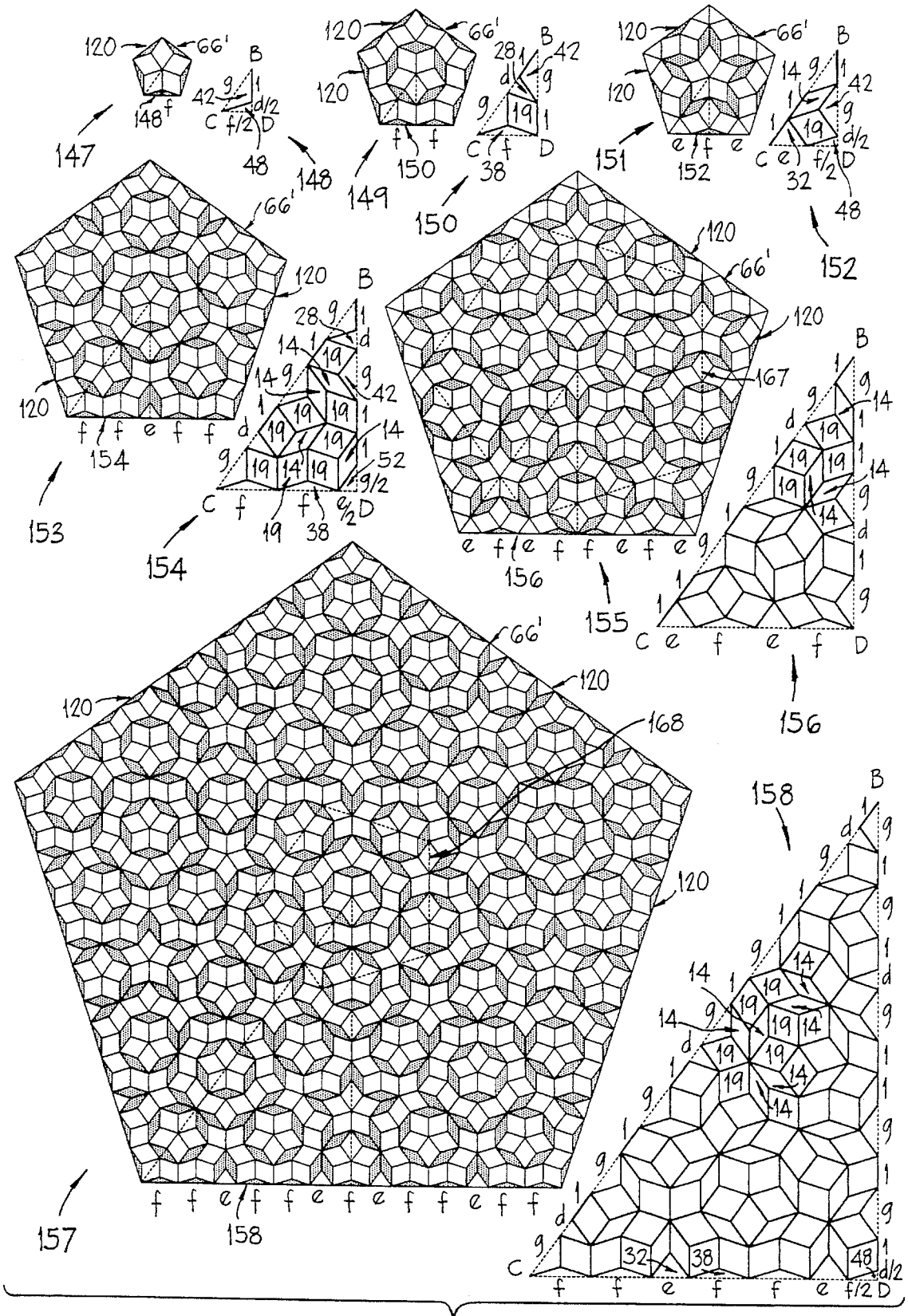
Figure 7E:
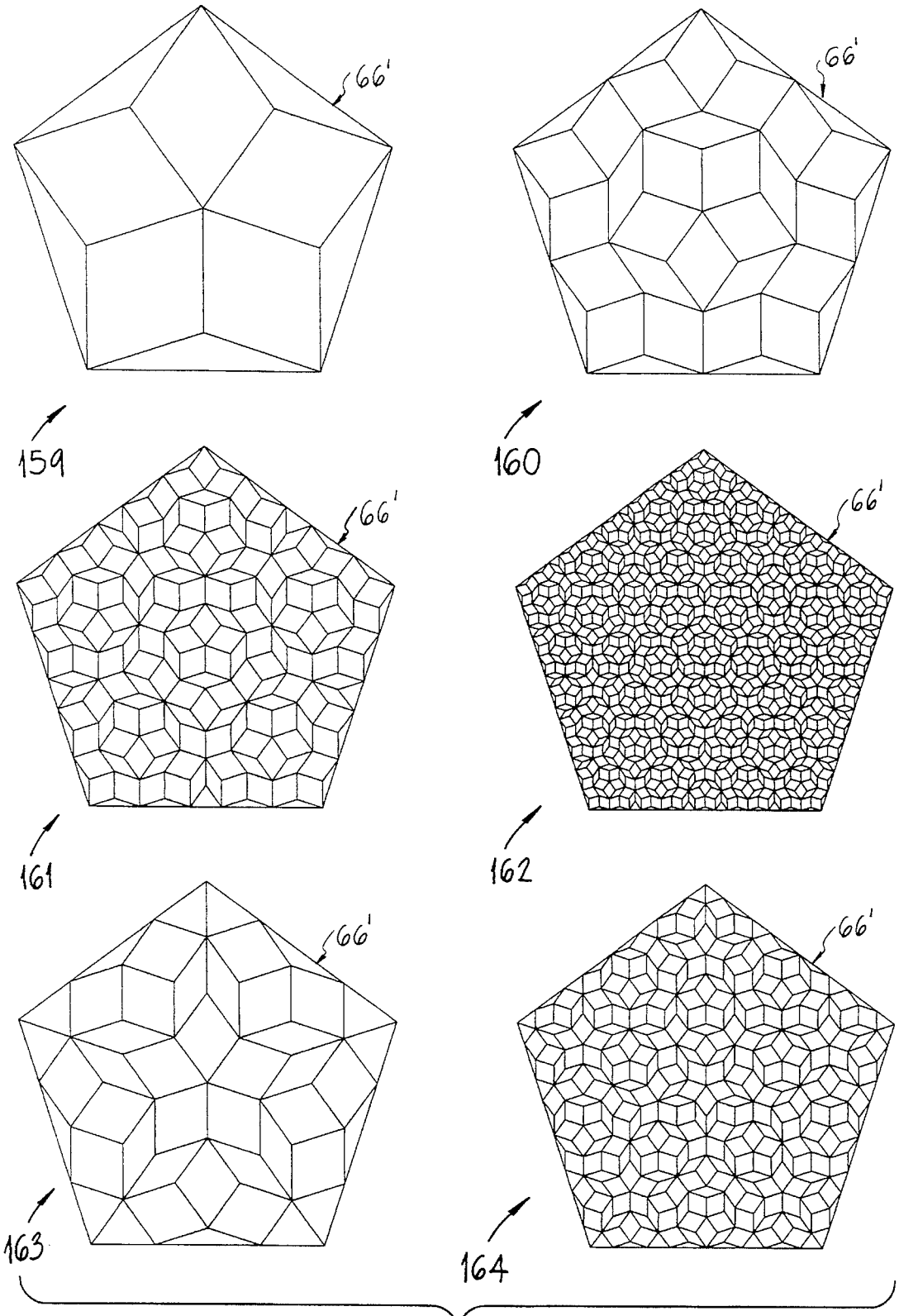
Figure 7F:
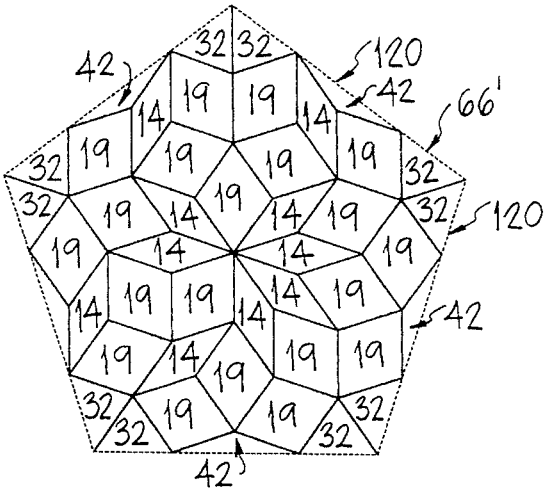
Figure 7F:
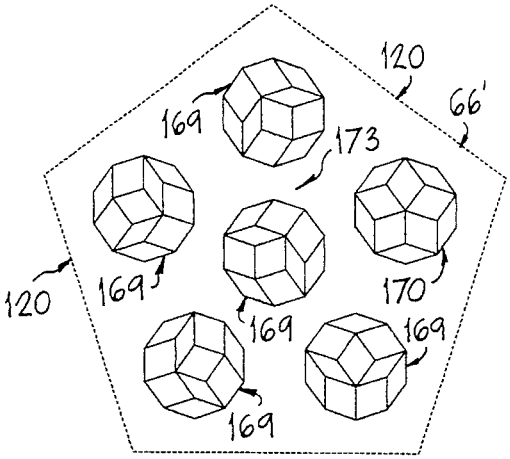
Figure 7F:
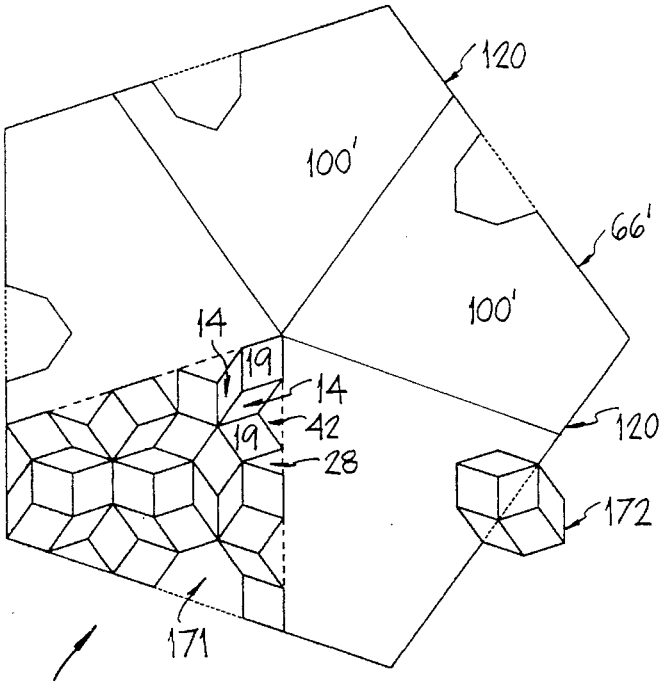
Figure 7F:
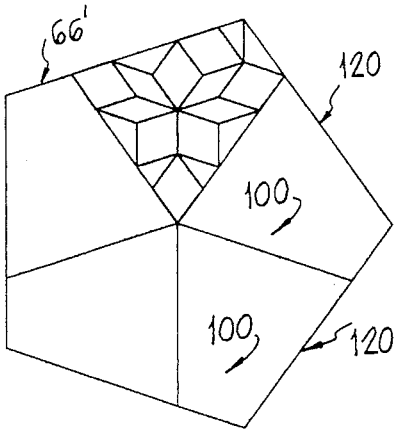

FIGS. 7*d–f* show subdivisions of pentagons 66' derived from decagons in FIG. 7*b*. A corresponding set of pentagons can be derived from the decagons in FIG. 7*c*. FIG. 7*d* shows the various pentagons bound by edges 120 and composed of fundamental regions 85 of Type I, and where the subdivisions of the fundamental regions are derived from the Penrose tilings in FIG. 7*b*.

The examples of subdivided pentagons 147, 149, 151, 153 156 and 157 shown here have fundamental region Type I shown alongside each. 147, 149, 153 and 157 are derived from the central regions of the subdivided decagons 140 as shown there with dotted lines, and 151 and 155 are derived from the central region of 139 as shown there. The lengths BD of the fundamental regions have the golden ratio in them.

The fundamental region 148 of 147 is composed of ¾ rhombii comprising one half-rhombus 42 and one quarter-rhombus 48. The length of its base CD equals f/2. The fundamental region 150 of 149 is composed of a total of three rhombii comprising one full rhombus 19, two half-rhombii 42, and one each of half-rhombus 28 and 38. The length of its base CD equals f. The fundamental region 154 of 153 is composed of twelve full rhombii, four half-rhombii and one quarter-rhombus as marked making a total of 49/4 rhombii. The base edge CD equals e/2+2f. The fundamental region 158 of 157 is composed of ninety full rhombii, twenty-one half-rhombii an one half-rhombus, making a total of 403/4 rhombii. The base edge CD equals 2e+9f/2. The edges of the four subdivided pentagons 147, 149, 153 and 157 equal f, 2f, e+4f, 4e+9f, respectively.

The fundamental region 152 of 151 is composed of a total of 15/4 rhombii comprising one each of the full rhombus 14 and 19, two half-rhombii 42, one half-rhombus 32 and one-quarter rhombus 48. The length of its base CD equals e+f/2. The fundamental region 156 of 155 is composed of twenty-six full rhombii and twelve half-rhombii, making a total of 32 rhombii. The length of the base CD equals 2e+2f. The lengths of the edges of the pentagons 151 and 155 equal 2e+f and 4e+4f, respectively.

FIG. 7*e* shows the six subdivided pentagons in 159–164 with the same subdivisions as the ones in FIG. 7*d*. The difference is that in FIG. 7*e* the edges of rhombii were kept fixed and the size of the subdivided pentagon increased, while here the size of the pentagon is kept fixed and the size of the rhombii shrink proportionally. There is a constructional advantage for each type. The former can be constructed out of equal lengths and equal polygons, providing an advantage of modular building system. The latter has a structural difference. The same distance or area can be spanned by a few large heavy members or many small light members. 159 corresponds to 147, 160 to 149, 161 to 153, 162 to 157, 163 to 151 and 164 to 155.

FIG. 7*f* shows miscellaneous examples of other types of subdivisions of the pentagon 66' bound by the edges 120. 165 shows a random reorganization of the rhombii in 151. The number of rhombii is the same in the two cases but 165 is completely asymmetric having lost the 5-fold symmetry present in 151. A similar technique can be applied to any subdivision obtained by rule-based or procedure-based methods. In 166, this method of rearragements of existing pieces is applied to the subdivision in 161. Only six decagons are show to illustrate the method. These decagons are present in the same location in 161 but are divided identically into rhombii and the five surrounding ones have the same orientation. In 166, one decagon 170 has the same subdivision as in the source pattern but is oriented differently. The five decagons marked 169 are subdivided identically but are in different orientation and the subdivision is different from 170. The remaining area 173 could retain the same pattern or be similarly rearranged here and there. This way the resulting subdivision will be completely asymmetric. Note that this method leaves the half-rhombii at the periphery untouched so as to enable matching of two adjacent pentagons in structures composed of several pentagons.

Figure 4D:
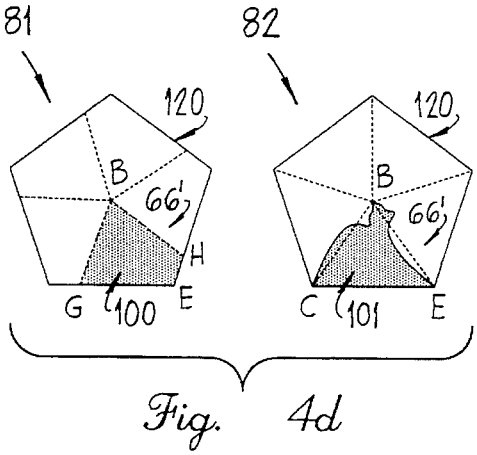

The subdivided pentagons in 167 and 168 have a rotational symmetry and their fundamental region corresponds to 100 in FIG. 4*d*. 167 is derived from the 155, 168 is derived from 157, and the two are shown in dotted lines in the source subdivisions. In 167, the area 171 can be filled with the unit 172, providing an advantage of joining one pentagon with another as described later. This advantage is absent in 168.

2.34 Subdivided Heptagons and Tetrakaidecagons (14-sided)

Figure 8A:
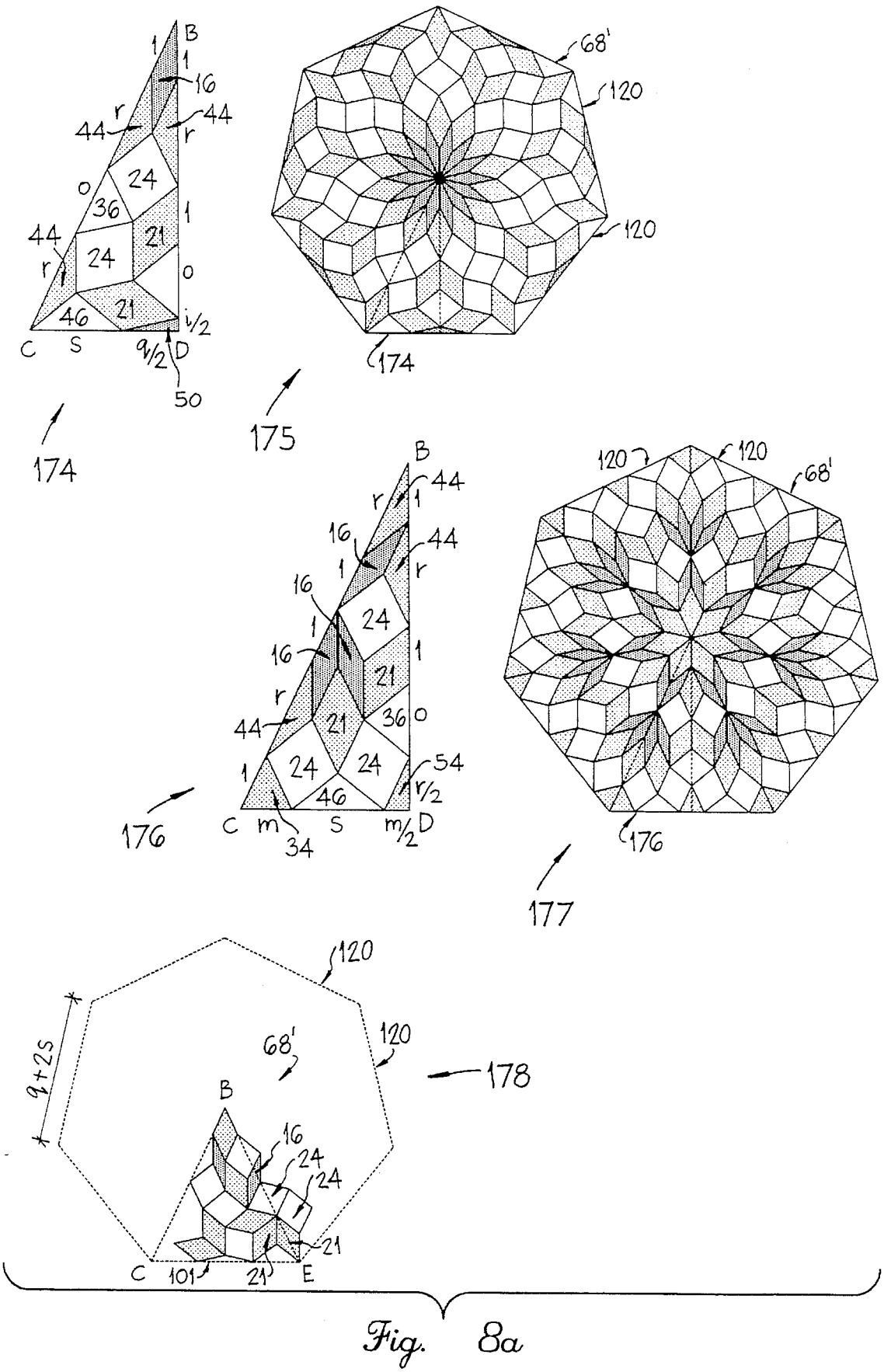
Figure 8B:
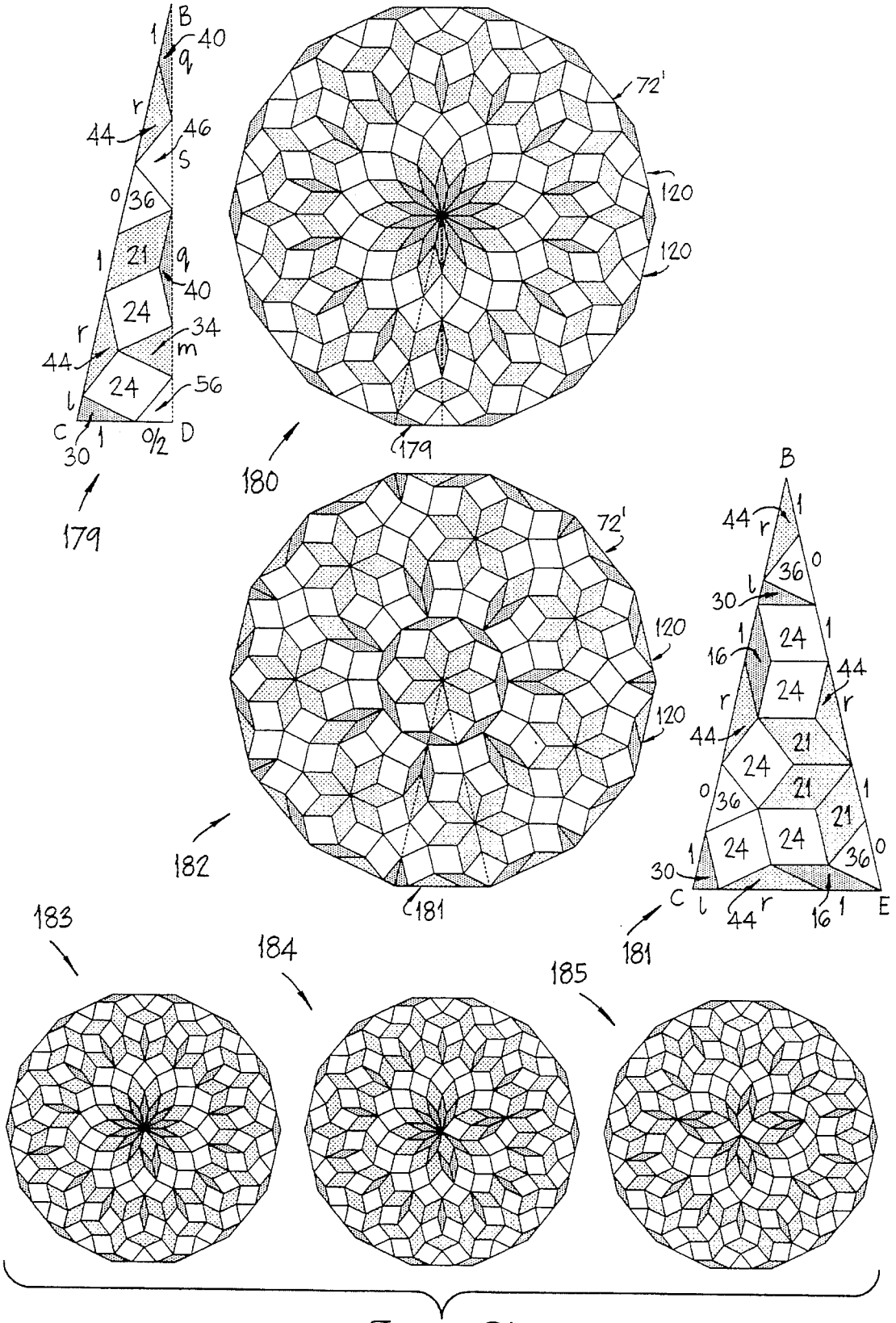

FIGS. 8*a* and 8*b* show subdivisions of 7-sided and 14-sided polygons using rhombii 16, 21 and 24, half-rhombii 30,34, 36, 40, 44 and 46, and quarter-rhombii 50, 54 and 56, all obtained from the n=7 case in FIGS. 1 and 2. In FIG. 8*a*, the subdivided fundamental region 174 corresponds to 87 (in illustration 68 of FIG. 4*a*) and is composed of five full rhombii, six half-rhombii and one quarter-rhombus, making a total of 33/4 rhombii. The length of its base equals s+q/2 and it generates the heptagon 175. The subdivided fundamental region 176 is composed of eight full rhombii, six half-rhombii and one quarter-rhombus, making a total of 45/4 rhombii. The base CD equals s+3m/2, and it generates the heptagon 177. 178 shows the fundamental region 101 in FIG. 4*d*. The side of the heptagon equals q+2s.

In FIG. 8*b*, the subdivided fundamental region 179 corresponds to the region 91 in FIG. 4*a*. It is composed of three full rhombii, eight half-rhombii and one quarter-rhombus as marked, making a total of 29/4 rhombii. Its base CD equals 1+o/2, and it generates the 14-sided polygon 180. The subdivided fundamental region 181 corresponds to the region Type II for p=14. It is composed of ten full rhombii and nine half-rhombii, making a total of 29/2 rhombii. Its base CE equals 1+l+r, and it generates the 14-sided polygon in 182. Subdivided 14-sided polygons 183–185 are three stages in the transformation of 180 by successive "flipping" of rhombii with selected zonogons. In 183, two such flips of rhombi have taken place at two different places, one within a hexagon at the center and the other within an 8-sided zonogon towards the left. In 184, an 8-sided zonogon at the center (on the right) has been flipped, and in 185 another such zonogon has been flipped. The resulting polygon has no symmetry.

3. Curved Polygons and Planar Arrays of Curved Polygons

All subdivided polygons described in Section 2 can be converted into curved structures by curving the surface of the polygon. There are numerous possibilities. The polygons could be rolled up into cylinders or parts of cylinders, the polygons could be projected onto any symmetric or asymmetric curved surface, any surface of revolution obtained by revolving a convex, concave or arbitrary curve, any quadric or super-quadric surface, any surface of translation obtained by translating any curve over any other curve, any minimal surface or saddle shape, and any irregular or arbitrary surface. The curved polygons could be portions of a sphere, ellipsoid, cone, conoid, ovoid, catenoid, hyperbolic paraboloid, hyperboloid, paraboloid, pseudo-sphere, or any other singly-curved or doubly-curved surface. The edges of the curved polygons could be straight, convex, concave, bent, or irregular, or in any combination. The surfaces could be shells, curved space frames, tensile nets, membranes or fluid-supported structures.

3.1 Curved Polygons

Figure 9:
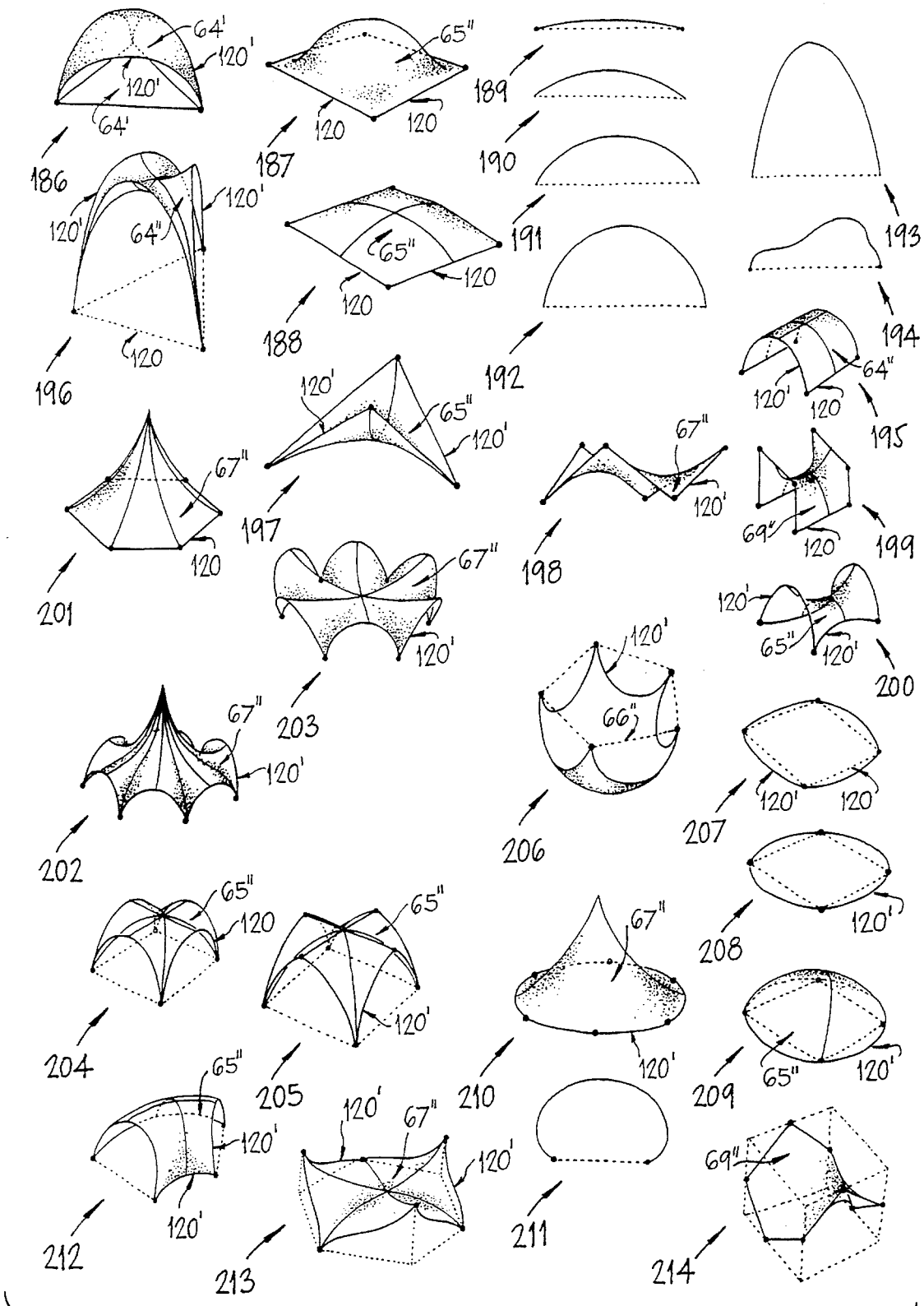

FIG. 9 shows various possibilities of curved polygons. The curved polygons are identified with their planar counterparts in FIG. 4*a* by a suffix ", e.g. 65" is a curved variant of the plane square 65', and so on for other polygons. 186 is a curved triangle with its three sides 120' (curved edges) as upright circular arches and the curved triangular surface 64" as part of a sphere. 187 and 187 are curved square surfaces 65" which are "inflated", as air-supported structure, and have their edges 120 untransformed. 189–192 show various sections through a sphere or a cylindrical vault, and 93 shows a parabolic profile and 194 is an irregular profile. These could be alternative sections through surfaces like 187 and 188. 195 is a square rolled into a half-cylindrical barrel vault. 196–200 show various saddle polygons. 196 is a three-sided saddle triangle 64" spanned between three parabolic arches, 197 is a four-sided saddle 65" with zig-zag edges, 198 is a six-sided saddle 67" with zig-zag edges, 199 is a saddle octagon 69", 200 is a four-sided hyperbolic paraboloid surface 65".

201–203 are various curved hexagons 67". 201 is a tent-shaped hexagon, 202 is bound by curved arches and six intersecting doubly-curved units, and 203 is an intersection of three inter-penetrating hyperbolic paraboloids. 204 and 205 are four-sided intersecting vaults 65", with 204 having a circular section and 205 having a pointed Gothic arch section. 206 is a hanging pentagon 66". 207 and 208 are two stages in the transformations of a plane square to a plane surface with four circular sides. In 209, this surface is inflated to make a shallow domical surface 65". 210 is a pseudo-sphere 67' with six points on the base plane. 211 is a profile of a drop-shaped section. 212 is a bent half-cylinder with four sides, two upright arches and two concentric curves on the base plane. 213 is a six-sided tensile surface 67" with tensile edges 120' as a variant of the saddle 198. 214 is a saddle octagon 69" inscribed in a cube by joining the mid-points of eight edges of the cube.

These examples are representative and other examples can be worked out. The curved polygons can be repeated in periodic or non-periodic arrays to provide structures that enclose larger areas for various architectural uses.

3.2 Curved Polygons with Subdivided Surfaces

Figure 10A:
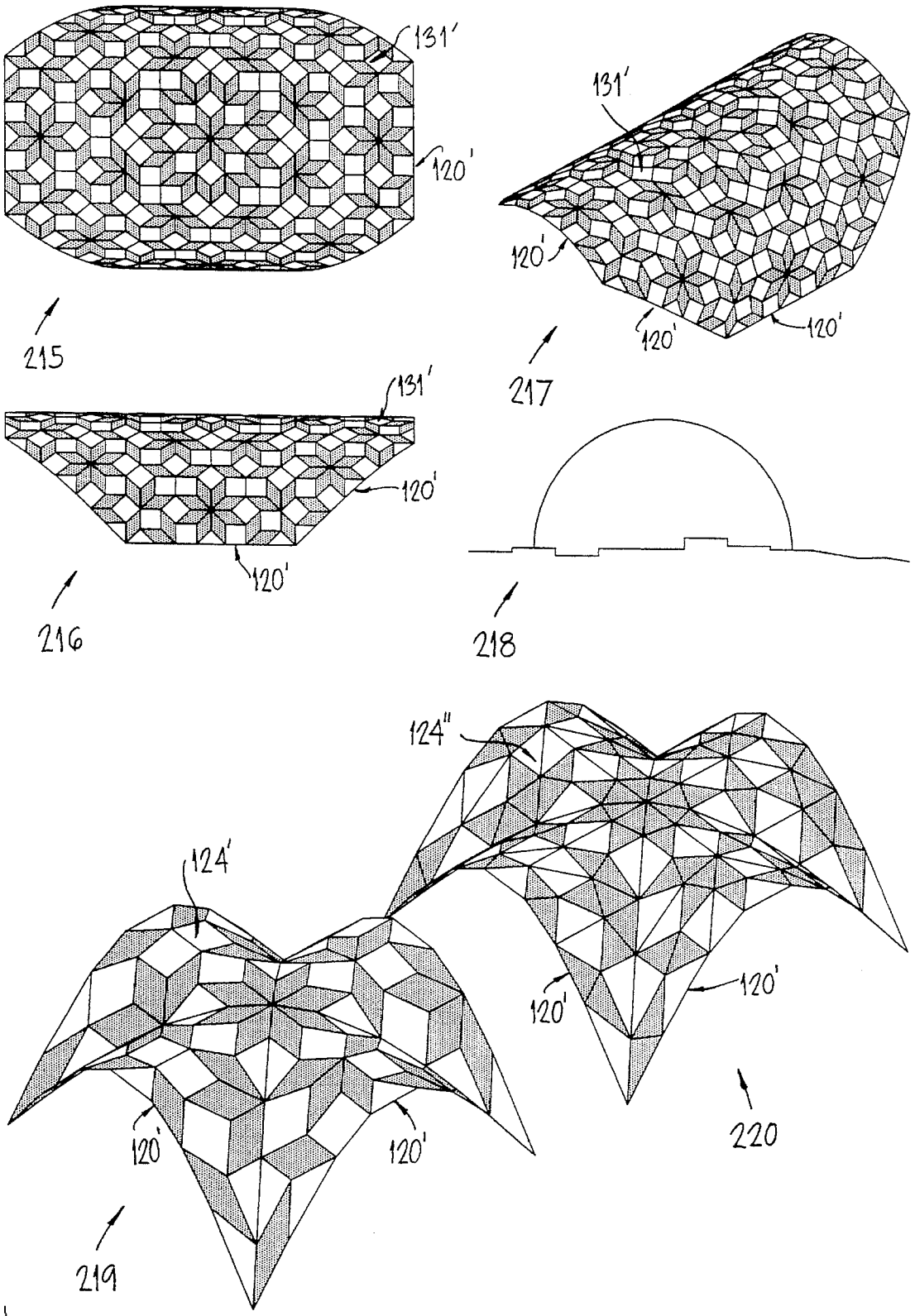
Figure 10B:
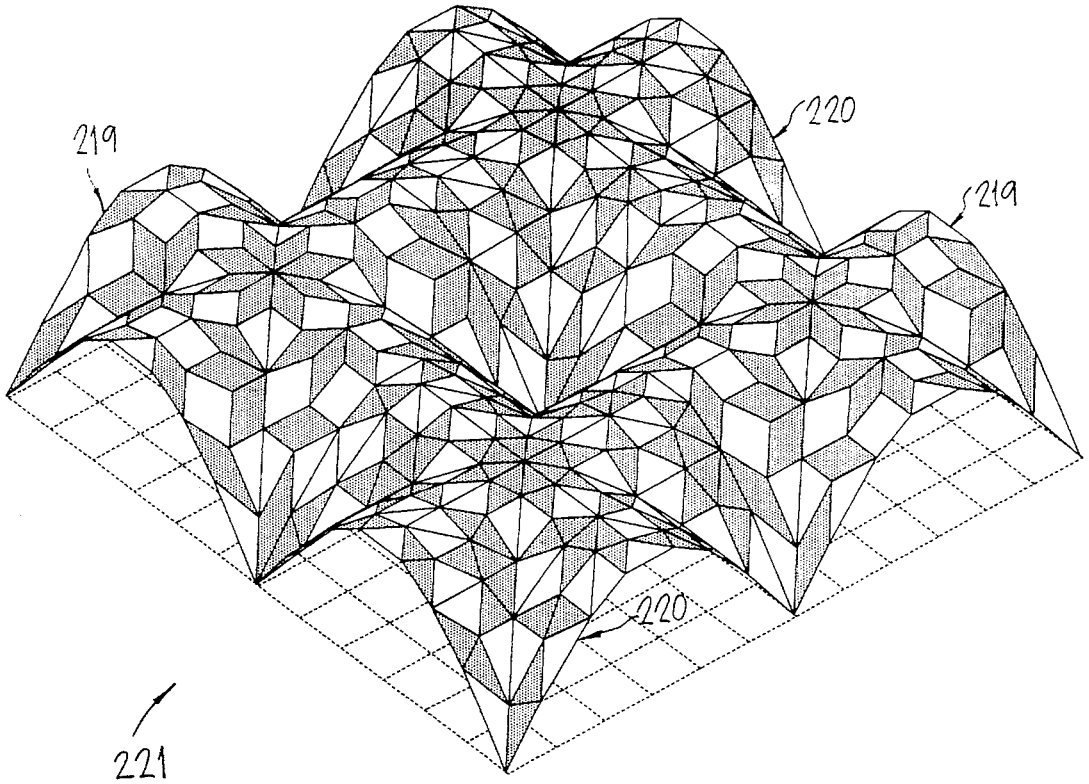
Figure 10B:
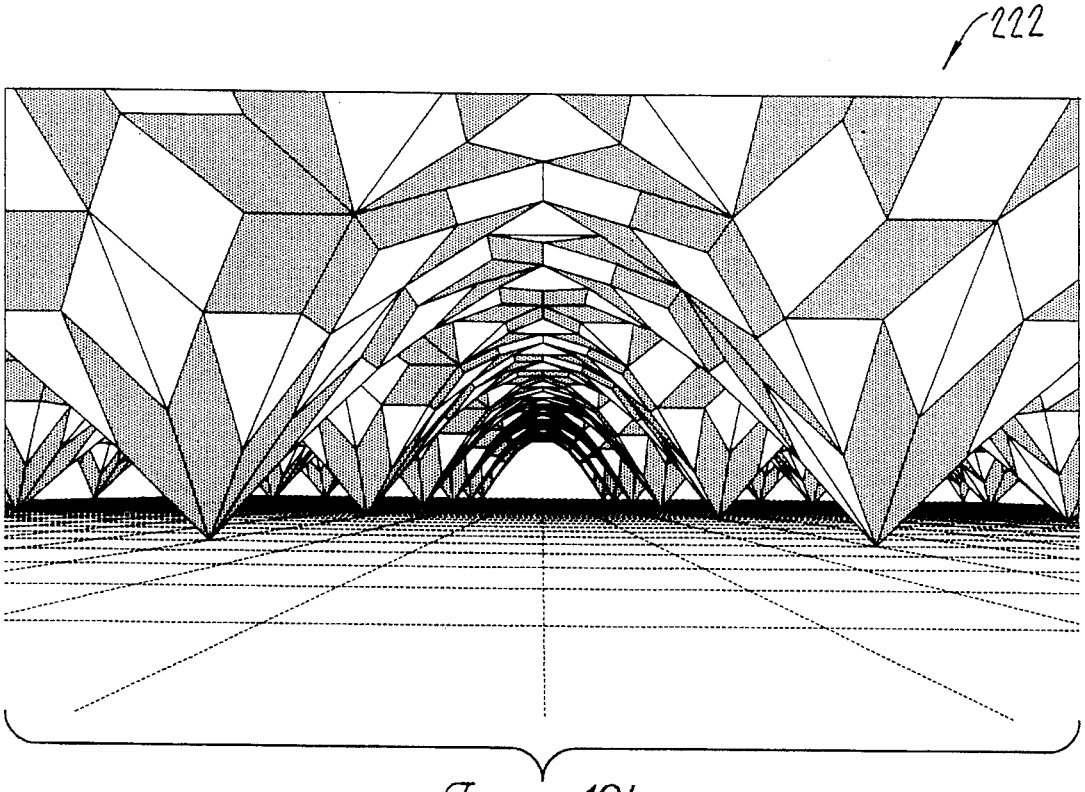

Various examples of curved polygons with subdivided surfaces are shown in FIGS. 10–12. These examples are obtained by curving the subdivided plane polygons shown earlier in FIGS. 5–8 in various ways.

3.21 Singly-curved Structures

Singly-curved structures have a curvature in one direction only. This includes vaults with a variety of profiles. The common examples are cylinders and cones, or portions of either. The general case is where any curved profile is translated over a straight line. For example, in FIG. 9, the curved profiles 189–194 or 211 can be used as the generating curves. Two examples are shown in FIGS. 10*a* and 10*b* and correspond to the examples 189–193, 195, 204 and 205 of FIG. 9.

In FIG. 10*a*, 215–218 show the plan view, side view, an isometric view and a section through a cylindrical vault. The subdivided octagon 131 (p=8) in FIG. 6*c* is rolled into a half-cylinder 131'. Two of the eight edges 120 remain straight, and the remaining six edges are converted into curved edges 120', 219 is a curved version of the subdivided square 124 (p=4) in FIG. 6*b*. Here its is converted into the curved surface 124', a cross vault. The curved edges 120' are funicular polygons. 220 is a triangulated version of 219 composed of the curved surface 124". The triangulation is obtained by introducing the diagonals in each rhombus and the process is effectively the same as using half-rhombii of FIG. 2. In 220, the groins of the cross vault are visible along the diagonal curved lines. In FIG. 10*b*, the cross-vault is repeated to produce a periodic array of vaults. 221 shows four such cross-vaults, two of 219 and two of the triangulated version 220. 222 is a interior perspective view of 221.

3.22 Doubly-curved Structures

Doubly-curved structures have curvature in two directions. Here there are two types, synclastic and anti-clastic curved structures. In synclastic structures, the two curvatures are in the same direction, and in anti-clastic structures the two curvatures are in the opposite directions. Domes are examples of the first type and saddles are examples of the second type. Examples of subdivided curved polygons are shown for both.

3.223 Synclastic Surfaces

Figure 11A:
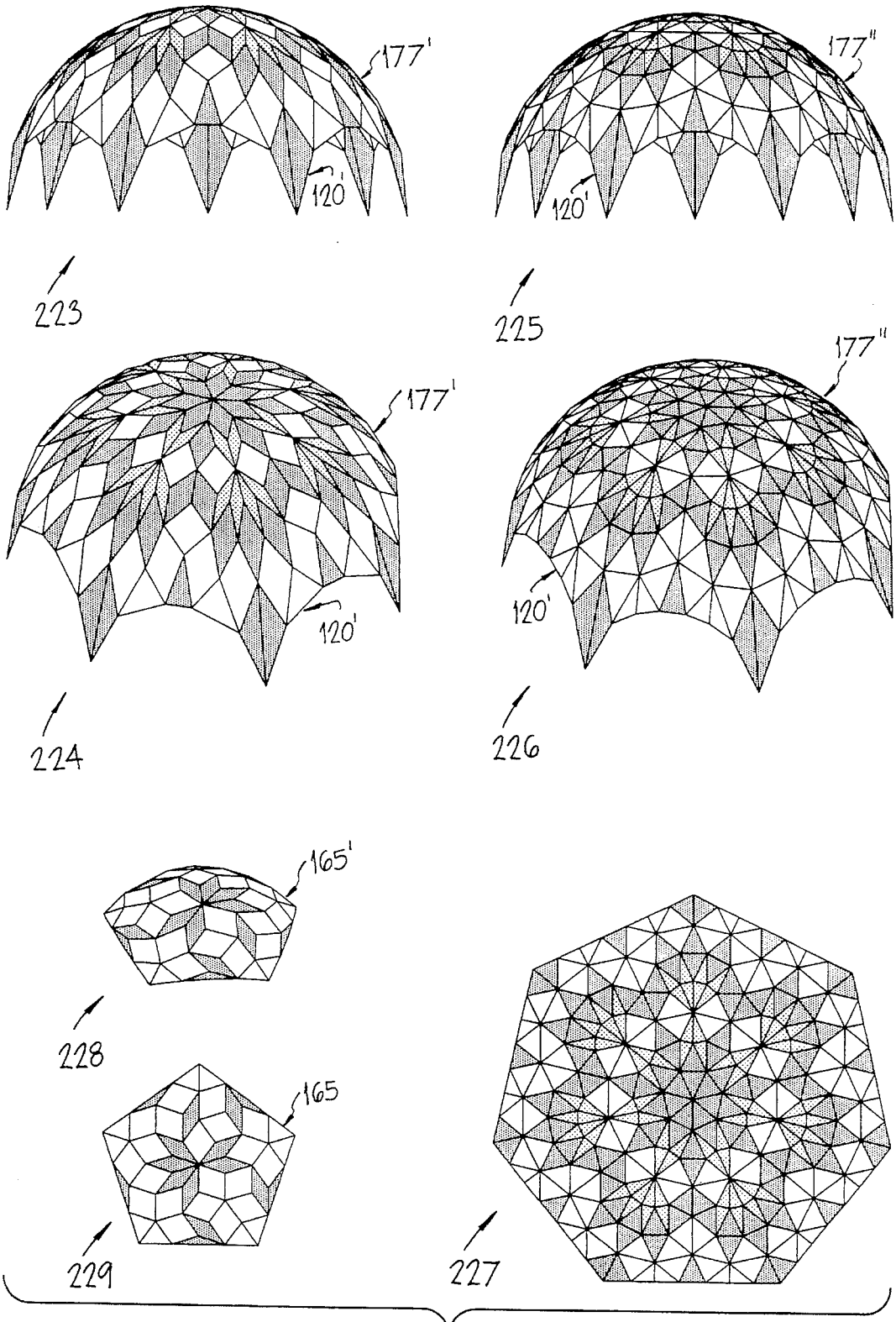

FIG. 11*a* shows two different examples of domes, one based on the subdivided heptagon 177 of FIG. 8*a* and the other based on the subdivided pentagon 165 of FIG. 7*f* and bound by curved edges 120'. 223 and 224 are the elevation and isometric views of the curved surface 117' obtained by projecting 177 on to a sphere. 225 and 226 are corresponding triangulated versions seen in a plan view in 227. The 7-fold symmetry is retained in this example. To obtain a smooth surface, the shorter diagonal on the surface is added in the triangulated case. 228 and 229 are an example of a projection of 165 onto a shallow sphere or sphere-like dome. The dome 228 has an asymmetric subdivision. These two examples correspond to the structures 189–193, 206 and 211 in FIG. 9.

Figure 11B:
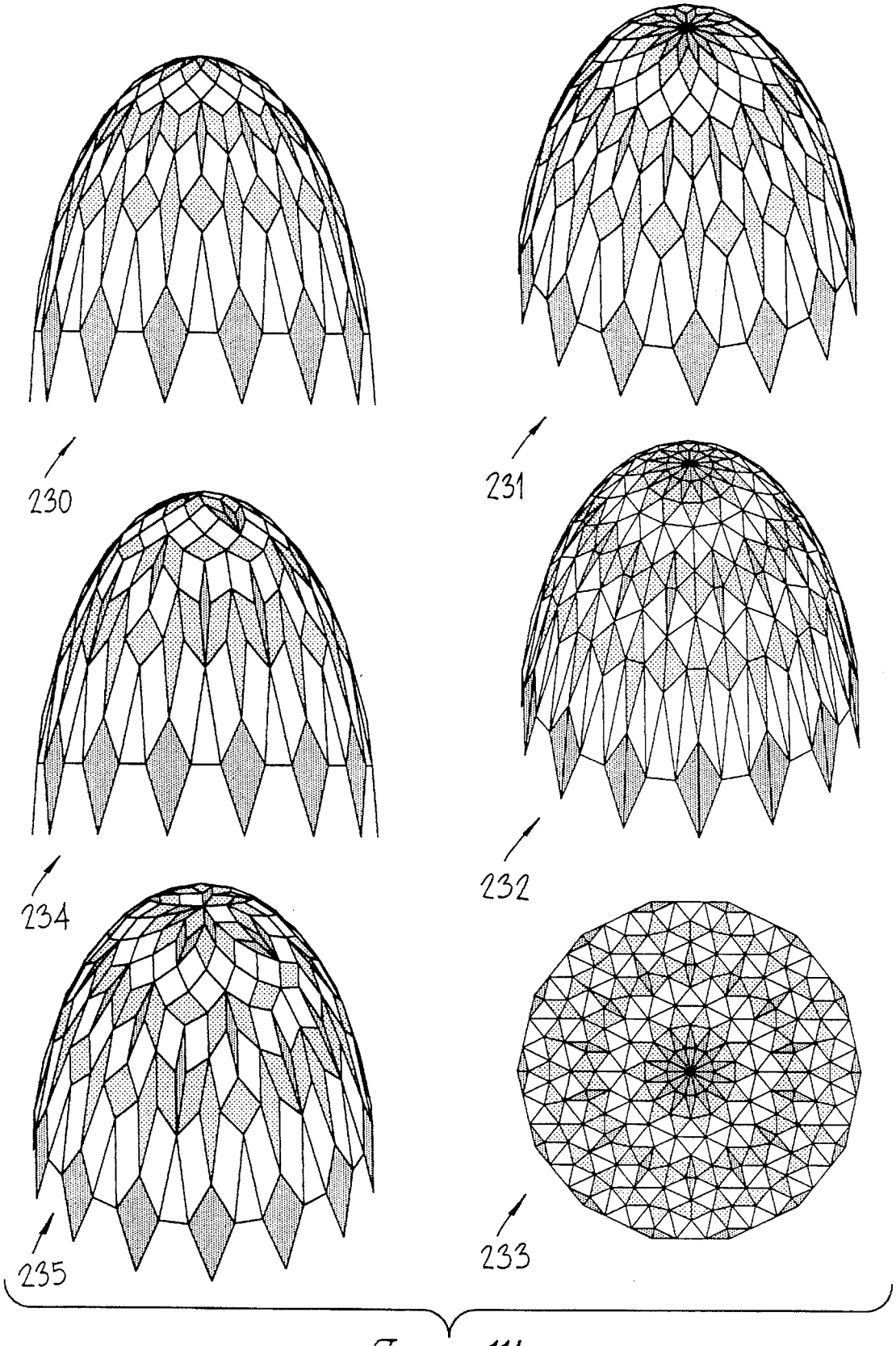

FIG. 11*b* shows two more examples of ellipsoidal domes, both based on the 14-sided polygons in FIG. 8*b*. 230 and 231 show elevation and an isometric view of the projection of the plan 180 of FIG. 8*b* on to an ellipsoidal surface. 232 is a triangulated version shown with its plan 233. 234 and 235 are projections of the plan 185 of FIG. 8*b*. This dome is an asymmetric variant of the symmetric dome shown here (compare 231 with 235) and can be derived in the same manner in which the asymmetric plan 185 was derived from the symmetric plan 180.

Figure 11C:
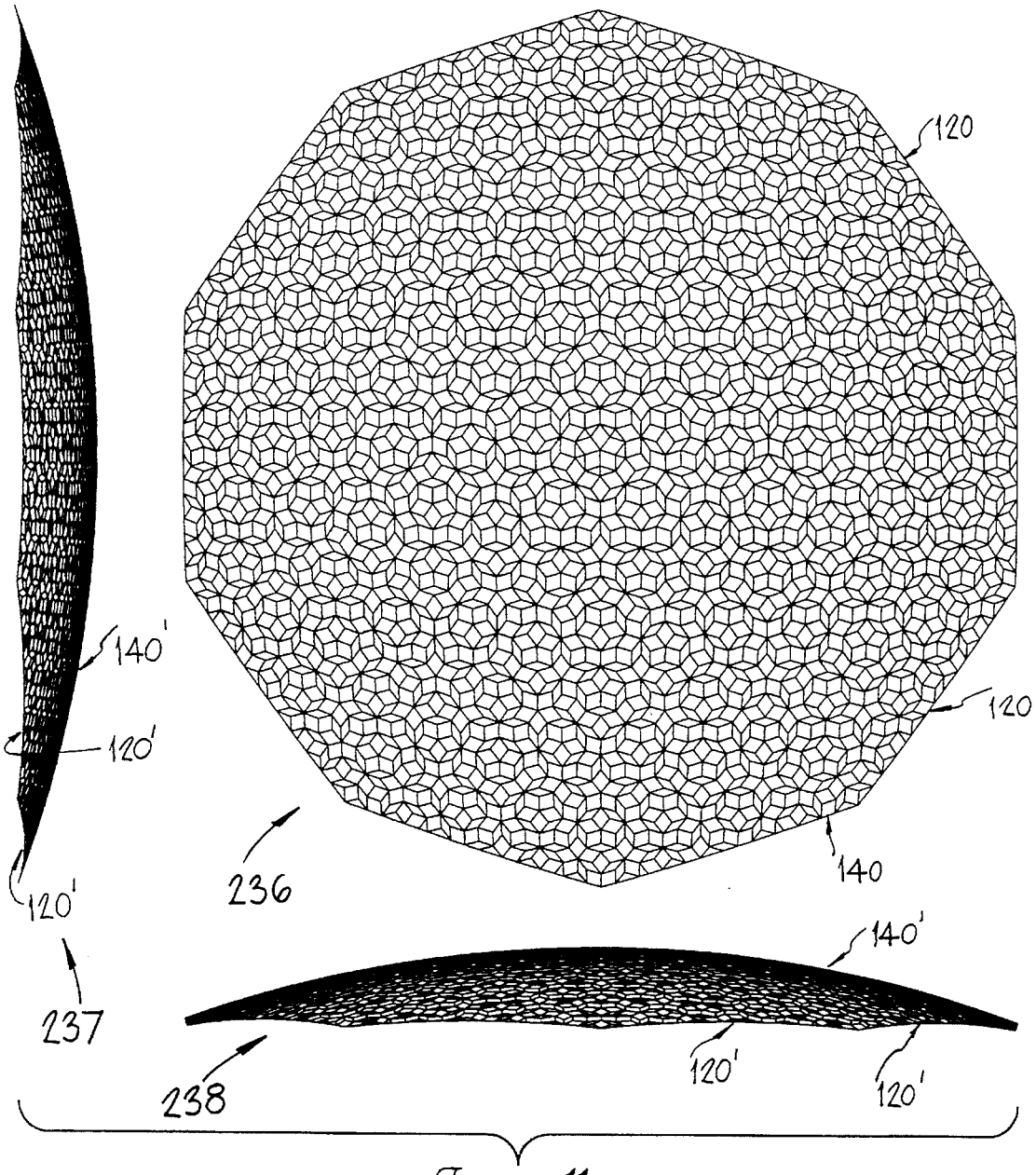
Figure 11D:
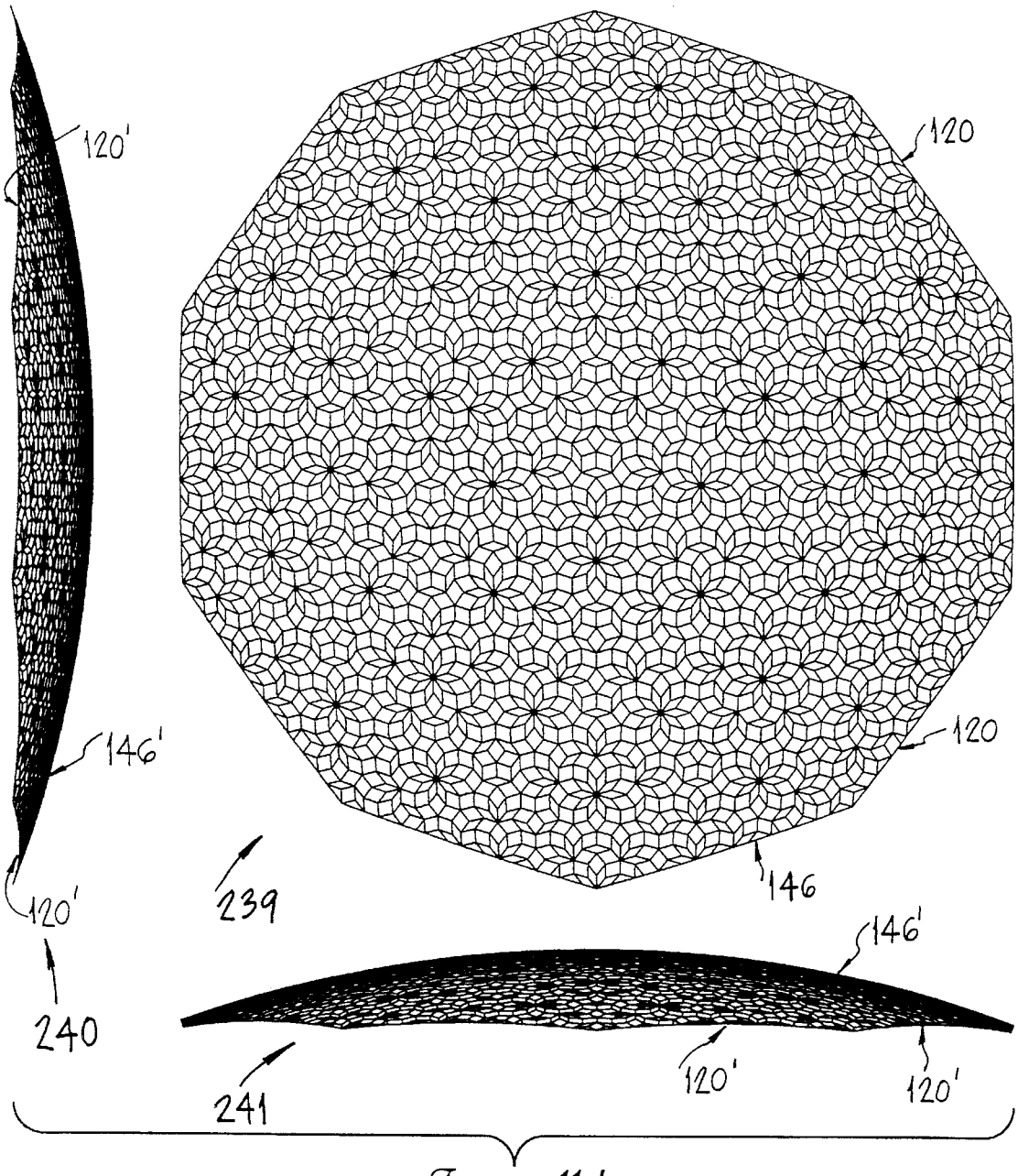
Figure 11E:
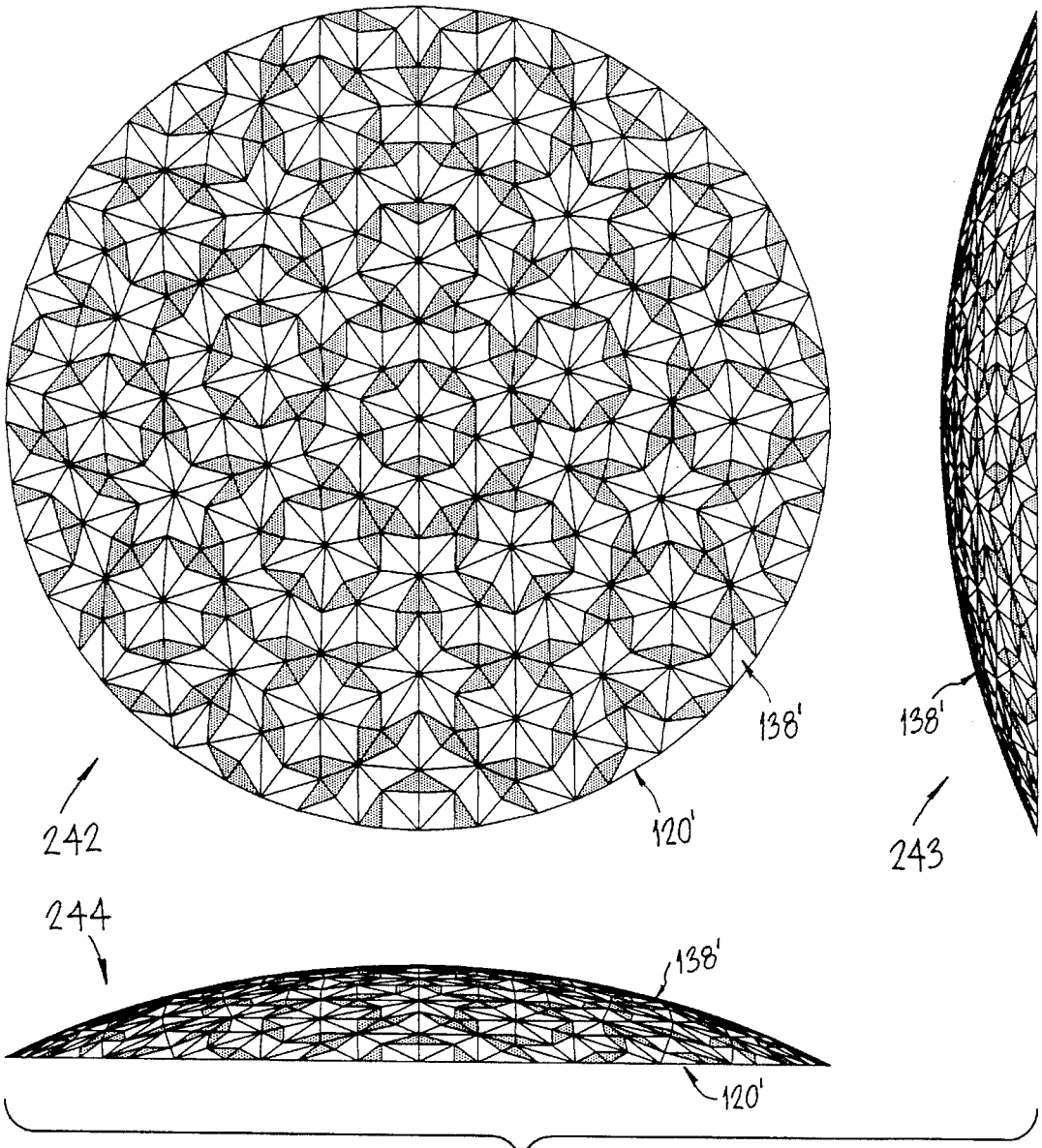

FIG. 11*c* shows a shallow dome obtained by "inflating" the plane decagon 140 of FIG. 7*b* such that the edges 120' are scalloped. The curved surface 140' is seen in the two side views, and the plan view 140 is the same as before. FIG. 11*d* is a similar example obtained from the plane decagon 146 of FIG. 7*c*. The two examples could be curved according to sections 189–194 or 211 in FIG. 9. FIG. 11*e* is another shallow dome obtained from the decagon 138 of FIG. 7*b*. Here the curved surface 138' is not only "inflated" in sections 243 and 244 but also in plan 242. In the plan view, the concentric edges lie on concentric circles, as in a radial grid. This structure corresponds to the illustrations 207–209 in FIG. 9.

3.224 Anticlastic Surfaces

Figure 12A:
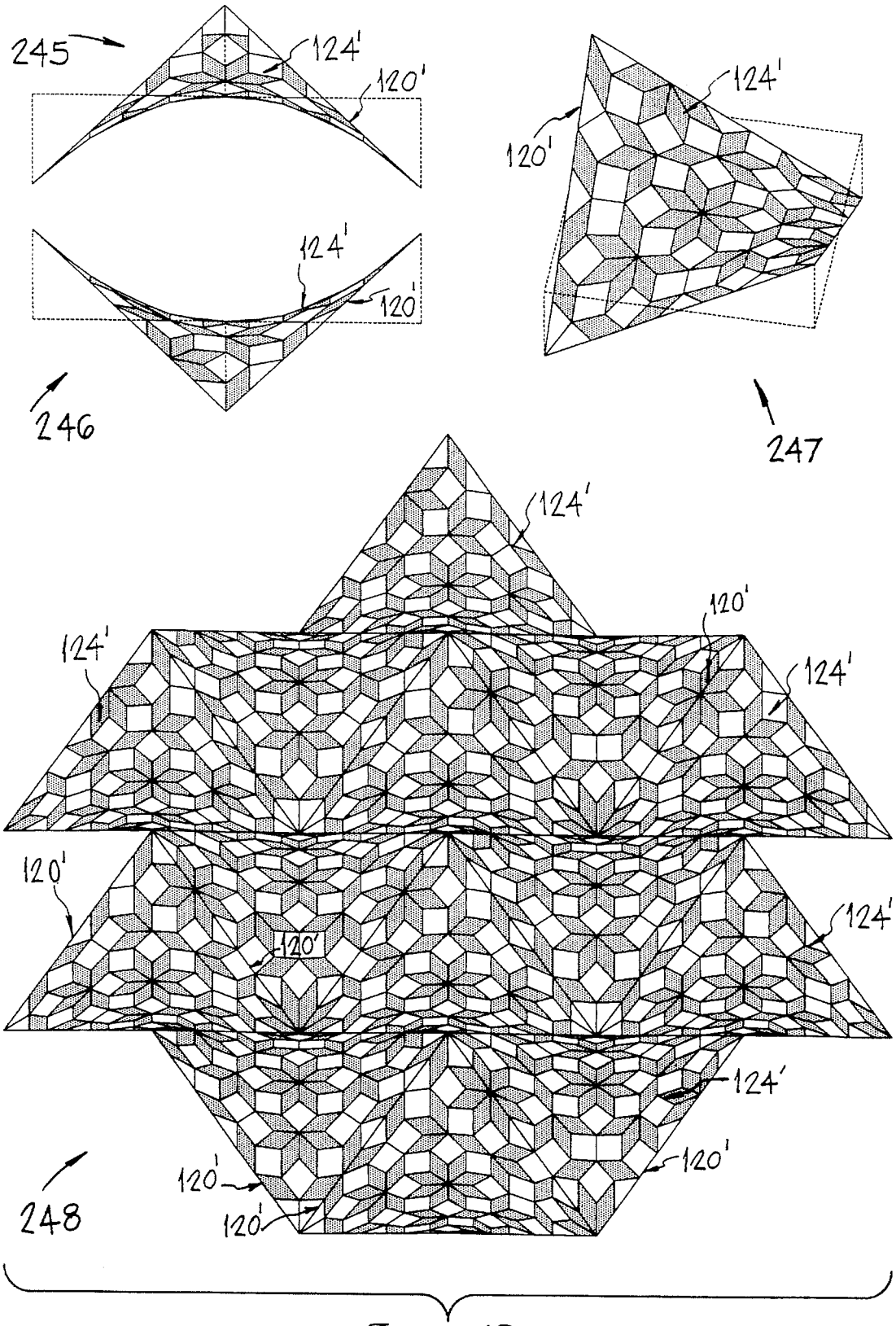

FIG. 12*a* shows a four-sided saddle surface 124' obtained by curving the subdivided square 124 of FIG. 6*b* 245 and 246 are the two different elevation views and 247 is an isometric vies of the saddle 124'. It is obtained from the source square by raising two opposite corners and lowering the other two opposite corners. 248 shows a periodic array of saddles 124'. The mirror-symmetry of the source square along one diagonal line is retained in the saddle.

Figure 12B:
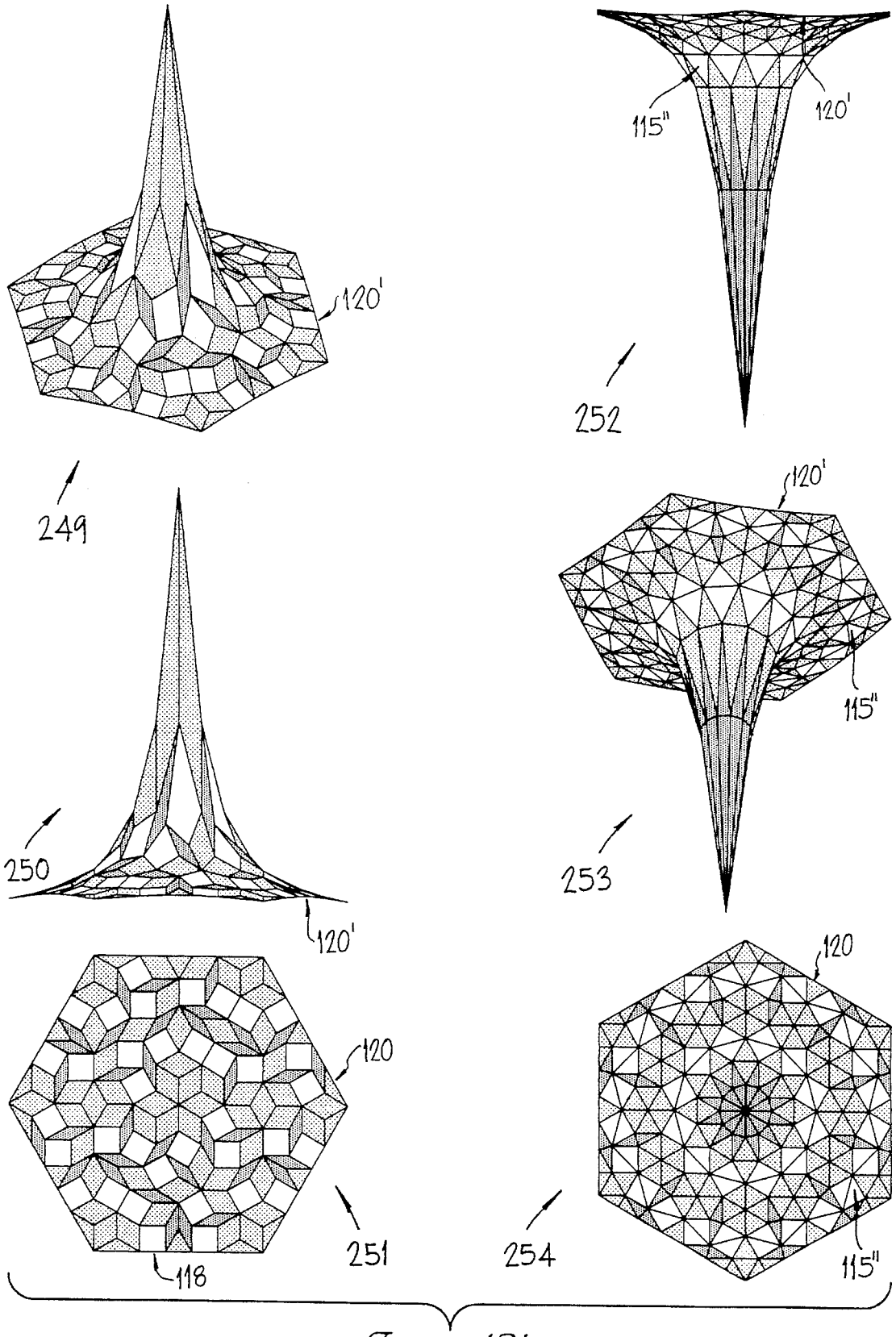
Figure 12C:
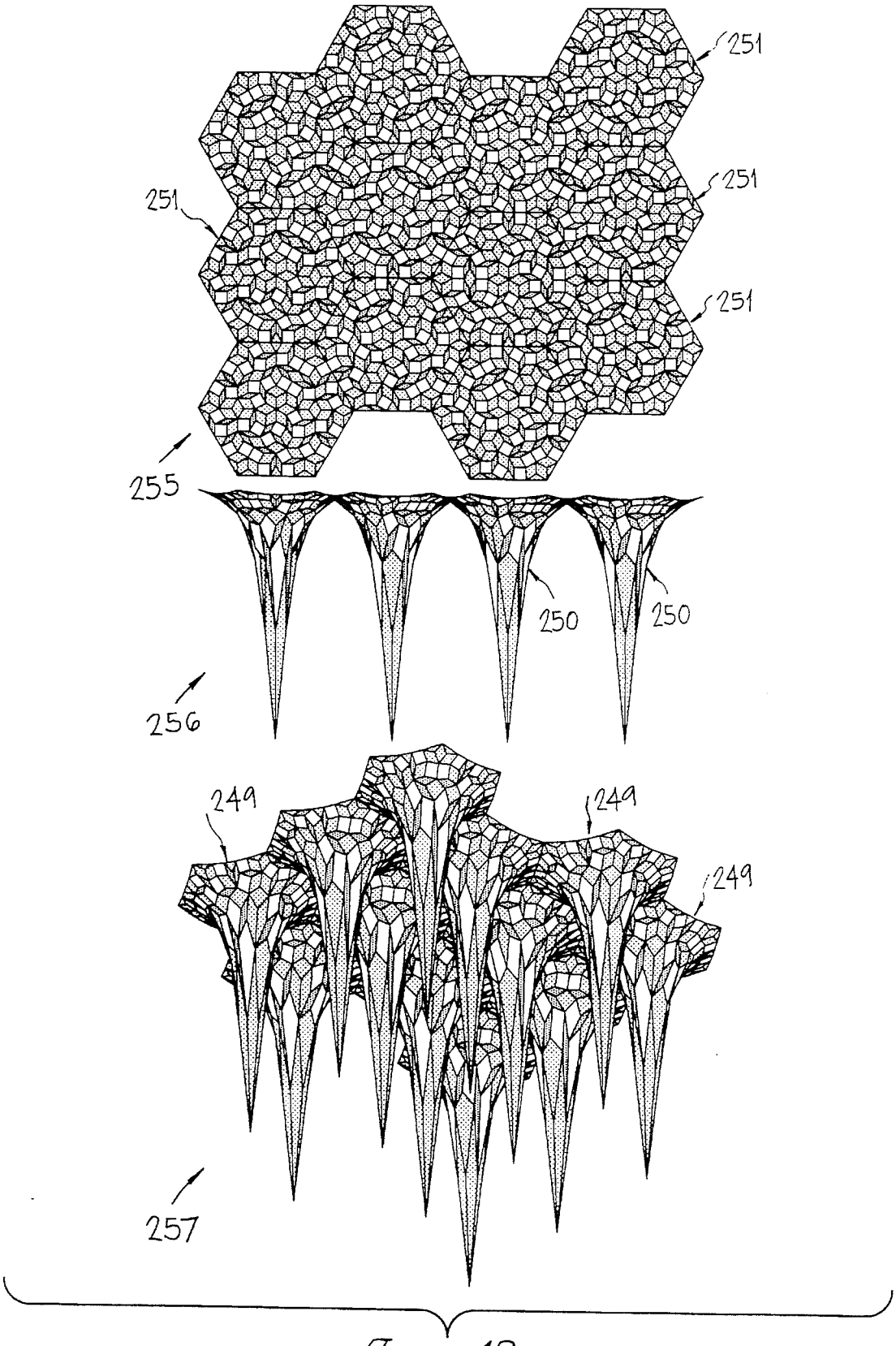

FIG. 12*b* shows two examples of faceted versions of a pseudo-sphere with scalloped edges. These two examples correspond to the illustrations 201, 202 and 210 of FIG. 9. 249–251 shows the isometric view, the elevation and the plan of the first example, and 252–254 show the elevation, isometric view and plan of the second example which is an upside-down version of the first. The plan 251 is asymmetric and is composed of six asymmetric triangles 118 of FIG. 5*b* fitted together in a random manner. The plan 254 is a triangulated version of the subdivided hexagon 115 of FIG. 5*b*. FIG. 12*c* shows an array of structures corresponding to 249–251 of FIG. 12*b* and shown in plan view 255, elevation view 256 and an isometric view from below. In the plan view, the hexagons 251 are rotated randomly to produce a non-periodic design.

4. Cylinders and Torii

Portions of subdivision patterns shown and others obtained from the various rhombii of FIG. 1 can be mapped onto cylinders which can then be transformed to torii. Three different examples are shown in FIGS. 13*a–d*.

Figure 13A:
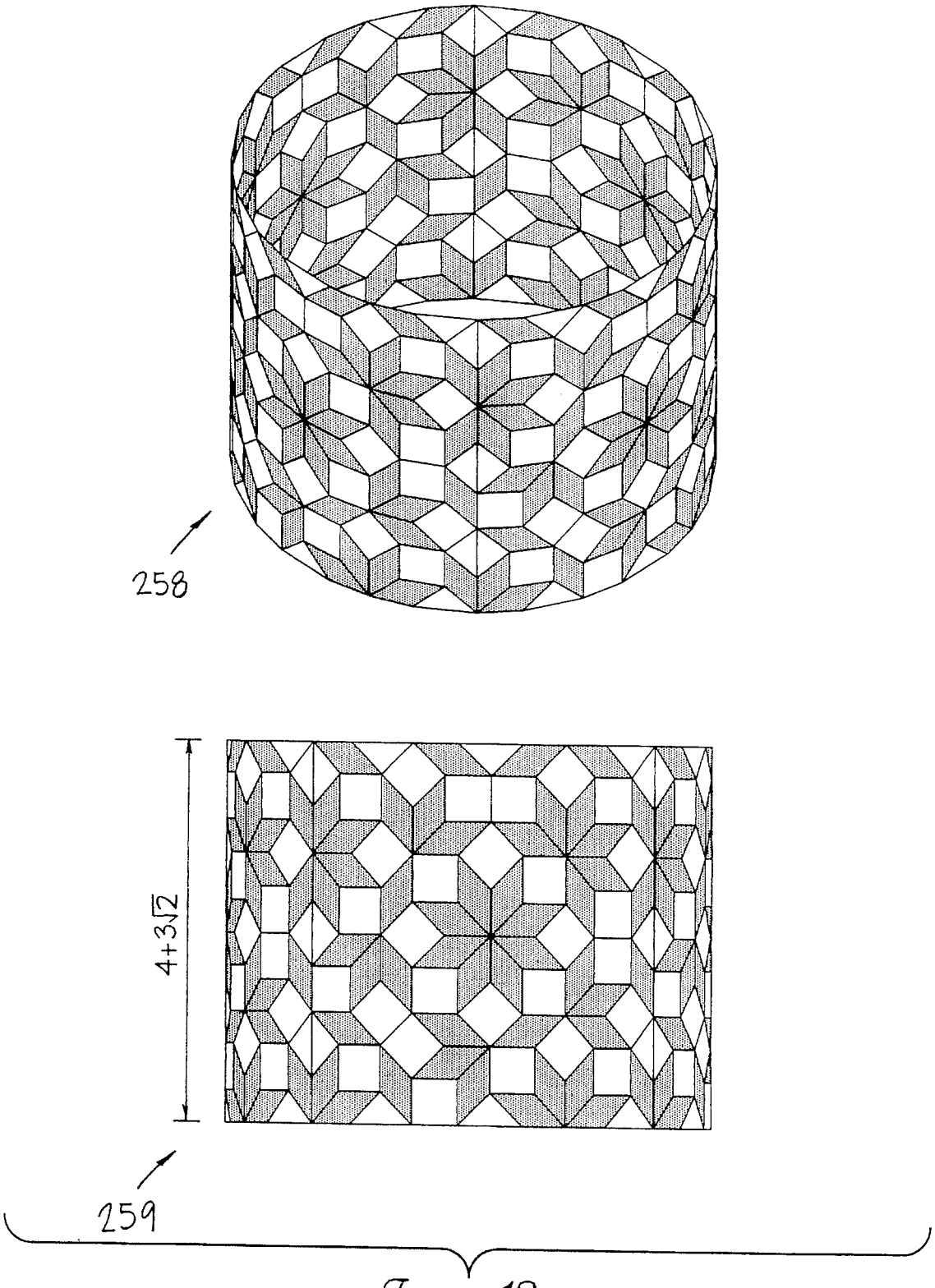
Figure 13B:
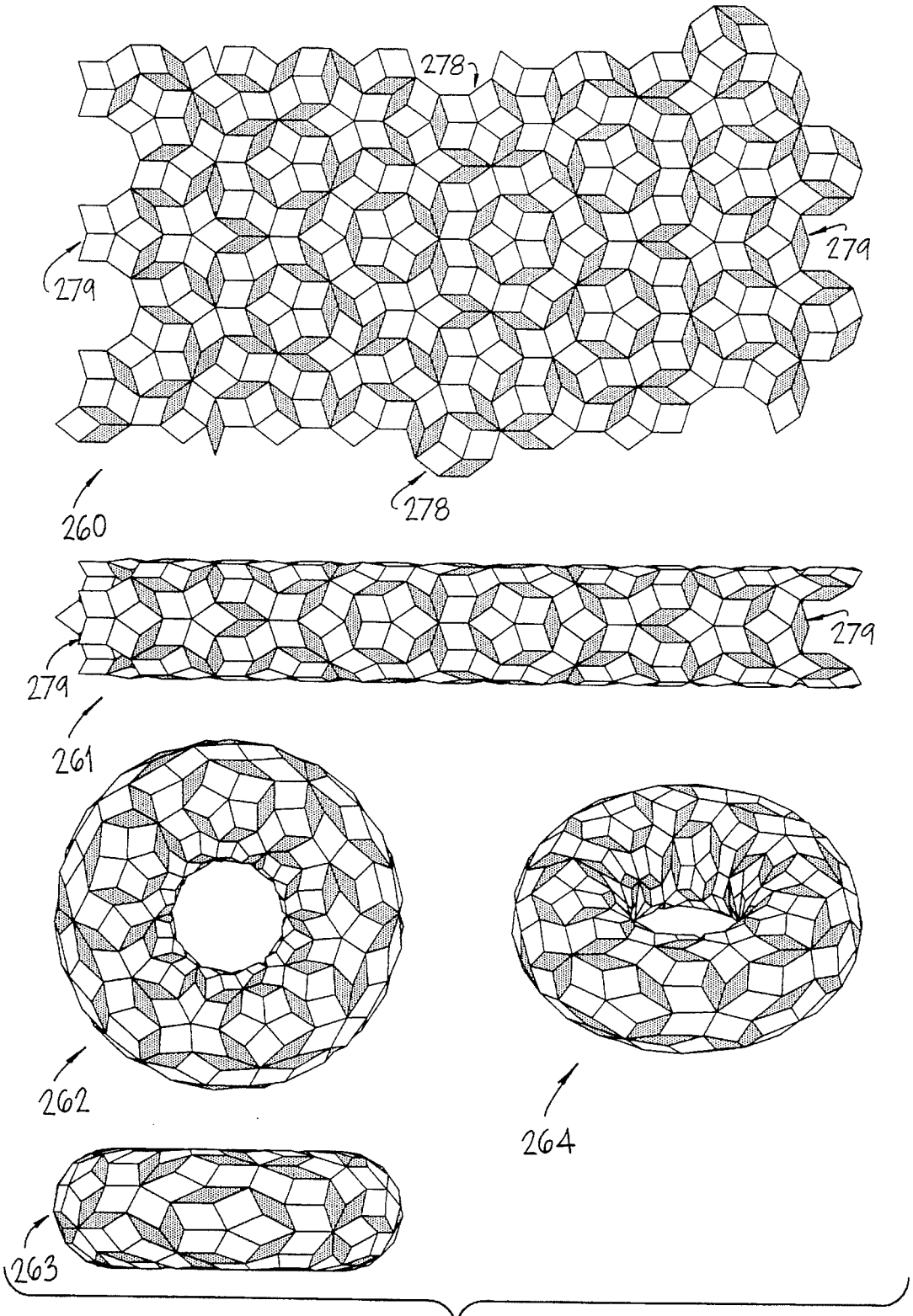
Figure 13C:
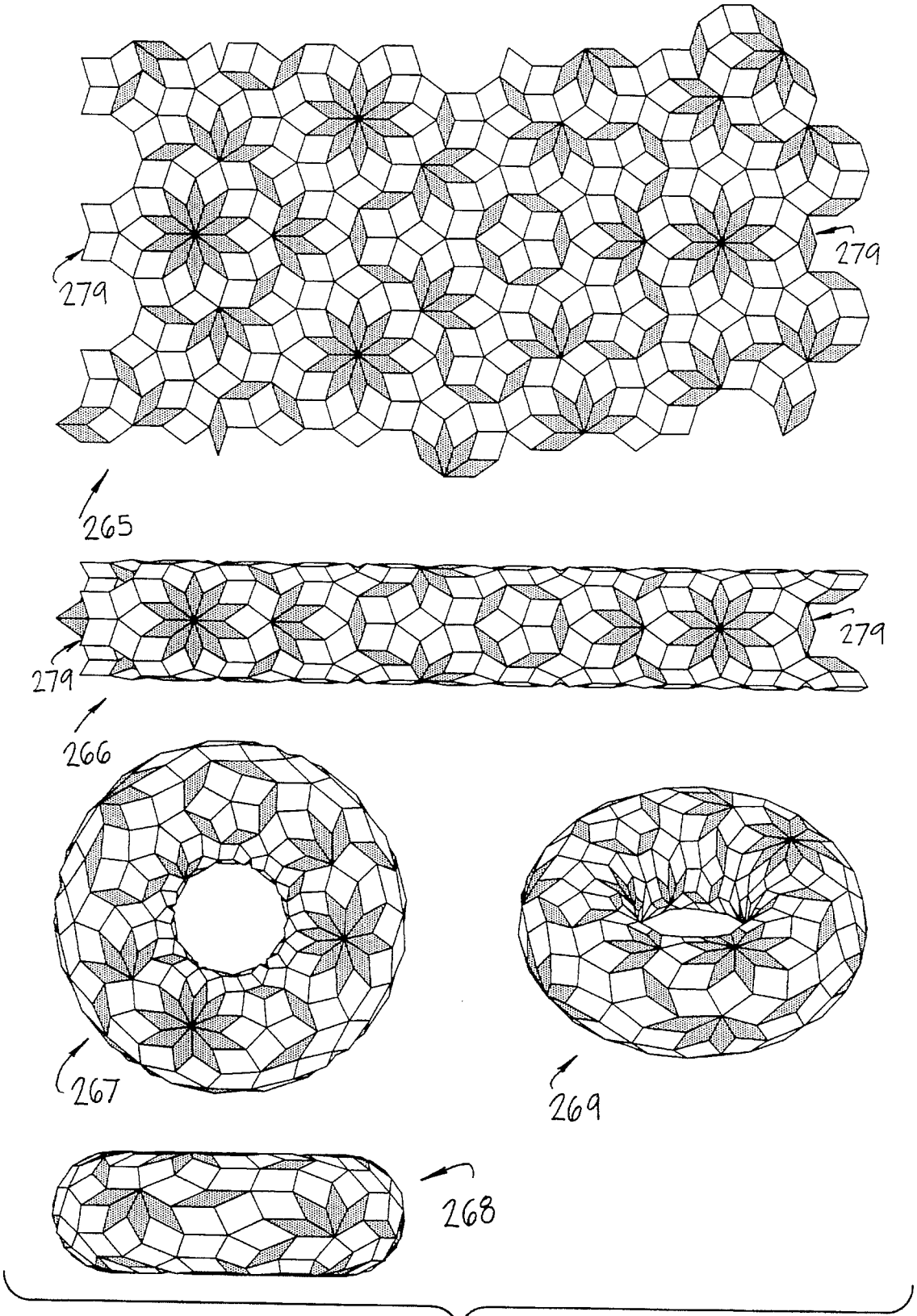
Figure 13D:
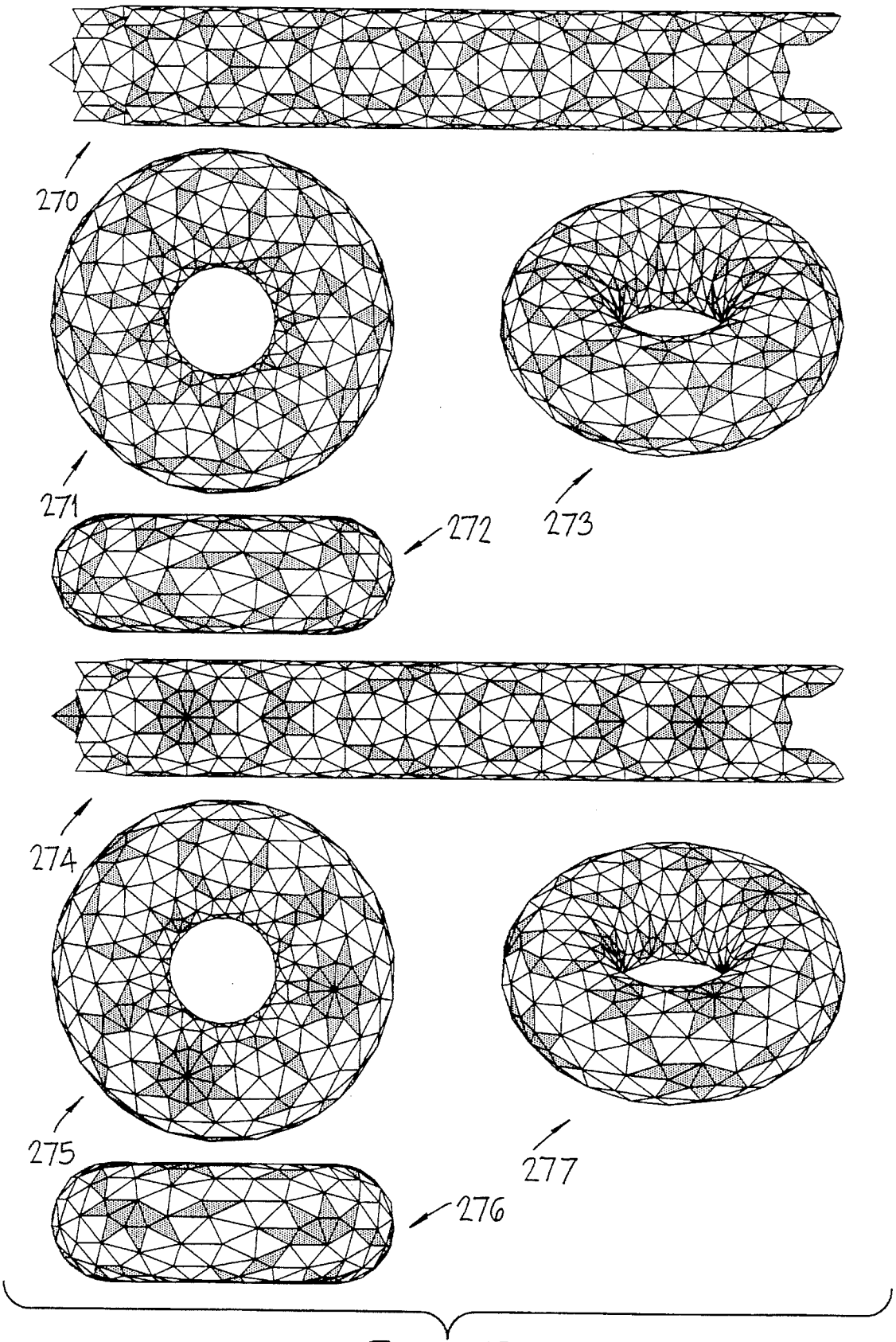

FIG. 13*a* shows the pattern from the n=4 case (obtained from FIG. 6*a*) which has been rolled into a cylinder. 258 can be seen as four squares of edge 4+3/2 joined edge-to-edge and curved. In fact a strip of these four squares can be extracted from a larger portion of the pattern 121. The size of the square matches the subdivided square 124 in FIG. 6*b*. The pattern 260 in FIG. 13*b* is extracted from 140 of FIG. 7*b*. It is a portion of the Penrose tiling which is rolled into a cylinder 261. Notice that the opposite edges 278 of this cut-out match as positive and negative. 261 is bent and its two ends 279 are joined to obtain the torus shown in its plan view 262, elevation 263 and an isometric 264. FIG. 13*c* shows the identical derivation of the cylinder 266 and the torus 267–269 from the net 265 which is extracted from 146 of FIG. 7*c*. FIG. 13*d* shows the triangulated versions of the pair of cylinders and torii of FIGS. 13*b* and 13*c*. The diagonals inserted for the triangulation are such that the new edges correspond to the geodesic curves.

5. Regular Space Structures with Subdivided Faces

The subdivided regular polygons as described in Section 2, and their curved variants as described in Section 3, can be used a faces of all regular space structures since regular structures are composed only of regular polygons. All regular space structures are well known. These exist in space of any dimension n. When n=2, we get the familiar 2-dimensional structures, n=3 are 3-dimensional structures, n=4 are 4-dimensional structures, and so on for any value of n. These also exist in Euclidean as well as non-Euclidean space, n-dimensional regular structures in Euclidean as well as hyperbolic space are known. This disclosure suggests that the faces of regular structures of any dimension in Euclidean or non-Euclidean (hyperbolic) space can be subdivided as described in Section 2, and curved variants can be derived for each as described for single polygons in Section 3. Since the number of rhombii is known within the fundamental region, the total number of rhombii can be easily calculated by multiplying this number with the number of fundamental regions which are known for each finite regular structure.

5.1 Regular Polyhedra and Plane Tessellations

Polygons, as described are notated as {p} and are classified as 2-dimensional structures. Polyhedra are the next extension in the dimensional hierarchy of structures. Regular polyhedra are 3-dimensional structures composed of p-sided polygonal faces {p}, q of which meet at every vertex of the structure. They are notated by the Schlafli symbol {p,q}. {q} is also called the vertex figure, the structure obtained by joining the mid-points of all edges surrounding a vertex. For the purposes of classification, plane tessellations are also notated as {p,q}. These are considered as degenerate polyhedra and are thus also classified as 3-dimensional structures.

Figure 14:
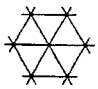
FIG. 14 shows a table of regular polyhedra and tessellations {p,q}. It includes the 5 Platonic solids, the three regular plane (Euclidean) tessellations, the infinite class of dihedra and digonal polyhedra, and the infinite class of hyperbolic tessellations.
Figure 14:
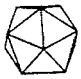
Figure 14:
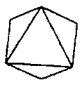
Figure 14:
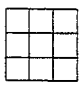
Figure 14:
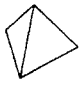
Figure 14:
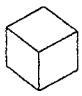
Figure 14:
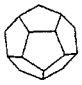
Figure 14:
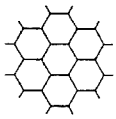

The table in FIG. 14 shows the entire range of regular polyhedra and plane tessellations {p,q}, where p and q are integers greater than 1. p is plotted along the x-axis, and q along the y-axis, and are pairs of integers are permissible structures. The five Platonic solids are shown in the table. Three of these lie in the p=3 column: tetrahedron {3,3} composed of 4triangles with 3 per vertex, octahedron {3,4} composed of 6 triangles with 4 per vertex, icosahedron {3,5} composed of 20 triangles with 5 per vertex, the remaining two are in the q=3 row: cube {4,3} composed of 6 squares with 3 per vertex, and the dodecahedron {5,3} composed of 15 pentagons with 3 per vertex.

The three plane tessellations are also seen in the table in FIG. 14. The triangle tessellation {3,6} with 6 triangles per vertex, the square tessellation with 4 squares per vertex, and the hexagonal tessellation {6,3} with 3 hexagons per vertex. If p=2 and q=2 structures along with the five regular polyhedra and the three regular plane tessellations are excluded, the remaining structures are plane hyperbolic tessellations. There are composed of hyperbolic triangles which are composed of curved circular arcs. The concept of the fundamental regions still holds, but the sides of the fundamental triangle can now be curved. The table in FIG. 14 shows the hyperbolic tessellations {7,3} composed of heptagons with 3 per vertex, its reciprocal {3,7} composed of hyperbolic triangles with 7 per vertex, and {3,∞} composed of hyperbolic triangles with infinite number meeting at a vertex.

The next section describes examples of regular polyhedra, plane tessellations and hyperbolic tessellations in which the polygonal faces are subdivided as per this disclosure. This includes all regular structures {p,q}, where p and q are any pair of numbers greater than 1. Structures with p and q equal to 2 are an infinite family of diagonal and dihedral polyhedra. Polyhedra with plane or curved faces are possible, as in the case of single polygons (except for p=2 cases which cannot exist in plane-faced states). The polyhedra are shown in their plane-faced states along with the corresponding sphere-projected states composed of spherical or warped rhombii. In many instances, the triangulated versions of the sphere-projected states are shown. The triangulation is obtained by inserting the diagonal within each rhombus. To obtain smooth spheres, the shorter diagonal (after sphere-projection) is used. Only a small selection of subdivided polygons is used to illustrate the concept. Other spherical subdivisions can be similarly derived without departing from the scope of the invention.

5.11 Regular Polyhedra with Subdivided Faces

Figure 15:
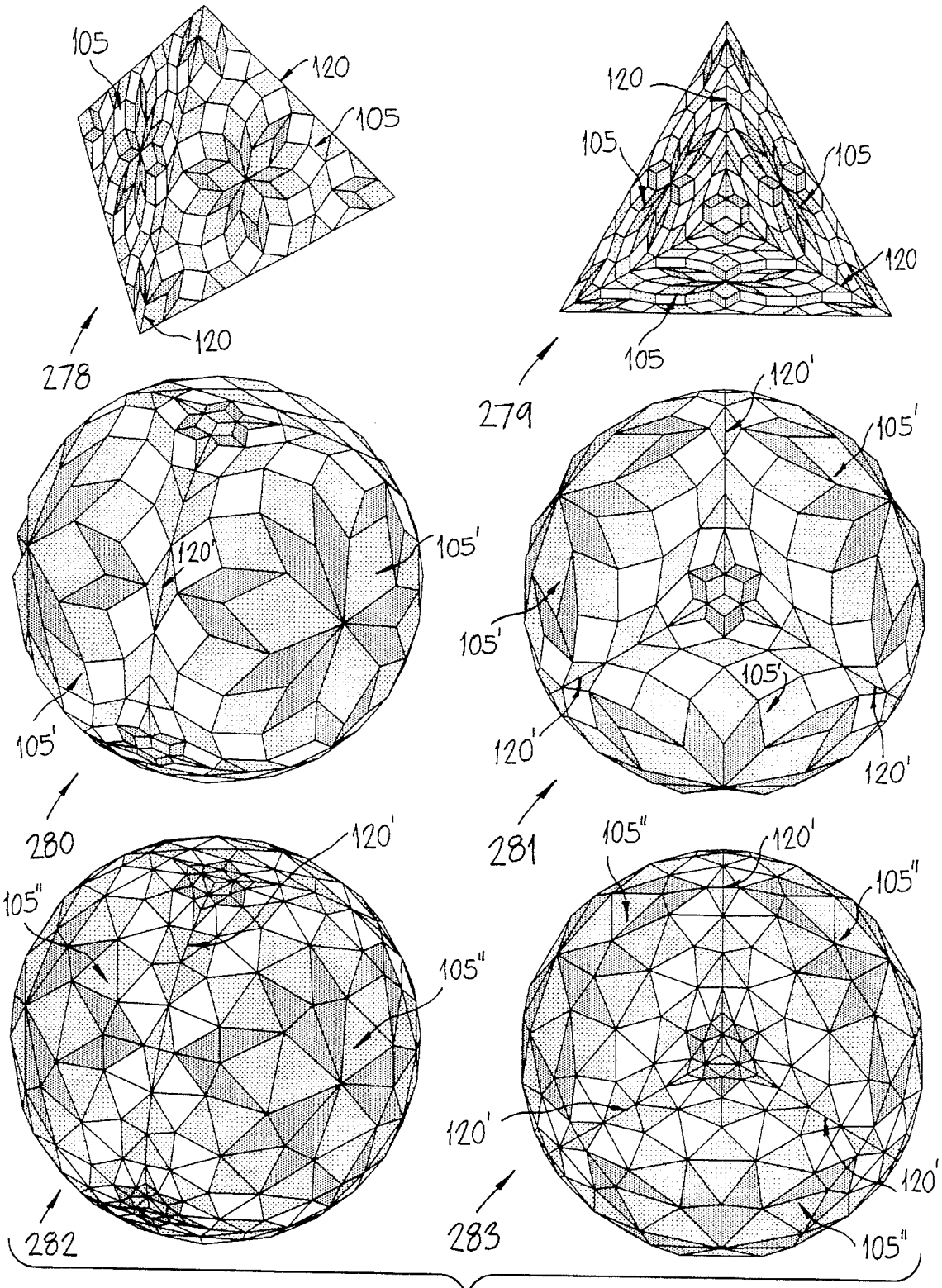
FIG. 15 shows one example of a regular tetrahedron {3,3} composed of subdivided faces in its plane-faced and sphere-projected states. A triangulated version is also shown.

FIG. 15 shows one example of a regular tetrahedron {3,3} composed of four subdivided triangles 105 of FIG. 5*a*. It is shown in its plane-faced state in 278 and 279 where it is viewed along an arbitrary angle and along its 3-fold axis, respectively. It is bound by edges 120. Since the face triangles 105 has a 3-fold symmetry, the tetrahedron retains its overall tetrahedral symmetry. 280 and 281 are the corresponding sphere-projected states composed of curved triangles 105' meeting at curved edges 120'. 282 and 283 are triangulated versions of the spherical states and are composed of triangulated faces 105".

FIG. 16*a* shows one example of a regular octahedron {3,4} composed of eight subdivided triangular faces 105 of FIG. 5*a*. 284 shows the plane-faced state bound by edges 120 and faces 105, 285 is the same viewed along its 4-fold axis. Since the face subdivision has a 3-fold symmetry, the octahedron retains a global octahedral symmetry. 286 and 287 are corresponding sphere-projected states composed of curved triangles 105' and bound by curved edges 120'. 288 and 289 are triangulated versions of 286 and 287, respectively, and are bound by curved triangulated triangles 105" and curved edges 120'.

FIG. 16*b* shows another regular octahedron {3,4} composed of eight subdivided triangles 118 of FIG. 5*b*. 290 shows the foldout net of the octahedron composed of triangles 118 bound by edges 120. This net makes it clear that the triangles 118 can be turned to other orientations and still make a match since the three edges of the triangle are subdivided in the same way. This possibility of locally turning the faces is an interesting feature of such types of subdivision. Faces can be locally rotated to change the visual and compositional character of the structure. 291 and 292 are two views of the octahedron obtained by folding the net 290. It is bound by faces 118 and edges 120. 293 and 294 are corresponding sphere-projected states composed of spherical triangles 118' meeting at curved edges 120'. Since the subdivided triangle has no symmetry and the triangles are arranged in an arbitrary manner, the resulting octahedron has lost all symmetry. This is seen in the vertex-first views in 291 and 293 where there is no 4-fold symmetry.

FIG. 17*a* shows a regular icosahedron {3,5} composed of twenty triangles 105 of FIG. 5*a*. 295 and 296 show the plane-faced versions composed of faces 105 meeting at edges 120. The faces have a 3-fold symmetry and the structure retains its global icosahedral symmetry. The 5-fold symmetry is evident from the view in 296. 297 and 298 are two views of the sphere-projected state corresponding to 295 and 296, respectively. It is bound by spherical triangles 105' meeting at circular edges 120'. 299 and 300 are corresponding triangulated states composed of triangulated faces 105" meeting at circular edges 120'. FIG. 17*b* shows an icosahedron composed of faces 119 of FIG. 5*b* in its plane-faced state in 300 and sphere-projected state in 301. Since the face 119 is asymmetric, the other faces can be matched in various ways to either produce a partial symmetry or no symmetry.

FIG. 18*a* shows a regular cube {4,3} derived from six subdivided squares 124 of FIG. 6*b*. The fold-out net is shown in 306. The net shows the six squares 124 bound by edges 120 which folds to the cube 304. From the net it is easy to see the technique of construction. Any subdivided squares from FIG. 6*b*, or from the region 121 of FIG. 6*a*, can be laid out in a net for a cube, or rearranged by rotating each face so the edges match. 302 shows one face 124 of the cube. This face has become a spherical square in 303. A similar procedure transforms 304 to the sphere 305 which is composed of curved faces 124' meeting at circular arcs 120'. In FIG. 18*b*, 307 shows the same cube 305, but one of the faces marked 124" is triangulated. 308 shows the face-first view of the sphere. There is a local symmetry in the center, but towards the periphery the subdivision is asymmetric.

FIGS. 19*a–d* show examples of a family of dodecahedra {5,3} composed of twelve identical pentagons, where each pentagon is subdivided using the Penrose tiling as shown in FIGS. 7*d* and 7*e*. Five examples are shown. These correspond to the subdivided pentagons 147, 149, 151, 153 and 155 of FIG. 7*d*.

FIG. 19*a* shows three geodesic spheres composed of subdivided pentagons 147, 149 and 151. In each case the fundamental region is shown by itself and its location within the sphere, and the geodesic spheres are shown in their triangulated and untriangulated states. 309, 313 and 317 show the sphere-projected fundamental regions 148', 150' and 151' which corresponds to the plane fundamental regions 148, 150 and 151, respectively, shown in FIG. 7*d*.

Here the full rhombii, also sphere-projected, are shown extending beyond the region instead of the half-rhombii shown earlier. These rhombii are marked 14' and 19'. 310, 314 and 318 show the locations of the subdivided fundamental regions within a sphere subdivided into 120 fundamental regions 85'. When these regions are multiplied to fill the spherical surface, the corresponding sphere projections 311, 315 and 319 are obtained. In the three cases, the spherical pentagonal face is shown in dotted line and marked 147', 149' and 151' and corresponds to the plane pentagons 147, 149 and 151, respectively. The number of rhombii in the three spheres equal 90, 360 and 450, respectively. 312, 316 and 320 are corresponding triangulated versions of the preceding rhombic states.

FIG. 19*b* shows an example of a spherical subdivided dodecahedron composed of 1470 rhombii. The top row shows the 5-fold views, the middle row shows the 3-fold views and the bottom row shows the 2-fold views. In 321, 322 and 323, the subdivided fundamental 154' is shown on a sphere composed of 120 regions marked 85'. 324, 325 and 326 show the entire geodesic sphere obtained by replicating the subdivided region 120 times, as in FIG. 19*a*. In 324, the spherical pentagon 153' is marked and corresponds to the plane pentagon 153 of FIG. 7*d*. 327, 328 and 329 show the corresponding triangulated geodesic spheres.

FIG. 19*c* shows another example of a spherical subdivided dodecahedron composed of 3840 rhombii. Each spherical pentagonal face 155' meets at circular edges 120'. The subdivision corresponds to the plane pentagon 155 in FIG. 7*d*. FIG. 19*d* shows the triangulated geodesic sphere based on FIG. 19*c* and composed of triangulated spherical pentagons 155" which meet at circular arcs 120'.

FIG. 19*e* shows an asymmetric subdivision of the dodecahedron into 450 rhombii, the same number of rhombii as the sphere 319. Each of the twelve faces is identical and corresponds to the plane subdivided pentagon 165 of FIG. 7*f* meeting at edges 120. Since the edges of this pentagon are subdivided symmetrically, the pentagons permit a local rotation of the face to other orientations. This, as in the earlier cases of the octahedron 292 and cube 304, permits many ways to combine the same number of faces with one another, leading to a variety of geodesic spheres. 332 shows an random view, 333, 334 and 335 show the symmetric views corresponding to the 5-fold, 3-fold and 2-fold axes of symmetry. 336–339 are the corresponding sphere-projected states composed of spherical pentagons 165' meeting at circular edges 120'.

5.12 Regular Tessellations with Subdivided Polygons

The concept of subdivided polygons can be applied to the three regular tessellations, the triangular tessellation {3,6}, the square tessellation {4,4} and the hexagonal tessellation {6,3}. This was already shown in part with the following examples: 290 (FIG. 16*b*) which can be easily extended into a triangular array, 306 (FIG. 18*a*) which can extended into a square array, and 255 (FIG. 12*c*) which shows a triangular array. Other triangles and hexagons from FIGS. 5*a* and 5*b*, and squares from FIGS. 6*a* and 6*b*, can be used to generate other tessellations composed of subdivided regular polygons. Curved variants, which are composed of curved polygons with regular polygonal plans, are possible. The array of cross-vaults 221 (FIG. 10*b*), saddles 248 (FIG. 12*a*) and hexagonal pseudo-sphere 257 (FIG. 12*c*) were already shown. Other examples can be similarly derived.

5.13 Regular Hyperbolic Tessellations with Subdivided Polygons

In hyperbolic tessellations, known from prior literature, the same concept of the fundamental region applies, but the geometry changes. For example, the right-angled triangle fundamental region of Type I is modified to a right-angled triangle with curved sides such that the sum of the angles within this region is less than 180°. Also, reflections take place across curved mirror planes. The resulting polygons have curved sides made from circular arcs. The techniques of subdivision of the fundamental region, or the entire polygon, into rhombii extends to hyperbolic tessellations. The hyperbolic polygons can be subdivided into hyperbolic rhombii with curved sides.

One example of a regular hyperbolic tessellation {4,5} composed of hyperbolic squares with 5 per vertex is shown in FIG. 20. One of the square 341 is divided into two halves, 342 and 343, to show the application of the fundamental region Type V. The region 343 is subdivided into rhombii based on the Penrose tiling taken from the $\phi^3$-half-rhombus KLM. This example will work for all hyperbolic tessellations with an even p and q=5. Other examples can be similarly derived. For example, the hyperbolic tessellations {3,q} with q>6 can utilize the subdivided triangles of FIGS. 5*a* and 5*b*. The tessellations {4,q} with q>4 can use subdivided squares, {5,q} can use subdivided pentagons, and so on.

5.14 Digonal Polyhedra and Dihedra with Subdivided Digons

The structures {p,2} are an infinite class of dihedra composed of two faces but any number of sides. The reciprocal structures {2,q} are composed of digons with q meeting at each of its two vertices. These structures can also be subdivided with rhombii. In FIG. 21, 344 is a digonal pentahedron composed of five digons 348 meeting at curved edges 120'. 345 and 346 are two nets from the Penrose tiling of FIG. 7*b* which can be mapped onto 344. There is one vertex in the middle, and the points marked Q will all meet at the other vertex. 345 has a fundamental region 349 which is subdivided to give 350, and the region corresponds to fundamental region Type I. 346 has a fundamental region 351 which is subdivided to give 352. This region corresponds to fundamental region Type II.

347 is an elevation of 7-sided dihedron. The edge 120 divides the two faces. The subdivided curved fundamental region 353 corresponds to the plane region 176 of FIG. 8*a*. All subdivided polygons can be converted into dihedra.

5.2 Higher-Dimensional Structures with Subdivided Faces

The Schlafli symbol extends to higher-dimensional space structures (termed polytopes). The notation {p,q,r} represents all regular 4-dimensional polytopes composed of cells {p,q} and vertex figures {q,r}. Since the cells and vertex figures must be regular polyhedra, the number of possibilities of regular 4-dimensional polytopes are limited to seven, namely, 5-cell {3,3,3} composed of 5 tetrahedra, 8-cell {4,3,3}, also called the hyper-cube and composed of 8 cubes, 16-cell {3,3,4} composed of 16 tetrahedra, 24-cell {3,4,3} composed of 24 octahedra, 120-cell {5,3,3} composed of 120 dodecahedra, 600-cell {3,3,5} composed of 600 tetrahedra, and infinite cubic honeycomb {4,3,4} composed of cubes.

All of these structures are known from prior art. This application suggests the use of subdivided polygons as faces of these structures. For example, the subdivided triangles of FIGS. 5*a* and 5*b* could be used as faces of the 5-cell, 16-cell, 24-cell and the 600-cell. Similarly, the subdivided squares could be used as faces of the 8-cell and the cubic honeycomb. The subdivided pentagons could be used as faces of the 120-cell. This idea can be extended to 5-dimensional structures where there are six Euclidean cases of which two are honeycombs, but four are composed of triangles, and two are composed of squares. In spaces of dimension greater than 5, there are only four polytopes for each higher dimension. Two of these are the hypercube and hypercubic lattice composed of squares, the other two are finite structures composed of triangles. These higher-space structures are also known from mathematics.

A few examples showing the application of the concept described here are illustrated in FIGS. 22*a* and 22*b*. When these are built, the regularity of the faces is lost by projection from higher space where indeed the faces are regular. In FIG. 22*a*, 354 is one tetrahedron of the 5-cell 362 is shown. It of composed of faces 114 of FIG. 5*b* meeting at edges 120. The faces will get distorted to 114' as shown and the new edges 120' will change lengths when projected to 3- or 2-dimensions. 355 and 366 are two views of the same octahedral cell of a 4-dimensional polytope 16-cell or a 5-dimensional honeycomb. In its projection, it is a distorted version of the regular octahedron 284 of FIG. 16*a*.

357 is a distorted version of the regular icosahedron 295 of FIG. 17*a*. It has projected faces 105' and projected edges 120'. The cell shown is a composite if twenty tetrahedral cells like 278, and the cluster is a portion of the 4-dimensional polytope called 600-cell. 358 shows one cube 304' (same as 304 in FIG. 18*a*) of the 8-cell 363. In its projected state, the cube is a rhombohedron. 359 is the shell of a 4-cube, a 4-zonohedron, where the face is divided differently. In fact, the subdivision of the entire surface is topologically isomorphic to 285. 361 shows 3 dodecahedral cells of the 120-cell. In their 3-dimensional projection, the upper cells are "squished" as shown with respect to the lowest one which is true. The subdivided dodecahedra marked 330', 330", and 330'" correspond to the sphere 330 shown in FIG. 19*c*.

5.3 Hyperbolic Polyhedra

Regular hyperbolic polyhedra, as analogs of the hyperbolic tessellations, exist in 4-dimensional space. There are four of these, namely, {4,3,5} composed of hyperbolic cubes, {5,3,5} composed of hyperbolic dodecahedra, {5,3,4} also composed of hyperbolic dodecahedra, and {3,5,3} composed of hyperbolic icosahedra. These have curved faces and curved edges. In 5-dimensional space there are 5 regular hyperbolic polytopes, and beyond this there are none. All of these cases are known from prior literature. However, if the definition of regularity were relaxed, more examples are permissible.

This disclosure suggests that the faces of the these hyperbolic polyhedra could be subdivided polygons as described earlier in FIGS. 5–7. FIG. 23 shows one example of a hyperbolic dodecahedron 265 with subdivided pentagonal faces 155" alongside the regular case shown in 364. The hyperbolic faces 15" are analogous to the plane faces 155 and the spherical faces 155' shown earlier in 330. The hyperbolic edges 120" replace the plane edges 120 or the spherical edges 120'.

6. Other Regular-faced Structures and Variants

The subdivided regular polygonal faces of FIGS. 5–7 could be used as faces of any structures composed only one type of polygon. These polygons could be plane or curved and the edges could be straight or curved.

Assorted examples shown in FIG. 24 include structures composed only of squares 65' or triangles 64' or hexagons 67' bound by edges 120. The cubic packing 366 composed of cubes 374 or the derivative space labyrinth composed of squares. The "octet" close-packing 366 composed of octahedra 376 and tetrahedra 375 or the derivative space labyrinth. The space labyrinths 367 composed of octahedra 376 connected by octahedra and having selected faces removed, and 368 composed of icosahedra 377 connected with octahedra 376, also with selected faces removed. The tetrahedral helix 369 composed of tetrahedra 375, the octahedral tower 370 composed of stacked octahedra 376, numerous deltahedra composed of only triangles like the bipyramids 371 and 372. The space labyrinth 373 composed of regular hexagons 67' which make up a 3-dimensional unit 378, a truncated octahedron with square faces removed. All structures shown must be imagined to be composed of subdivided polygonal faces as opposed to the plain faces as illustrated.

FIGS. 25*a* and 25*b* show on example of a curved space labyrinth compose only of hexagons. The base structure is topologically identical with 373 of FIG. 24 and the example corresponds to the known Schwartz surface. The 3-dimensional unit or cell of the surface is shown in 379 and 380, viewed along its "4-fold" and "3-fold views". The cell is composed of 8 saddle hexagons 381 having a minimal surface. 382 is a side view of 381. The plane face version is composed of the unit 122 of FIG. 6*b* which uses two rhombii from n=4. Here these exist in their curved state 122' and six such pieces make up the hexagon 381 in a manner that the hexagon has a 2-fold symmetry. The single unit 379 is subdivided non-periodically. 383 is a front view of the periodic repeat of the unit 379, and 384 shows another view. FIG. 25*b* shows an interior view of the space labyrinth.

Other ramifications of the present invention include the application of the subdivided polygons to any periodic nets. Several cases are shown in FIG. 26 and are restricted to the triangular, square and hexagonal nets composed of triangles 64', squares 65' and hexagons 67', respectively, and bound by edges 120. The triangle nets are used in the tetrahedron 385 and its concave state 390, the octahedron 386, and the icosahedron 387 along with its convex state 389. The square net is used in the cube 388 and the inflatable 391. The hexagonal net is shown here on a tensile surface in 392 and 393.

The subdivided triangles, squares and hexagons of FIGS. 5 and 6 can be applied to each individual triangle, square or hexagon shown here. For example, the subdivided triangle 118 of FIG. 5*b* could be applied to any of the triangular nets (already disclosed in part in the fold-out pattern 290 of FIG. 16*b*. Other subdivided triangles from FIG. 5 could be used, and new one developed based on the concept. The triangles could be mixed and matched as lon as the edge conditions permit it. The hexagonal pattern 255 of FIG. 12*c* could be used for 392 and 393. And so on.

7. Further Subdivisions, Multi-Layering and Changing Lengths

A further extension of the concept, briefly described with FIG. 3, is to subdivide the rhombii into smaller self-similar rhombii in a periodic manner. This is shown in 394 for the p=7 fundamental region 174 shown earlier in FIG. 8*a*. The three types of rhombii are subdivided as shown earlier in FIG. 3. The smaller rhombii are triangulated in 395 to generate locally periodic triangular arrays. This concept permits local periodicity within global non-periodicity.

All subdivision described so far were restricted to to a single-layered surface whether plane or curved. The concept can be extended to make the surface into a double-layered, triple-layered or multi-layered structure. The multi-layered structures could be skeletal or space-filled with blocks. In 396, the geodesic sphere 298 of FIG. 17*a* has been transformed by erecting pyramids on the rhombic faces. Similarly, in 397, the triangulated geodesic surface 300 of FIG.

17*a* has also been transformed. In schematic section 398, this process is similar to acquiring a second layer if the apices of the pyramids were to be interconnected. Clearly, this process can be continued for any number of curved layers. Alternatively, instead of erecting pyramids, "prisms" could be erected on each rhombus or triangle. The prisms are in fact tapered as shown in the schematic section 399. Through these two techniques, the surfaces could become 3-dimensional.

Another variation would be to change the lengths of edges of the rhombii, converting them into parallelograms. One example is shown in 400, where the region 174 is transformed to 174'. Some of the rhombii have unequal lengths. Only the transformed rhombii are indicated. This technique will apply to all examples in this disclosure, whether plane or curved.

8. Applications to Building Systems

The geometry of the subdivisions presented here and their mapping onto various types of plane and curved surfaces open up interesting design and architectural applications. All examples of geometric structures can be converted into physical structures by converting the geometric elements into the components of a building system, i.e. the vertices into nodes or joints, edges into struts or linear members of a building structure, faces into surface members of a structure, and cells into the 3-dimensional blocks. From these building components, any combination of components could be used. Different combinations will work for different design situations.

Nodes could be connected to other nodes through struts. Suitable means, mechanical or otherwise, of coupling the two could be provided though the use of threads, screws, pins, locking devices, fastening devices, or simply welding pieces together. The linear members could be attached to others without the use of physically present nodes, as in the case when members are cast together. The surface members could be attached to others through linear connectors and attachment devices. The node-and-strut system could be integrated with the panels which could be transparent or opaque. The geometry of subdivision could provide the source geometry of cables nets in tensile structures based on the invention. The tensile nets could be air-supported or hung. Membranes could be integrated with space frames derived from the geometries described herein. The geometry of subdivisions, especially the triangulated cases, could be used to lay down reinforcement inside cast concrete domes and shells.

One example of the development of a double-layered space frame geodesic dome structure from the basic geometry is described in FIG. 27*b*. 401 shows the fundamental region corresponding to the geodesic sphere of FIG. 17*a*. In 402, all the vertices are replaced by nodes and the edges by struts to give a rhombic space frame. Panels could be inserted in between. In 403, the rhombic space frame is triangulated by inserting appropriate diagonals. Alternatively, in 404, a pyramid is raised on each rhombus of 402. In 405, the outer points of the rhombic caps are joined by additional struts (only partially shown). Alternatively, these could be filled 3-dimensional volumes or blocks. 406–409 show schematic sections through double-layered and triple-layered domes. Two are triangulated in section, the other two are trapezoids in section and could be triangulated if needed. These sections could represent space frames or space-filling with blocks. 410 shows a section through a node 413 which receives the struts 414 through a male-female connection. 411 is an alternative which also shows a pin which connects the nodes 415 to the strut 414. 412 shows a section through strip joint 416 which connects the panels 417. Besides their use as alternatives to the geodesic dome, the structures described herein have an aesthetic appeal. Modularity has become synonymous with repetition. The examples disclosed here show non-repeating designs which not only challenge an established paradigm, but also are intriguing because the "order" in the design is not that obvious. Other applications include tiling designs, where tiles of overall standard shapes like regular polygons could be patterned with a fairly complex design but based on a relatively simple procedure. Non-periodic domes, vaults, various curved surfaces, non-periodic designs on surfaces, and non-periodic spaces are interesting possibilities for advancing the state-of-art of building.

What is claimed is:

1. Curved space structures comprising:

a polygonal structure having p sides, where p is an integer greater than two, wherein said structure is composed of a plurality of 4-sided and 3-sided polygonal elements, each said element having vertices and edges, and arranged side by side such that two adjacent said elements share one of said edges and said 3-sided polygonal elements lie on the peripheri of said plurality of said 4-sided elements and share said edges with said sides of said polygonal structure said elements are further arranged such that at least two said vertices of each adjacent said element lie on a continuous curved surface, said elements, said edges and said vertices are engaged with one another by attachment means, and where the arrangement of said elements is identical to the arrangement of a plurality of at least two different sets of identical parallelograms and half-parallelograms in a corresponding plane regular polygon with p equal sides and p equal angles such that every said 4-sided element in said curved polygonal structure corresponds to a said parallelogram in said plane polygon and every said 3-sided element in said polygonal structure corresponds to a said half-parallelogram in said plane polygon, wherein said half-parallelograms are obtained by bisecting said parallelograms, wherein said arrangement of said parallelograms within at least one said polygonal structure includes at least a portion which is non-periodic, and further includes a cluster of more than four said elements around at least two said vertices, wherein the interior angles of said parallelograms of said sets equal 180°/n multiplied by 'a', where 'a' equals all integers ranging from 1 to n–1, and n equals p, 2p or p/2.

2. Curved space structures comprising:

a plurality of curved polygonal structures, each having p sides, where p is an integer greater than two, and wherein at least two said polygonal structures meet at each said side, wherein each said polygonal structure is composed of a plurality of 4-sided and 3-sided polygonal elements, each said element having vertices and edges, and arranged side by side such that two adjacent said elements share one of said edges and said 3-sided polygonal elements lie on the peripheri of said plurality of said 4-sided elements and share said edges with said sides of said polygonal structure said elements are further arranged such that at least two said vertices of each adjacent said element lie on a continuous curved surface, said elements, said edges and said vertices are engaged with one another by attachment means, and where the plurality of said curved polygonal structures corresponds to a plurality of plane regular polygons, each with p equal sides and p equal angles, and where the arrangement of said elements within each said polygonal structure is identical to the arrangement of a plurality of at least two different sets of identical parallelograms and half-parallelograms in corresponding said plane regular polygon such that every said 4-sided element in each said curved polygonal structure corresponds to a said parallelogram in corresponding said plane regular polygon and every said 3-sided element in said polygonal structure corresponds to a said half-parallelogram in said plane polygon, wherein said half-parallelograms are obtained by bisecting said parallelograms, wherein said arrangement of said parallelograms within at least one said polygonal structure includes at least a portion which is non-periodic, and further includes a cluster of more than four said elements around at least two said vertices, wherein the interior angles of said parallelograms of said sets equal 180°/n multiplied by 'a', where 'a' equals all integers ranging from 1 to n−1, and n equals p, 2p or p/2.

3. Space structures comprising:

a plurality of plane polygonal structures, each having p sides and p angles, wherein at least two said polygonal structures meet at each said side and where p is an integer greater than two, wherein each said polygonal structure is composed of a plurality of at least two different sets of identical 4-sided and 3-sided polygonal elements, each said element having vertices and edges, and arranged side by side such that two adjacent said elements share one of said edges and said 3-sided polygonal elements lie on the peripheri of said plurality of said 4-sided elements and share said edges with said sides of said polygonal structure wherein said 4-sided elements are parallelograms and said 3-sided elements are half-parallelograms and where said half-parallelograms are obtained by bisecting said parallelograms, said elements are further arranged within said polygonal structure such that said vertices and said edges of each adjacent said element lie on a continuous plane surface, said elements, said edges and said vertices are engaged with one another by attachment means, and said arrangement of said parallelograms within at least one said polygonal structure includes at least a portion which is non-periodic, and further includes a cluster of more than four said elements around at least two said vertices, wherein the interior angles of said parallelograms of said sets equal 180°/n multiplied by 'a', where 'a' equals all integers ranging from 1 to n−1, and n equals p, 2p or p/2.

4. Space structures according to claim 3, wherein said polygonal structures are regular or non-regular polygons.

5. Curved space structures as per claim 1, wherein said polygonal structure has a p-fold symmetry and wherein said non-periodic portion is (1/p)th or (½p)th portion of said polygon.

6. Curved space structures as per claim 1, wherein said polygonal structure has no symmetry.

7. Curved space structures as per claim 2, wherein said polygonal structure has a p-fold symmetry and wherein said non-periodic portion is (1/p)th or (½p)th portion of said polygon.

8. Curved space structures as per claim 2, wherein said polygonal structure has no symmetry.

9. Space structures as per claim 3, wherein said polygonal structure has a p-fold symmetry and wherein said non-periodic portion is (1/p)th or (½p)th portion of said polygon.

10. Space structures as per claim 3, wherein said polygonal structure has no symmetry.

11. Curved space structures as per claim 1, wherein said parallelograms are subdivided into two triangles by inserting a diagonal member.

12. Curved space structures as per claim 11, wherein said triangles are further subdivided into a periodic array of triangles.

13. Curved space structures as per claim 2, wherein said parallelograms are subdivided into two triangles by inserting a diagonal member.

14. Curved space structures as per claim 1, wherein said continuous curved surface is irregular.

15. Curved space structures as per claim 1, wherein said edges of said polygons are straight or curved.

16. Curved space structures as per claim 1, wherein said edges of said parallelograms are equal.

17. Curved space structures as per claim 1, wherein said space structures consist of more than one layer and wherein said layers are inteconnected.

18. Curved space structures as per claim 2, wherein said plurality of said curved polygonal structures defines a spherical regular polyhedron.

19. Curved space structures as per claim 2, wherein said plurality of said plane regular polygons defines a regular plane tessellation selected from the group consisting of:

triangular tessellation composed of equilateral triangles, square tessellation composed of squares, and hexagonal tessellation composed of regaular hexagons.

20. Curved space structures as per claim 2, wherein said edges of said parallelograms are equal.

21. Curved space structures as per claim 2, wherein said space structures consist of more than one layer and wherein said layers are inteconnected.

22. Curved space structures as per claim 2, wherein said plurality of said curved polygonal structures defines a curved space labyrinth.

23. Curved space structures as per claim 2, wherein said plurality of said curved polygonal structures defines a plane tessellation composed of plane polygons with curved sides.

24. Curved space structures as per claim 2, wherein said plurality of said curved polygonal structures defines a regular polyhedron with concave edges.

25. Curved space structures as per claim 13, wherein said triangles are further subdivided into a periodic array of triangles.

* * * * *